US005465760A

United States Patent [19]

Mohamed et al.

[11] Patent Number: 5,465,760

[45] Date of Patent: Nov. 14, 1995

[54] MULTI-LAYER THREE-DIMENSIONAL FABRIC AND METHOD FOR PRODUCING

[75] Inventors: Mansour H. Mohamed; A. Kadir Bilisik, both of Raleigh, N.C.

[73] Assignee: North Carolina State University, Raleigh, N.C.

[21] Appl. No.: 142,864

[22] Filed: Oct. 25, 1993

[51] Int. Cl.[6] ..... D03D 41/00; D03D 47/04; D03D 13/00

[52] U.S. Cl. ..... 139/11; 139/DIG. 1

[58] Field of Search ..... 428/902, 408, 428/113; 139/DIG. 1, 384 R, 11

[56] References Cited

U.S. PATENT DOCUMENTS

| | | | |
|---|---|---|---|
| 4,168,337 | 9/1979 | Maistre . | |
| 4,169,393 | 10/1979 | Wetzel et al. | 139/DIG. 1 X |
| 4,191,219 | 3/1980 | Kaye | 139/DIG. 1 X |
| 4,219,597 | 8/1980 | Maistre . | |
| 4,252,588 | 2/1981 | Kratsche et al. . | |
| 4,400,421 | 8/1983 | Stover . | |
| 5,076,330 | 12/1991 | Kimbara et al. . | |
| 5,085,252 | 2/1992 | Mohamed et al. . | |
| 5,137,058 | 8/1992 | Anahara et al. . | |
| 5,270,094 | 12/1993 | Anahara et al. | 139/384 R X |

*Primary Examiner*—Andrew M. Falik
*Attorney, Agent, or Firm*—Richard F. Jenkins

[57] ABSTRACT

A multi-axial, three-dimensional fabric formed from five yarn systems. The yarn systems include warp yarn arranged in parallel with the longitudinal direction of the fabric and a first pair of bias yarn layer positioned on the front surface of the warp yarn and a second pair of bias yarn layer positioned on the back surface of the warp yarn. Vertical yarn is arranged in a thicknesswise direction of the fabric in a perpendicularly intersecting relationship to the warp yarns. Weft yarns are arranged in the widthwise direction of the fabric and in a perpendicularly intersecting relationship to the warp yarns so as to provide a multi-axial, three-dimensional fabric with enhanced resistance to in-plane shear.

10 Claims, 59 Drawing Sheets

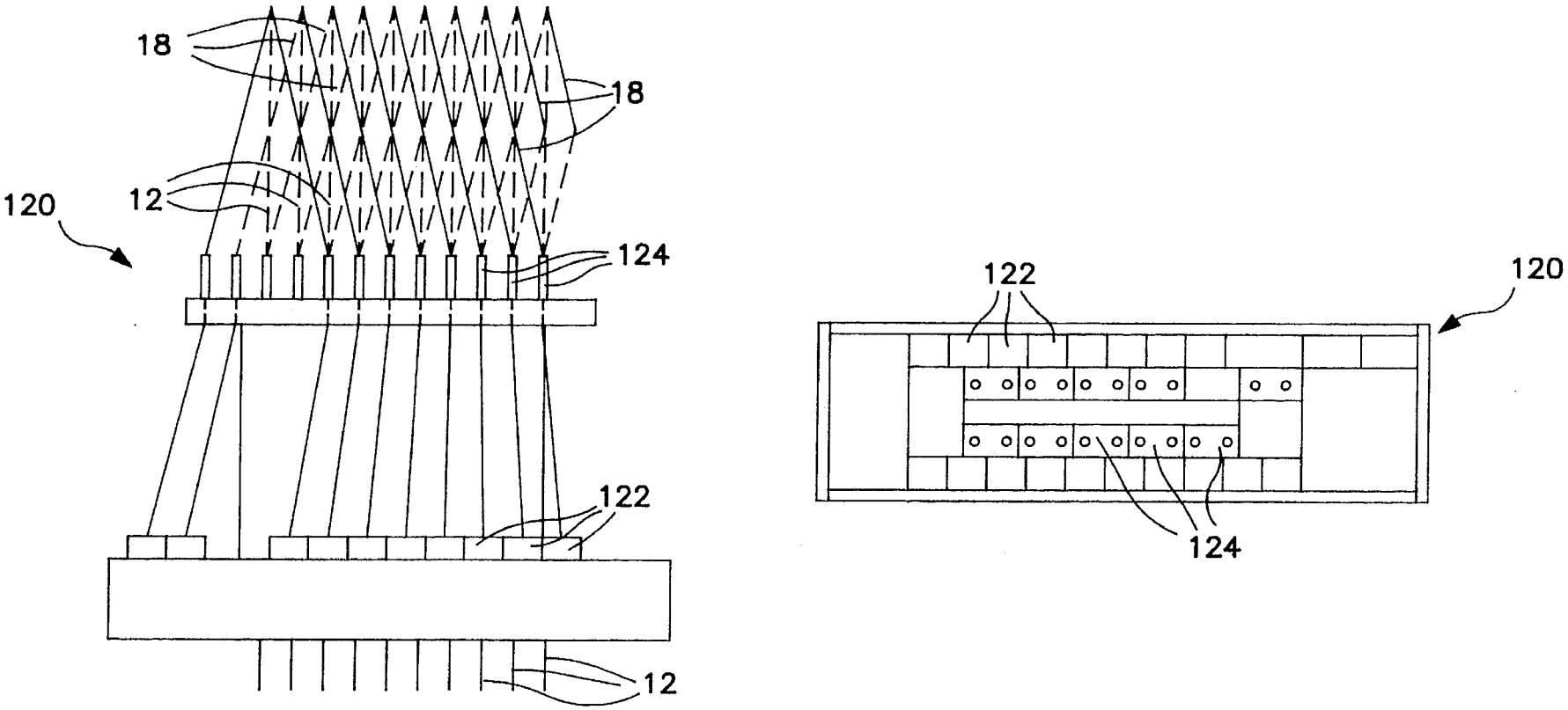
FIG. 13(d)1

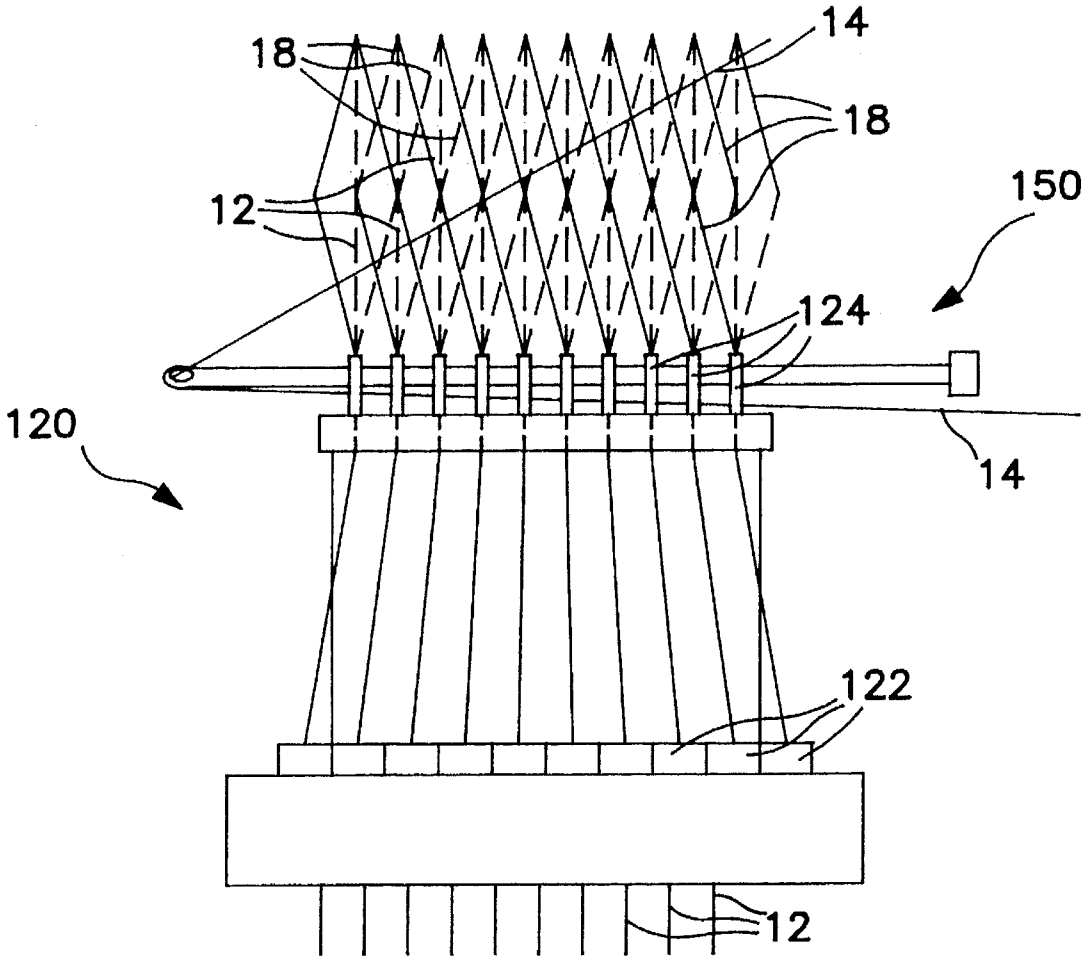
FIG. 13(e) I

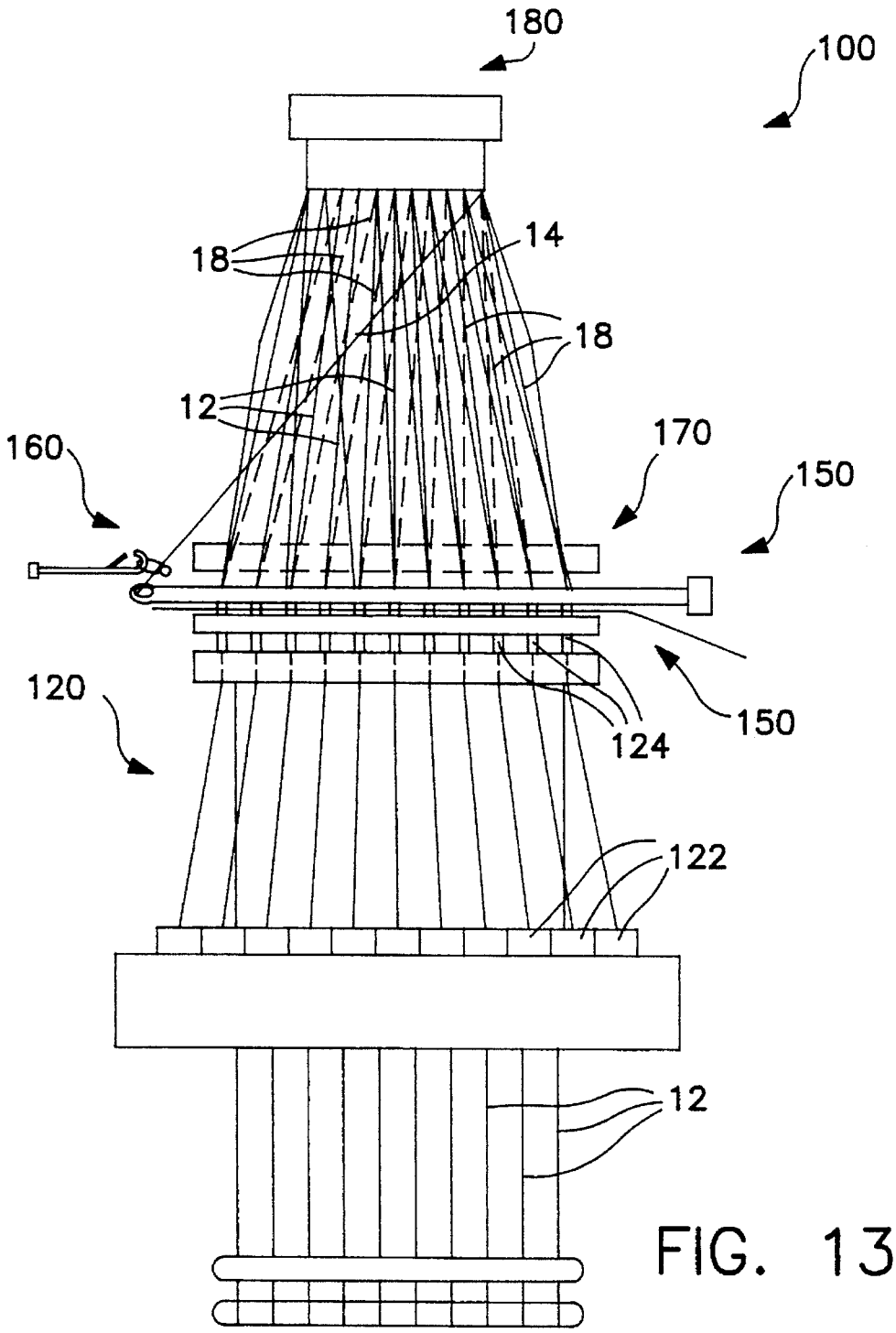
FIG. 13(e)$_2$

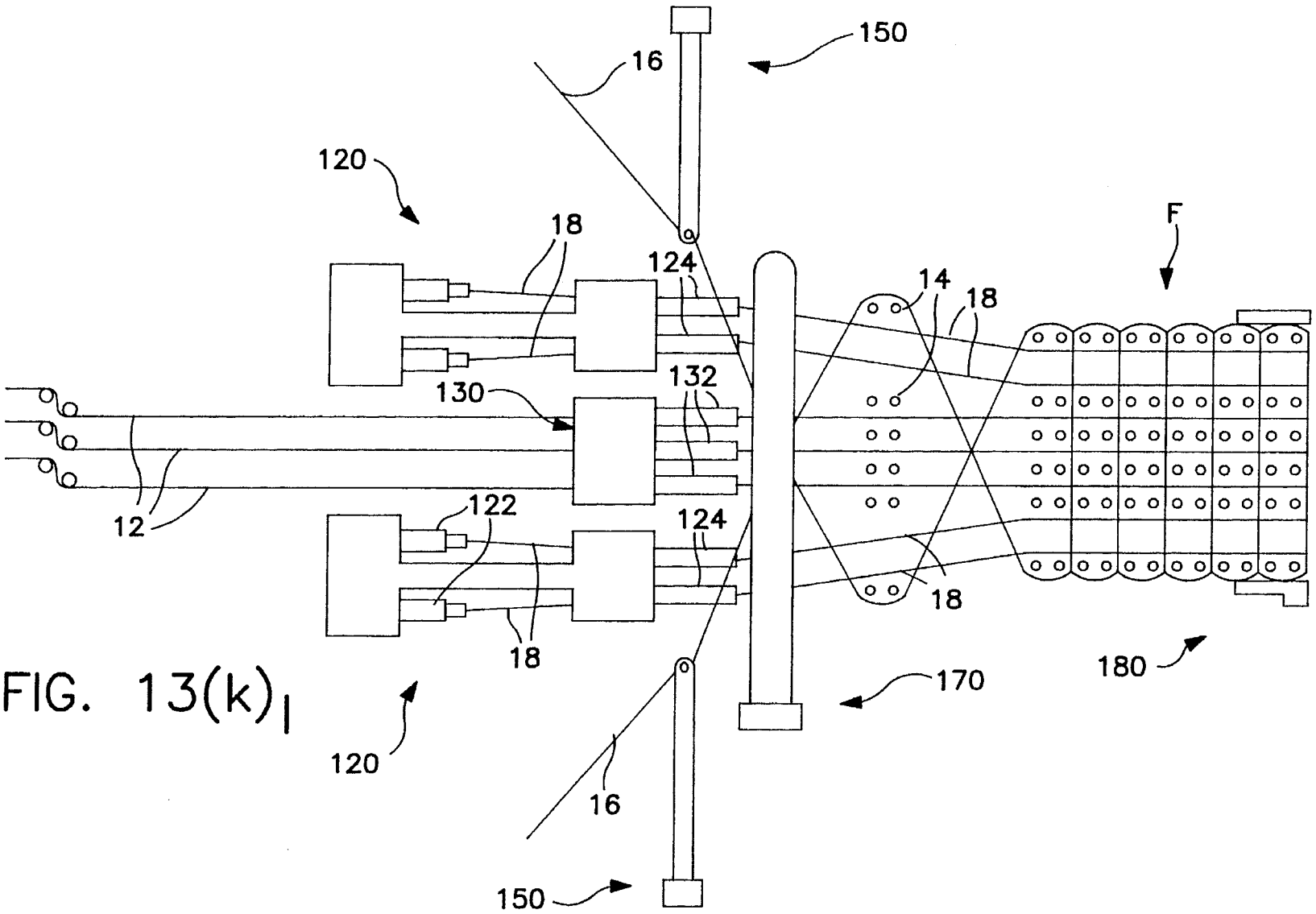
FIG. 13(k)1

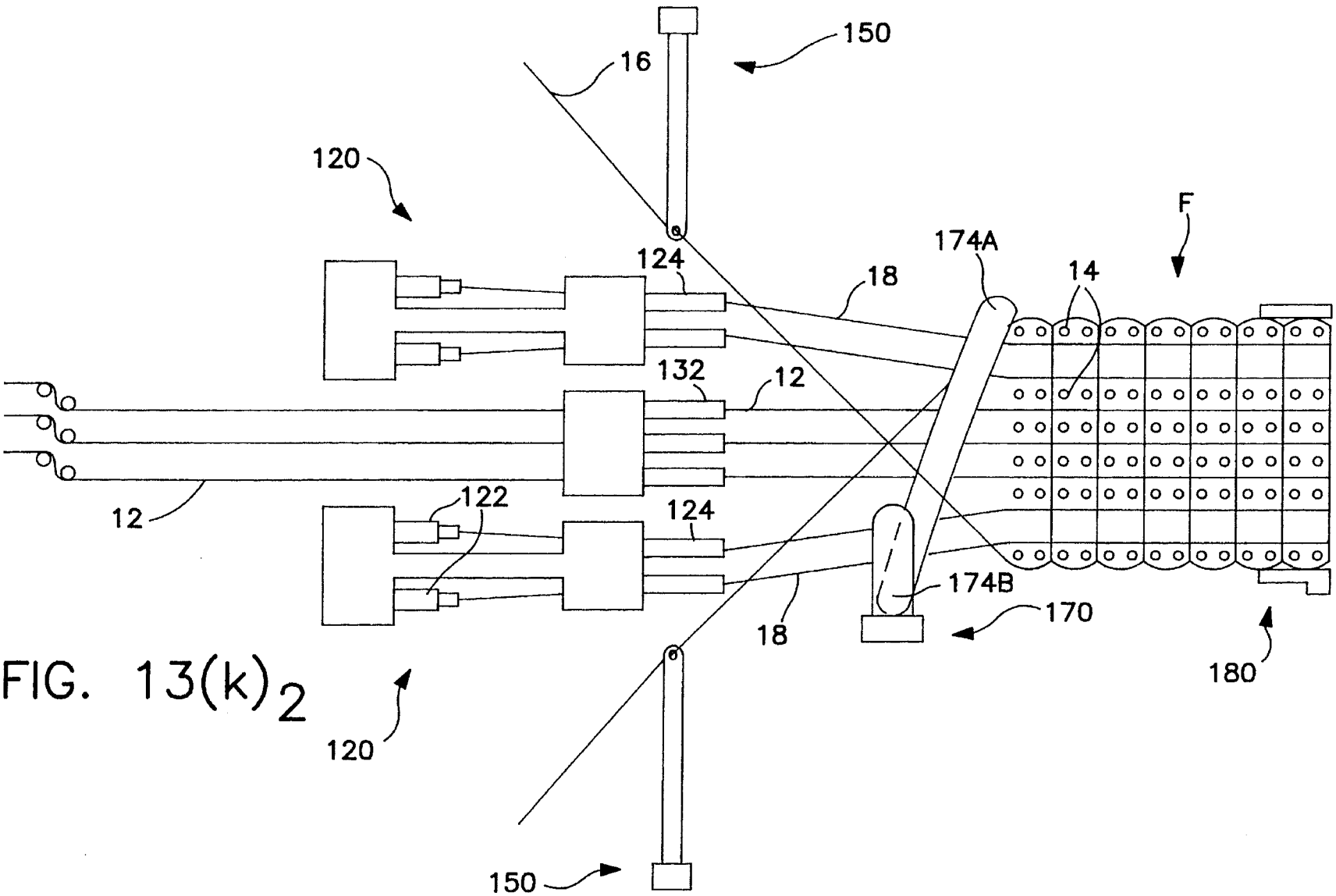
FIG. 13(k)2

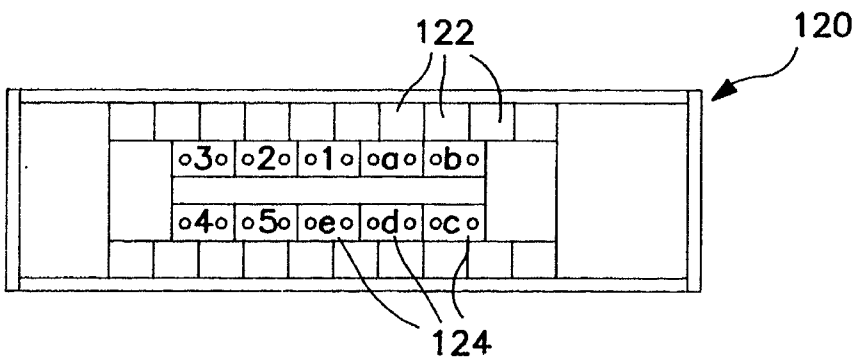
FIG. 16(i)
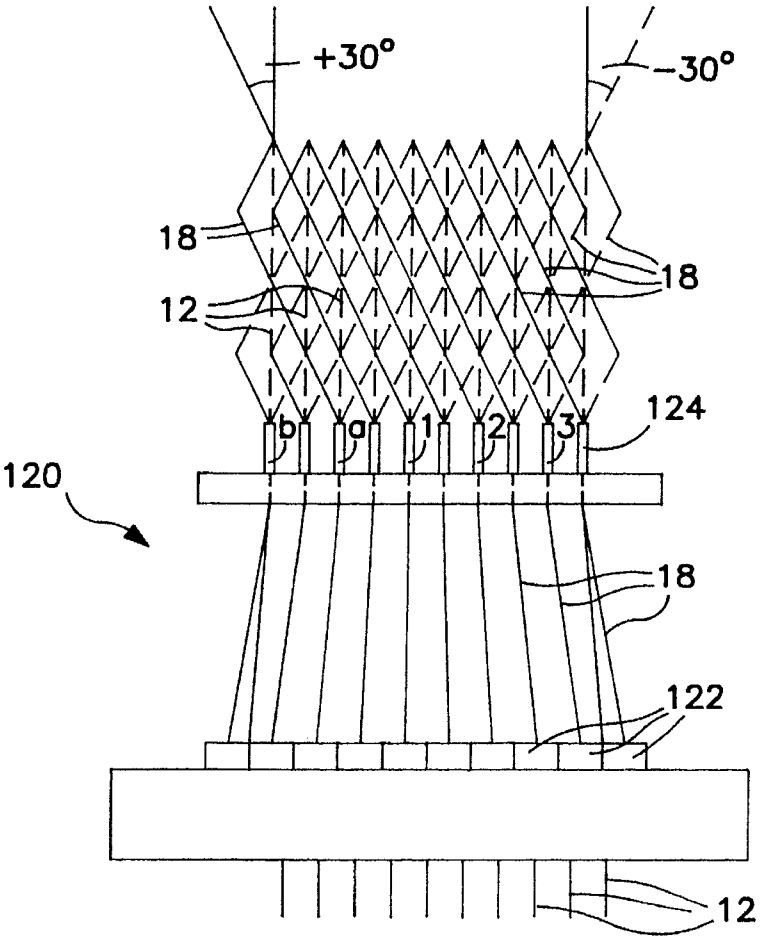

MULTI-LAYER THREE-DIMENSIONAL FABRIC AND METHOD FOR PRODUCING

GOVERNMENT INTEREST

This invention was made with Government support under Grant No. 99-27-07400 awarded by the U.S. Department of Commerce. The Government has certain rights in this invention.

TECHNICAL FIELD

The present invention relates to three-dimensional woven fabric formed of warp, weft and vertical yarns, and more particularly to a three-dimensional woven fabric incorporating a pair of bias yarn layers on the front surface and a pair of bias yarn layers on the back surface of the woven fabric for enhanced in-plane shear strength and modulus vis-a-vis conventional three-dimensional fabric, and also to a method for producing the fabric.

BACKGROUND ART

The use of high-performance composite fiber materials is becoming increasingly common in applications such as aerospace and aircraft structural components. As is known to those familiar with the art, fiber reinforced composites consist of a reinforcing fiber such as carbon or KEVLAR and a surrounding matrix of epoxy, PEEK or the like. Most of the composite materials are formed by laminating several layers of textile fabric, by filament winding or by cross-laying of tapes of continuous filament fibers. However, all of the structures tend to suffer from a tendency toward delamination. Thus, efforts have been made to develop three-dimensional braided, woven and knitted preforms as a solution to the delamination problems inherent in laminated composite structures.

For example, U.S. Pat. No. 3,834,424 to Fukuta et al. discloses a three-dimensional woven fabric as well as method and apparatus for manufacture thereof. The Fukuta et al. fabric is constructed by inserting a number of double filling yarns between the layers of warp yarns and then inserting vertical yarns between the rows of warp yarns perpendicularly to the filling and warp yarn directions. The resulting construction is packed together using a reed and is similar to traditional weaving with the distinction being that "filling" yarns are added in both the filling and vertical directions. Fukuta et al. essentially discloses a three-dimensional orthogonal woven fabric wherein all three yarn systems are mutually perpendicular, but it does not disclose or describe any three-dimensional woven fabric having a configuration other than a rectangular cross-sectional shape. This is a severe limitation of Fukuta et al. since the ability to form a three-dimensional orthogonal weave with differently shaped cross sections (such as T || T ||) is very important to the formation of preforms for fibrous composite materials. U.S. Pat. No. 5,085,252 to Mohamed et al. overcomes this shortcoming of Fukuta et al. by providing a three-dimensional weaving method which provides for differential weft insertion from both sides of the fabric formation zone so as to allow for superior capability of producing three-dimensional fabric constructions of substantially any desired cross-sectional configuration.

Also of interest, Fukuta et al. U.S. Pat. No. 4,615,256 discloses a method of forming three-dimensionally latticed flexible structures by rotating carriers around one component yarn with the remaining two component yarns held on bobbins supported in the arms of the carriers and successively transferring the bobbins or yarn ends to the arms of subsequent carriers. In this fashion, the two component yarns transferred by the carrier arms are suitably displaced and zig-zagged relative to the remaining component yarn so as to facilitate the selection of weaving patterns to form the fabric in the shape of cubes, hollow angular columns, and cylinders.

Also, U.S. Pat. No. 4,001,478 to King discloses yet another method to form a three-dimensional structure wherein the structure has a rectangular cross-sectional configuration as well as a method of producing cylindrical three-dimensional shapes.

A four directional structure was developed by M. A. Maistre and disclosed in Paper No. 76-607 at the 1976 AAIA/SAE Twelfth Propulsion Conference in Palo Alto, Calif. The structure was produced from pultruded rods arranged diagonally to the three principal directions. This was compared to three-dimensional woven structures and it was found that the four directional preform was more isotropic than three-dimensional fabric structures and its porosity was characterized by a widely open and interconnected network which could be easily penetrated by the matrix whereas the porosity of three-dimensional structures was formed by cubic voids practically isolated from each other and having difficult access.

Other forms of four directional structures are disclosed in U.S. Pat. No. 4,252,588 to Kratsch et al. and U.S. Pat. No. 4,400,421 to Stover. One structure is oriented in the diagonal/orthogonal directions wherein two sets of yarns are oriented in the diagonal direction and the other two sets (axial and filling) are orthogonal to each other. The second structure has one set of yarn in diagonal direction and the other set of yarn being mutually orthogonal to each other.

Fukuta et al. constructed a three-dimensional multi-axial weaving apparatus as disclosed in U.S. Pat. No. 5,076,330. The apparatus has four elements consisting of a warp rod holding disk, weft rod insertion assembly (with weft rod feeding and weft rod cutter units), a reed and a take-up assembly. The apparatus produced a structure which has four sets of yarns comprising one set of warp (axial) and three sets of weft yarns oriented diagonally around the warp yarns.

Anahara et al. discloses a five yarn system multi-axial fabric in U.S. Pat. No. 5,137,058. The preform according to this invention has five sets of yarn used as warp, filling, Z-yarn and ± bias yarns that are oriented inside the preform. A machine for manufacturing the preform is disclosed comprising a warp, ± bias and Z-yarn beams to feed the yarns into the weaving zone, a shedding device which opens the warp layers for insertion of the filling yarns, screw shafts to orient the bias yarns, and rapiers for insertion of weft and Z-yarns into the preform structure. However, as known to those skilled in the art, the screw shafts do not effectively control the bias yarn placement and this causes misplacement of these yarns and eventually makes the Z-yarn insertion very difficult.

DISCLOSURE OF THE INVENTION

In accordance with the present invention, applicants provide a three-dimensional fabric formed from five yarn systems having enhanced in-plane shear strength and modulus when compared to previously known three-dimensional fabrics. The three-dimensional fabric comprises a plurality of warp thread layers including a plurality of warp threads arranged in parallel with a longitudinal direction of the fabric and defining a plurality of rows and columns wherein the rows define a front and a back surface of the fabric. A first pair of bias thread layers is positioned on the front surface of the plurality of warp yarn layers and comprises a plurality of continuous bias threads arranged so that each layer is inclined symmetrically with respect to the other layer and inclined with respect to the warp threads. A second similar pair of bias thread layers is positioned on the back surface of the plurality of warp yarn layers. A plurality of threads is arranged in the thicknesswise direction of the fabric so as to extend between the first and second pair of bias thread layers and perpendicularly intersect the warp threads between adjacent columns thereof. Finally, a plurality of weft threads are arranged in the widthwise direction of the fabric and perpendicularly intersect the warp threads between adjacent rows thereof.

It is therefore the object of this invention to provide a novel three-dimensional fabric formed from five yarn systems so as to enhance the in-plane shear strength and modulus of the three-dimensional fabric.

It is another object of the present invention to provide a novel method for producing a three-dimensional fabric from five yarn systems.

Some of the objects of the invention having been stated hereinabove, other objects will become evident as the description proceeds, when taken in connection with the accompanying drawings described hereinbelow.

BRIEF DESCRIPTION OF THE DRAWINGS

FIGS. 13D1 and 13D2 are schematic views of step 4 of the weaving cycle;

FIGS. 13E1 and 13E2 are schematic views of step 5 of the weaving cycle;

FIGS. 13K1 and 13K2 are schematic views of step 13 of the weaving cycle;

FIG. 16I is a schematic view showing the yarn carrier moving forward and the bias yarns achieving a 30° angle with regard to the warp yarns for both surfaces of the three-dimensional fabric so that the weaving apparatus shown in FIG. 2 is now ready for weft yarn insertion;

BEST MODE FOR CARRYING OUT THE INVENTION

Previously developed three-dimensional orthogonal woven preforms for composites show low in-plane shear strength and modules. Applicants have discovered a new method of inserting bias yarns in addition to the warp, weft and Z-yarns to improve such properties and a new fabric produced thereby.

Figure 1:
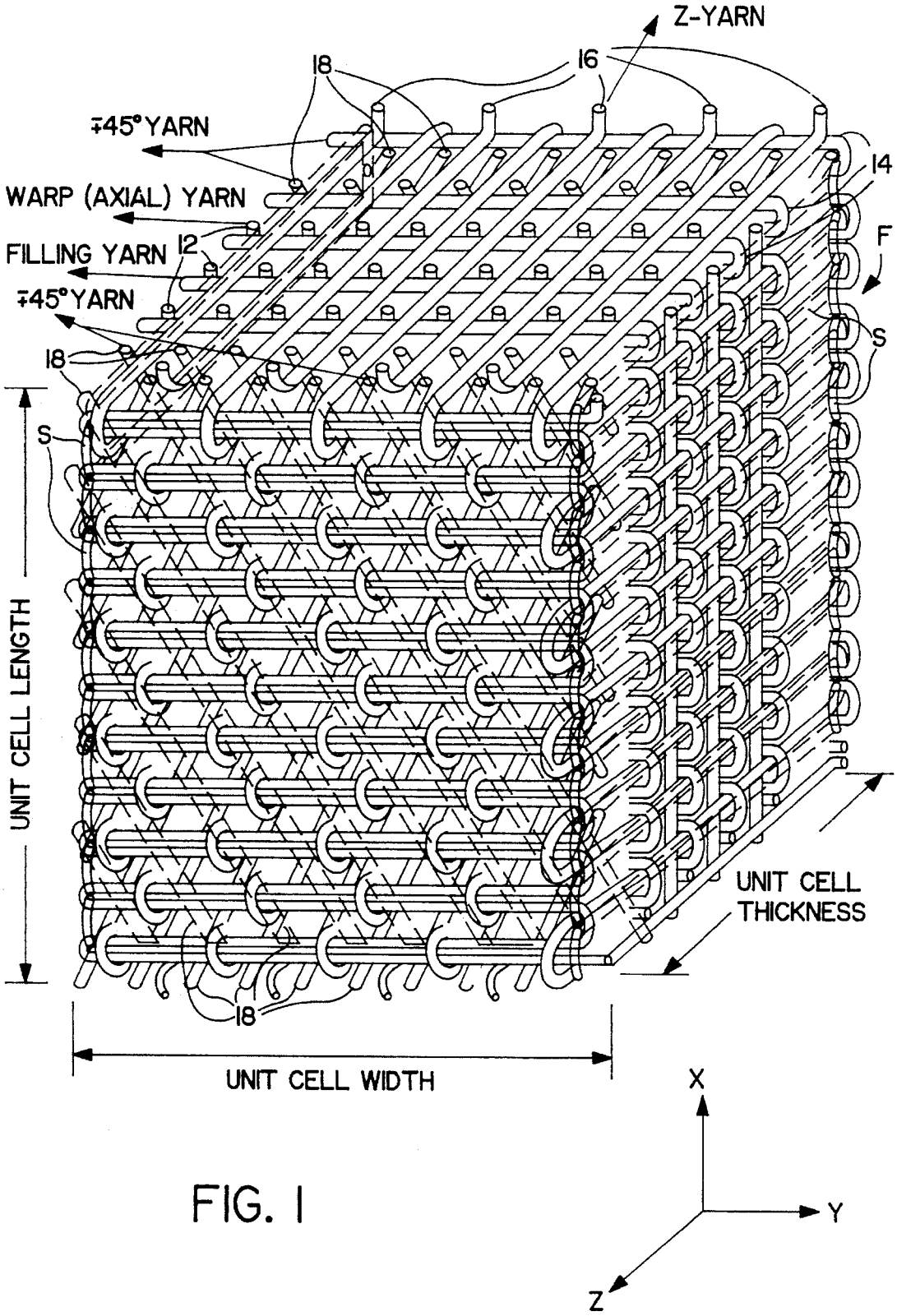
FIG. 1 is a schematic perspective view of a three-dimensional fabric according to the present invention.
Figure 1A:
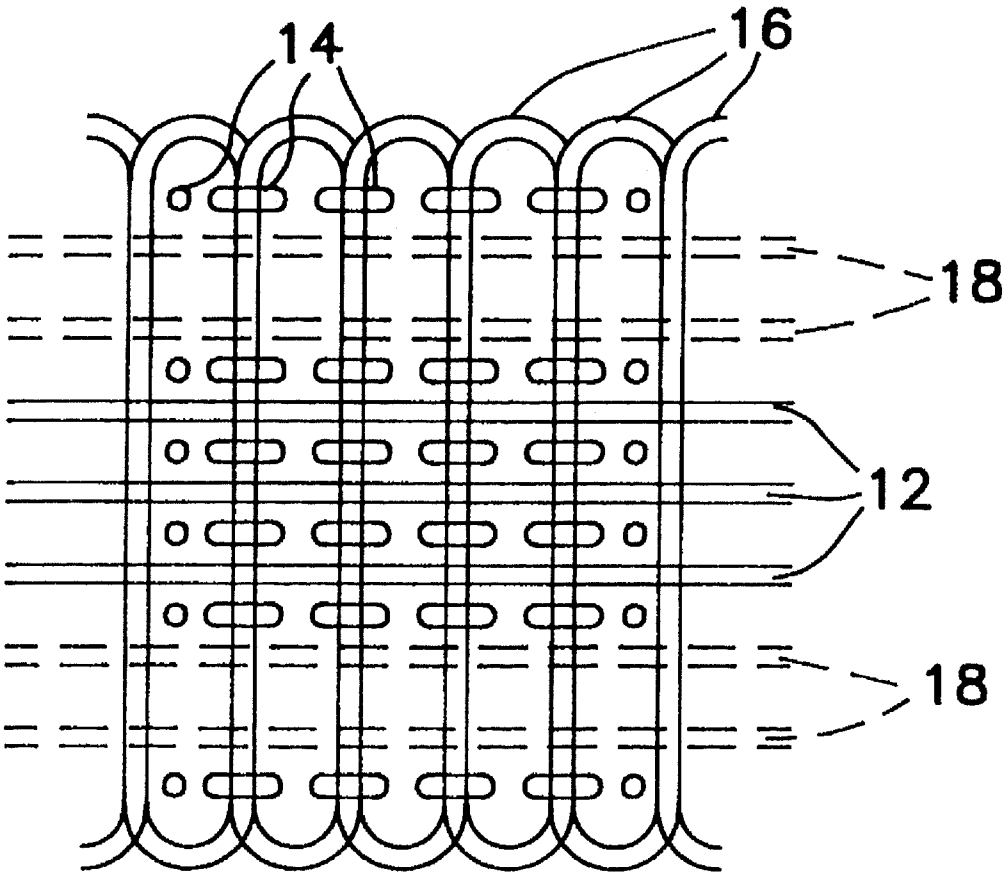
FIG. 1A is a schematic right side view of the three-dimensional fabric shown in FIG. 1.

A new multi-axial three-dimensional weaving prototype apparatus is being developed by the College of Textiles of North Carolina State University in Raleigh, N.C. to form a novel fabric F (see FIG. 1 and FIG. 1A) according to the invention. The apparatus produces a multi-axial woven preform. The preform is basically composed of multiple warp layers (axial yarns) 12, multiple filling yarns 14, multiple Z-yarns 16 (extending in fabric thickness direction) and ± bias yarns. The unit cell of the preform is shown in FIG. 1. As can be seen, ± bias yarns 18 are located on the back and front face of the preform, and they are locked to other sets of yarns by the Z-yarns 16.

In operation, warp yarns 12 are arranged in a matrix of rows and columns within the required cross-sectional shape. After bias yarns 18 have begun to be oriented at ±45° to each other on the surface of the preform, filling yarns 14 are inserted between the rows of warp yarns and the loops of filling yarns 14 are secured by two selvage yarns S at both edges of the structure and then they are returned to their starting positions. Z-yarns 16 are then inserted and passed across each other between the columns of warp yarns 12 to cross filling yarns 14 in place. The filling insertion takes place again as before and the yarns are again returned to their starting positions. Z-yarns 16 are now returned to their starting positions passing between the columns of warp yarns 12 locking ±45° yarns 18 and filling yarns 14 in place. The inserted yarns are beaten against the woven line and a take-up system removes the fabric structure from the weaving zone. The previous description is of one cycle of the method to weave the novel three-dimensional multi-axial woven preform F. The cycle is continuously repeated depending upon the fabric length requirement.

A three-dimensional weaving apparatus 100 is shown in FIG. 2 and FIGS. 2A–2C. This machine is composed of eight main elements. These are warp creel 110, ± bias yarn assembly 120, tube bars 130, tension units 140, insertion units 150, selvage and latch needle unit 160, fabric beat-up 170 and fabric take-up unit 180.

Figure 3:
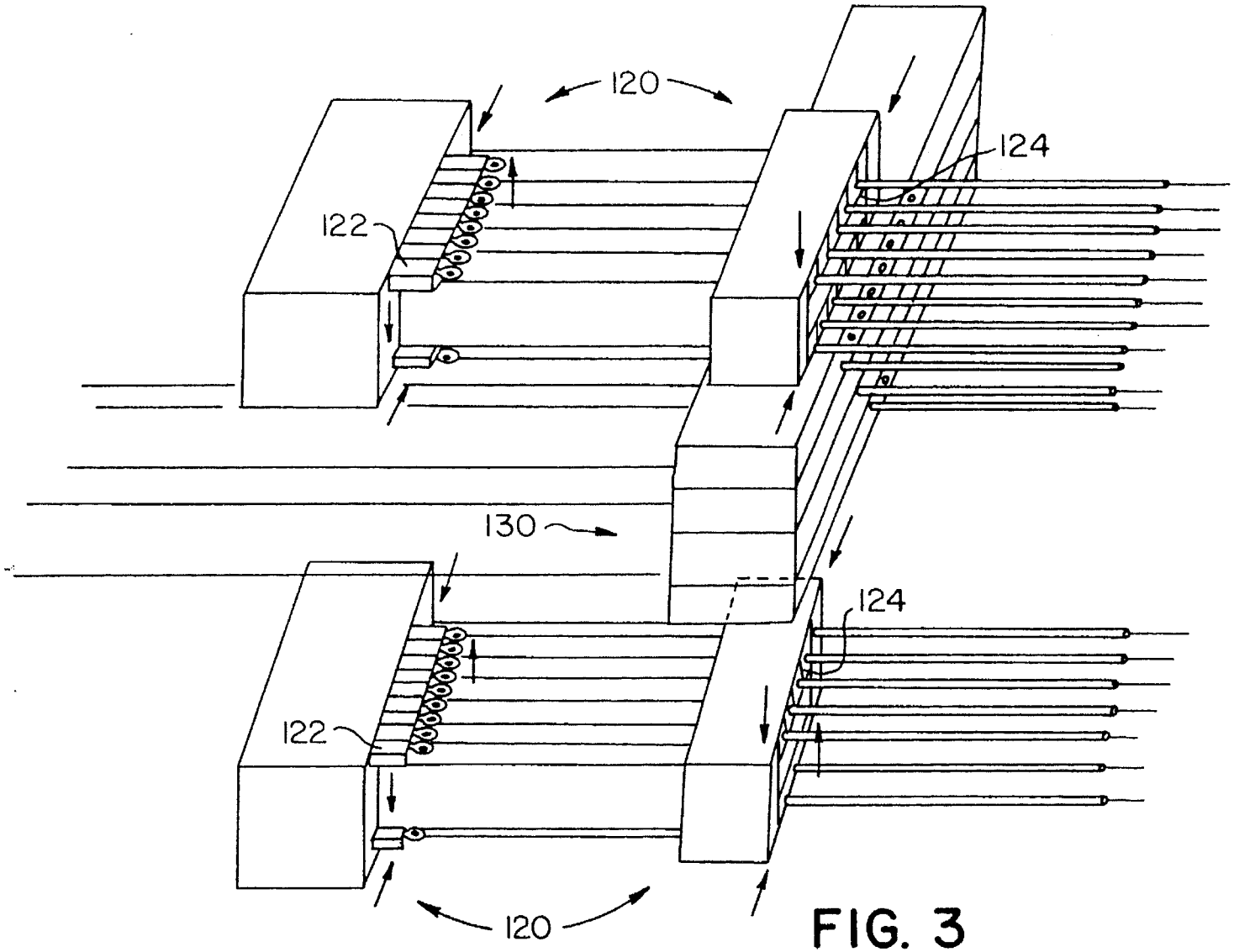
FIG. 3 is a schematic perspective view of the bias yarn and warp yarn carrier assemblies of the weaving apparatus.
Figure 6:
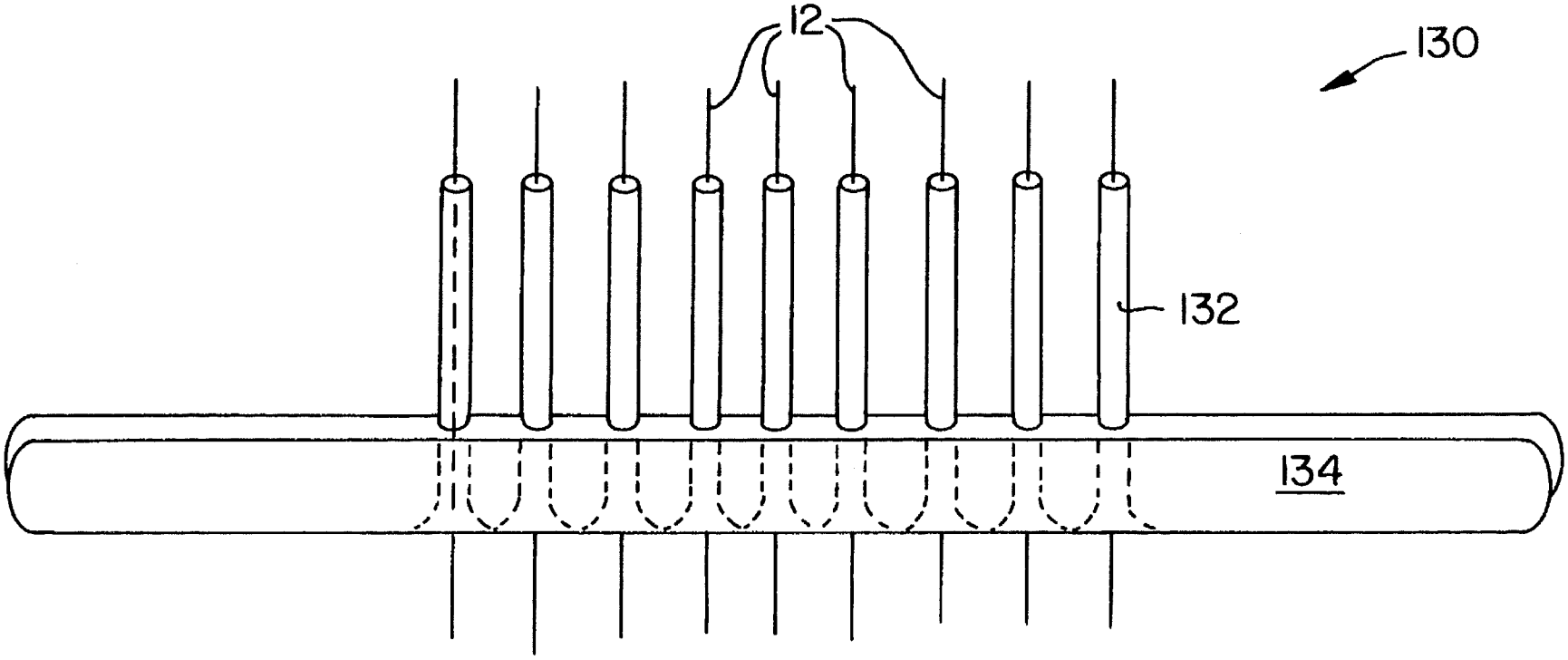
FIG. 6 is a schematic perspective view of a tube bar for the warp yarn of the weaving apparatus.

The warp creel has a pierced table in which ceramic guides are inserted at the top and a table which holds the bobbins on the bottom. Warp yarns 12 pass through the guides and extend to tube bar units 130. This unit is shown in FIGS. 3 and 6. As shown in FIG. 3, several tube bars can be used depending upon the number of warp layers. Each tube bar has a tube 132 and bar 134 section (see FIG. 6). The tube is mounted in the bar, and a warp yarn passes through each tube. The number of tubes 132 also depends upon the number of warp (axial) yarns 12. Tube bars 130 are held together at both ends by suitable slotted parts.

Figure 3A:
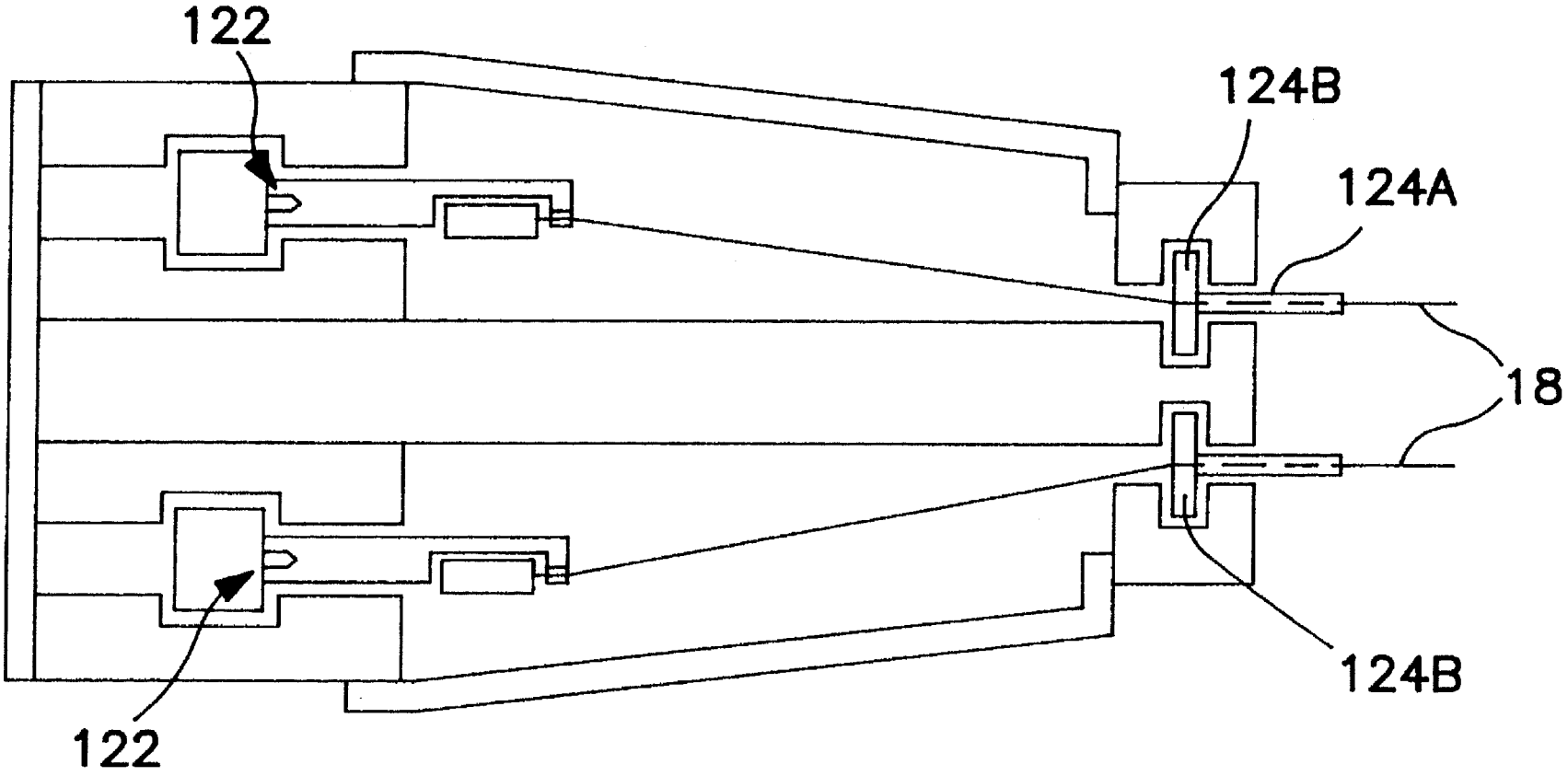
FIG. 3A is a schematic front view of the bias yarn carrier assembly shown in FIG. 3.
Figure 4:
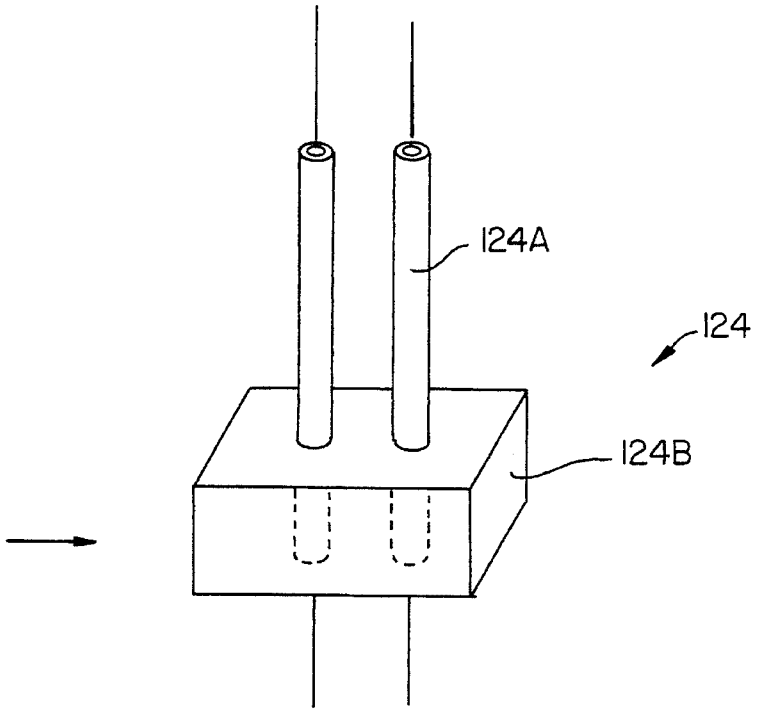
FIG. 4 is a schematic perspective view of a bias yarn carrier unit of the weaving apparatus.
Figure 5A:
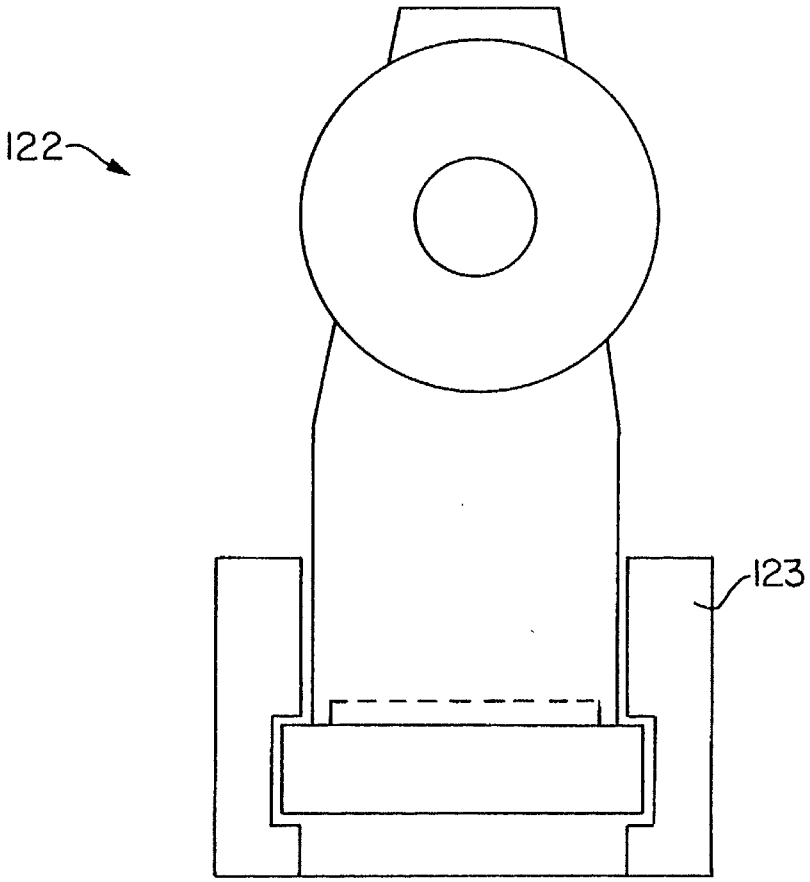
FIGS. 5A and 5B are schematic front elevation and side elevation views, respectively, of a bias yarn carrier unit of the weaving apparatus.
Figure 5B:
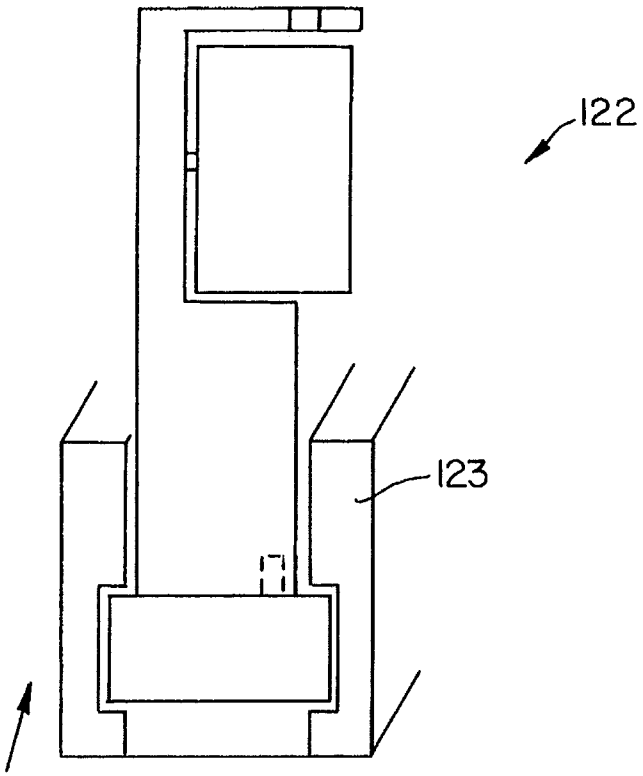

As shown in FIG. 3 and FIG. 3A, ± bias yarn assembly 120 has two parts, the ± bias yarn spool carriers 122 (see FIGS. 5A and 5B) and the tube carriers 124. Tube carrier 124 includes two tubes 124A and a block 124B into which the tubes are inserted tightly as shown in FIG. 4. The ± bias yarn spool carriers 122 carry bias yarn 18 and are slidably mounted in track 123 for discrete movements about a continuous rectangular pathway. Bias yarns 18 are fed from spool carriers 122 through the tube carriers 124. Both bias yarn spool carriers 122 and tube carrier 124 are moved in a rectangular pathway defined within their respective tracks to orient ± bias yarns 18 on the surface of the woven preform at a bias angle. FIG. 3 shows two such assemblies to be used for bias yarn orientation on both surfaces of preform F. The number of spool carriers 122 and tube carriers 124 can be arranged depending upon the preform size.

Figure 8:
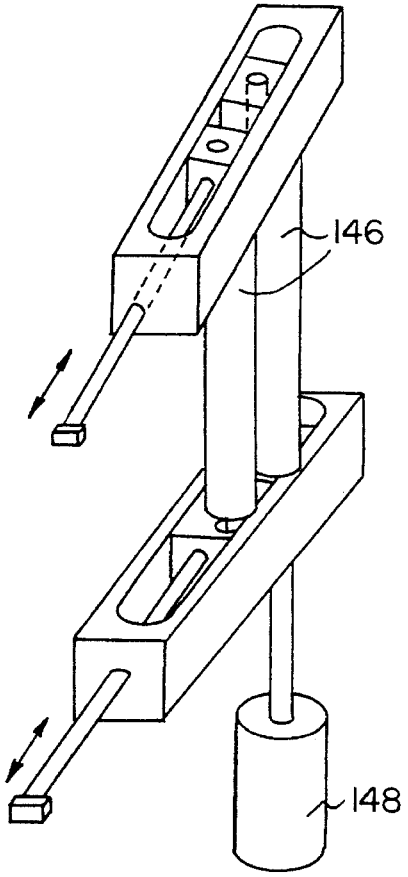
FIG. 8 is a schematic perspective view of yarn tension cylinders of the weaving apparatus.
Figure 7:
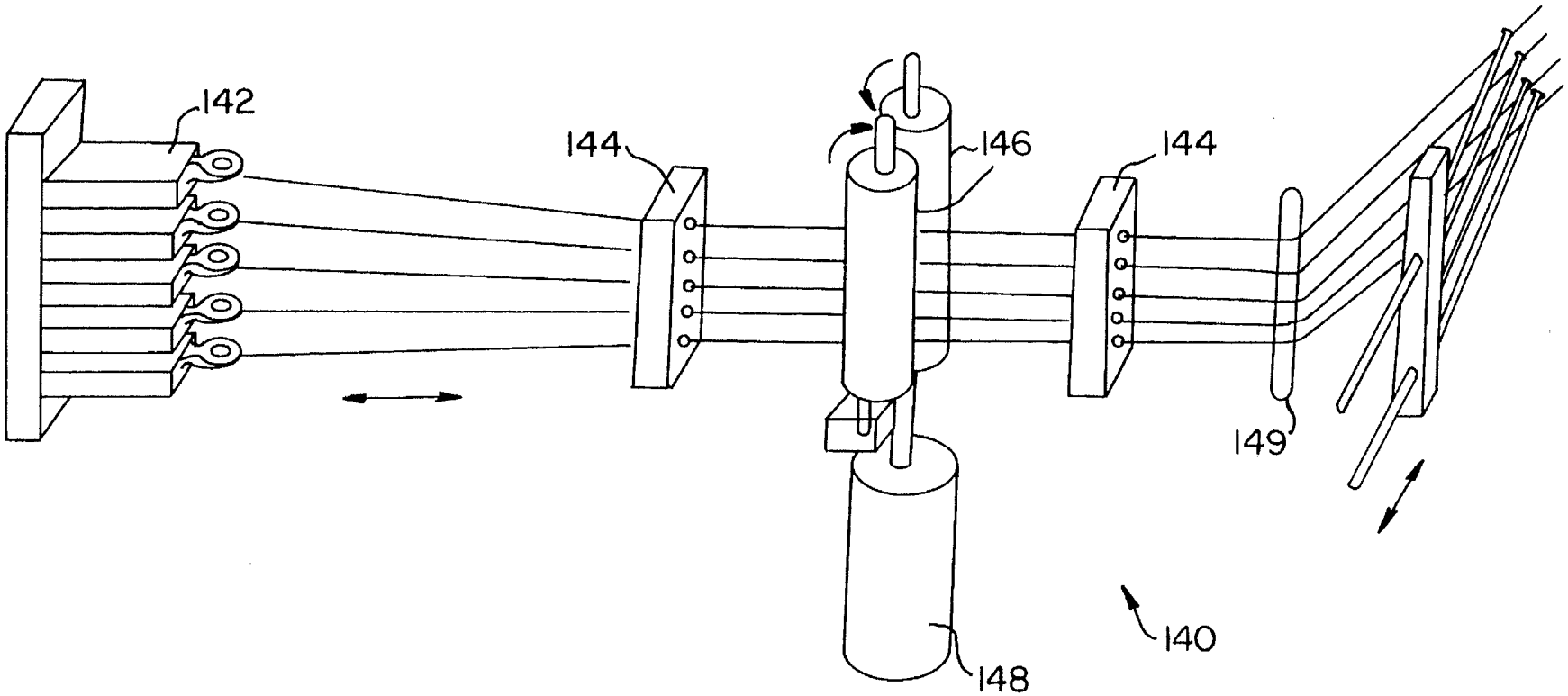
FIG. 7 is a schematic perspective view of a tension unit for the weft, thicknesswise extending yarns and selvage yarns of the weaving apparatus.

A tension unit 140 consisting of yarn spools 142, yarn guides 144, yarn feeding cylinders 146, and stepping motor 148 and rod 149 are shown in FIG. 7. Yarn feeding cylinders 146 are coated with rubber to prevent damaging high modulus fibers and both ends of the driven cylinder are inserted within a metallic block (see FIG. 8) to fix the distance between two cylinders 146. Tension unit 140 provides the necessary tension to the inserted weft, Z and selvage yarns. When yarn is inserted in the structure, stepping motor 148 drives cylinders 146 and feeds the yarns to the corresponding needles. Immediately after the insertion is completed, stepping motor 148 stops. When insertion unit 140 returns to its original position, the stepping motor drives cylinders 146 in the reverse direction to feed the slack yarn from the needles to yarn spools 142. A tension unit as described will be provided for filling insertion, Z-yarn insertion-1, Z-yarn insertion-2 and the weft selvage insertion units.

Figure 2:
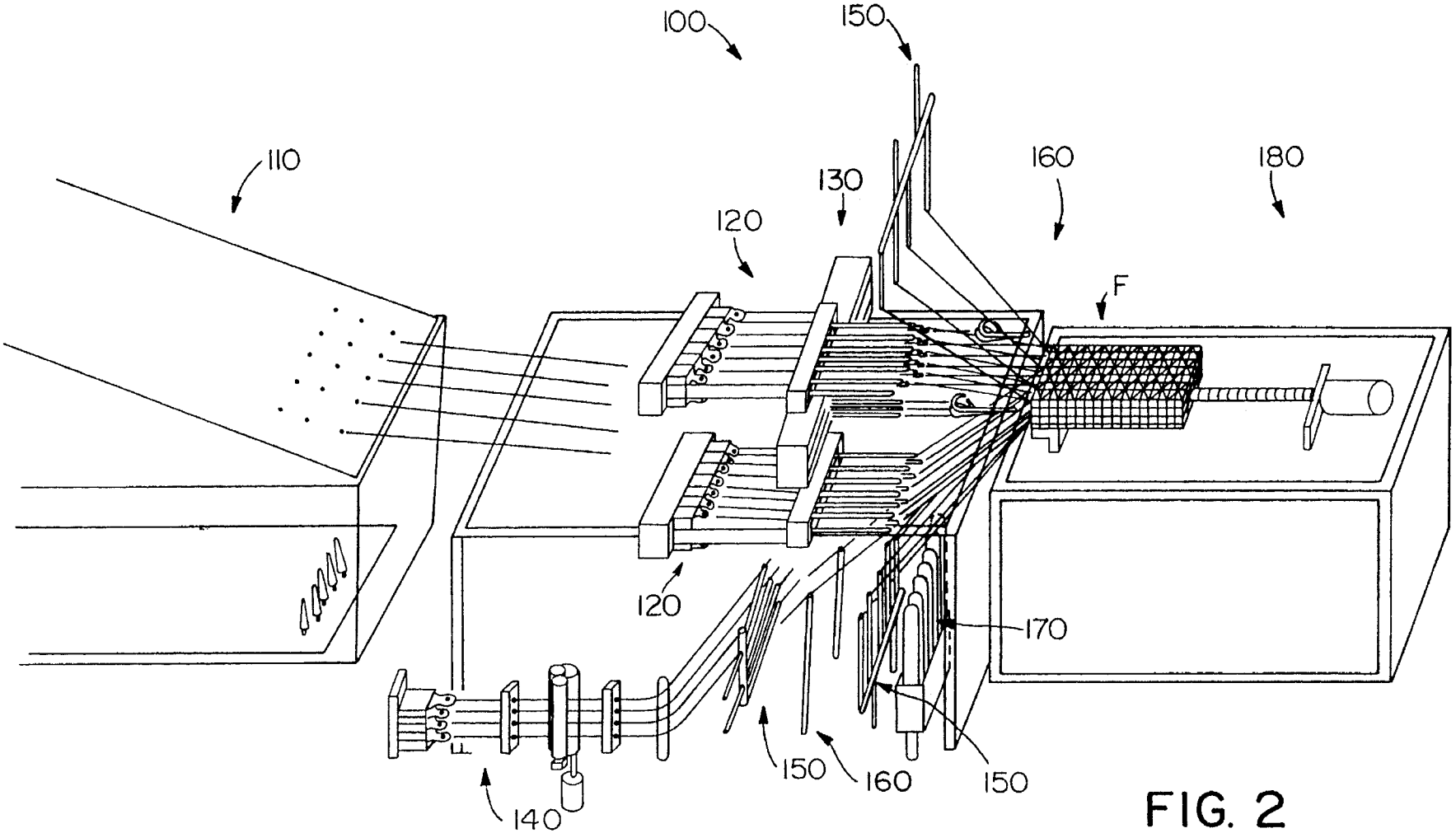
FIG. 2 is a schematic perspective view of an automated weaving apparatus for forming a three-dimensional fabric according to the present invention.
Figure 2A:
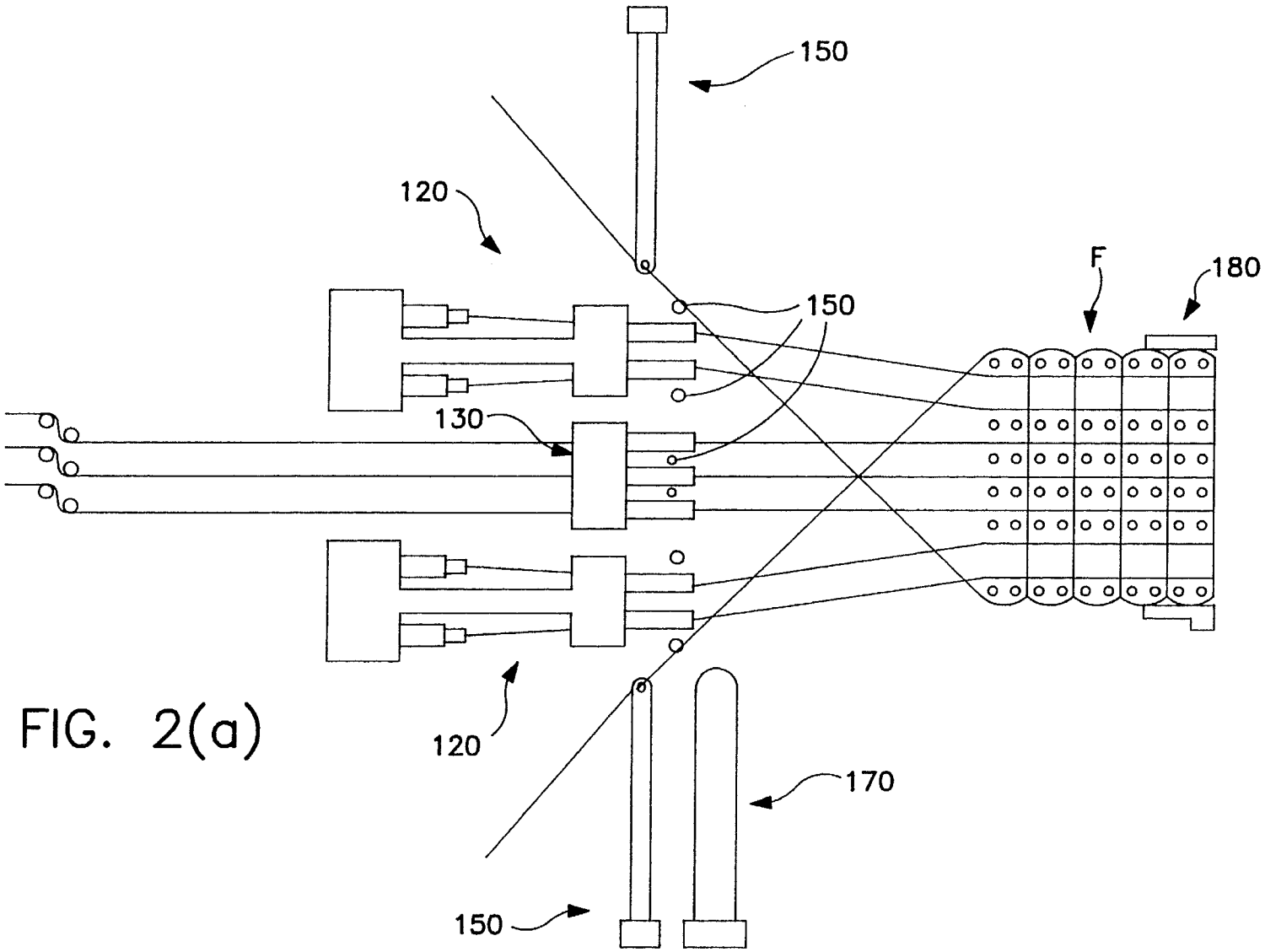
FIG. 2A is a schematic front view of the weaving apparatus shown in FIG. 2.
Figure 2B:
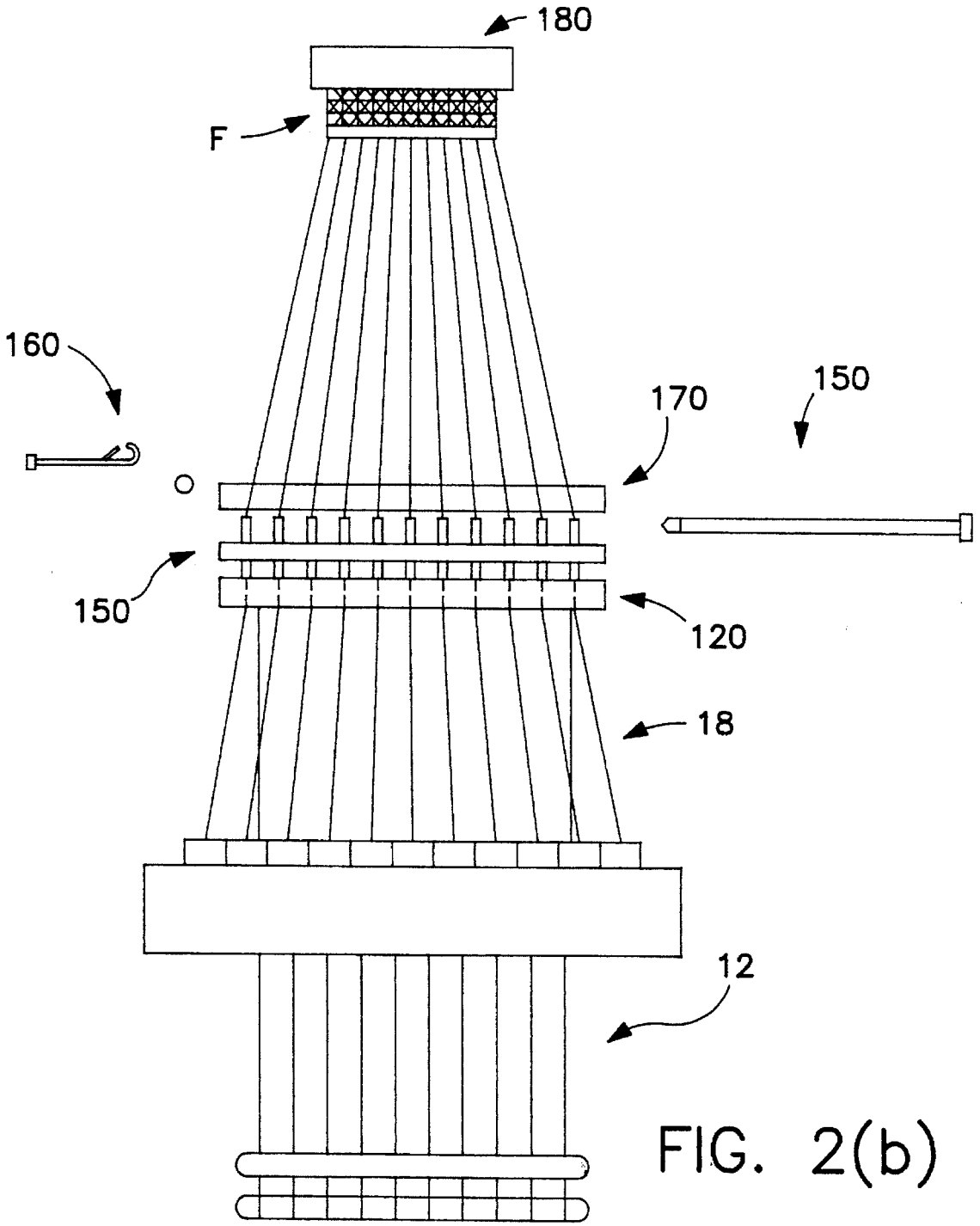
FIG. 2B is a schematic top view of the weaving apparatus shown in FIG. 2.
Figure 2C:
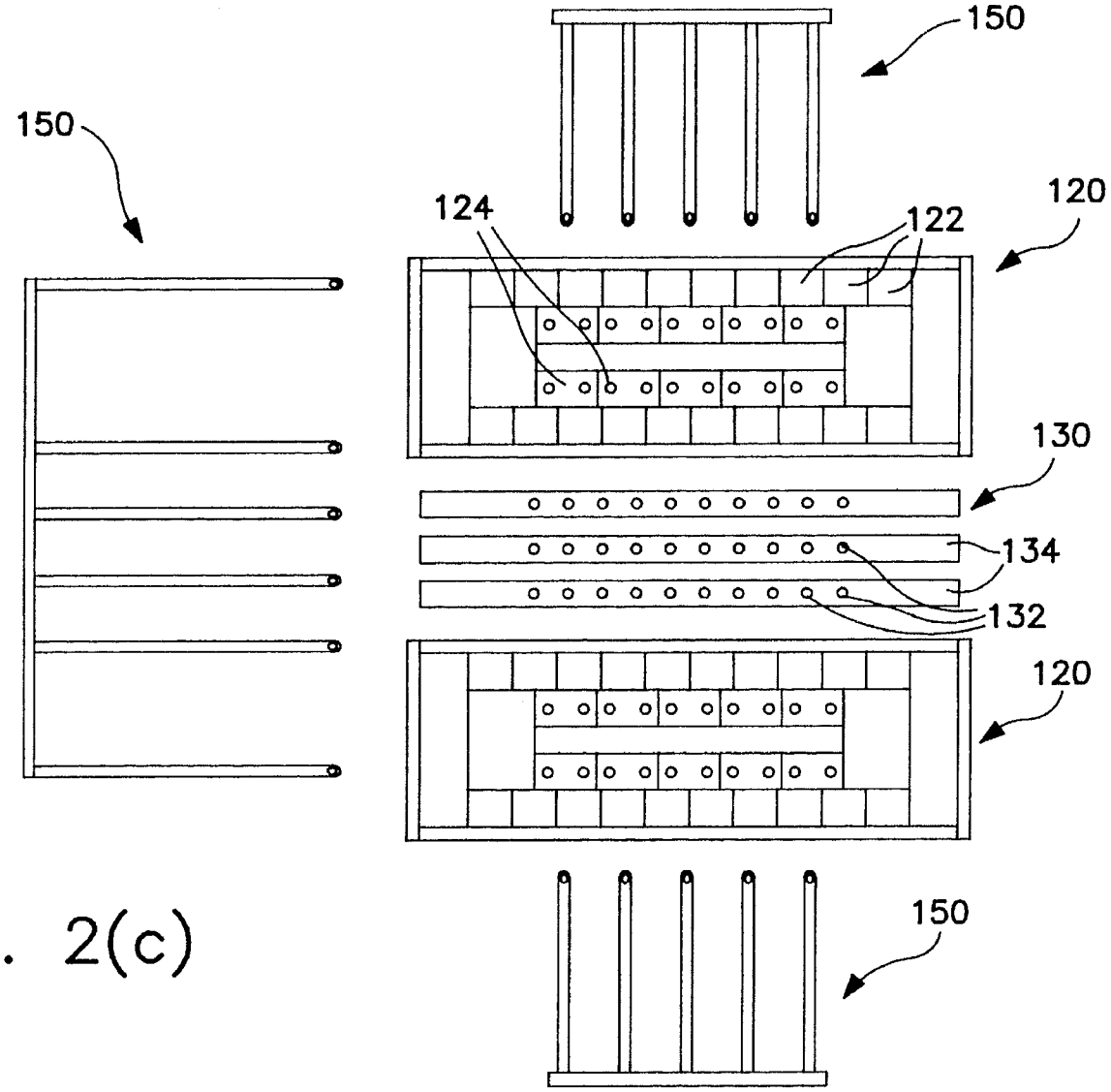
FIG. 2C is a schematic cross-sectional view of the weaving apparatus shown in FIG. 2.

There are three insertion units 150 which are used to produce the multi-axial woven structure of the invention. These are the filling insertion unit, Z-yarn insertion unit-1 and Z-yarn insertion unit-2. Each insertion unit has a needle for each yarn, and the number of needles depends upon the number of yarn ends to be inserted. The insertion units are shown in FIG. 2, and the number of insertion units 150 can be increased depending upon the desired cross-section shape of woven preform F.

Figure 9:
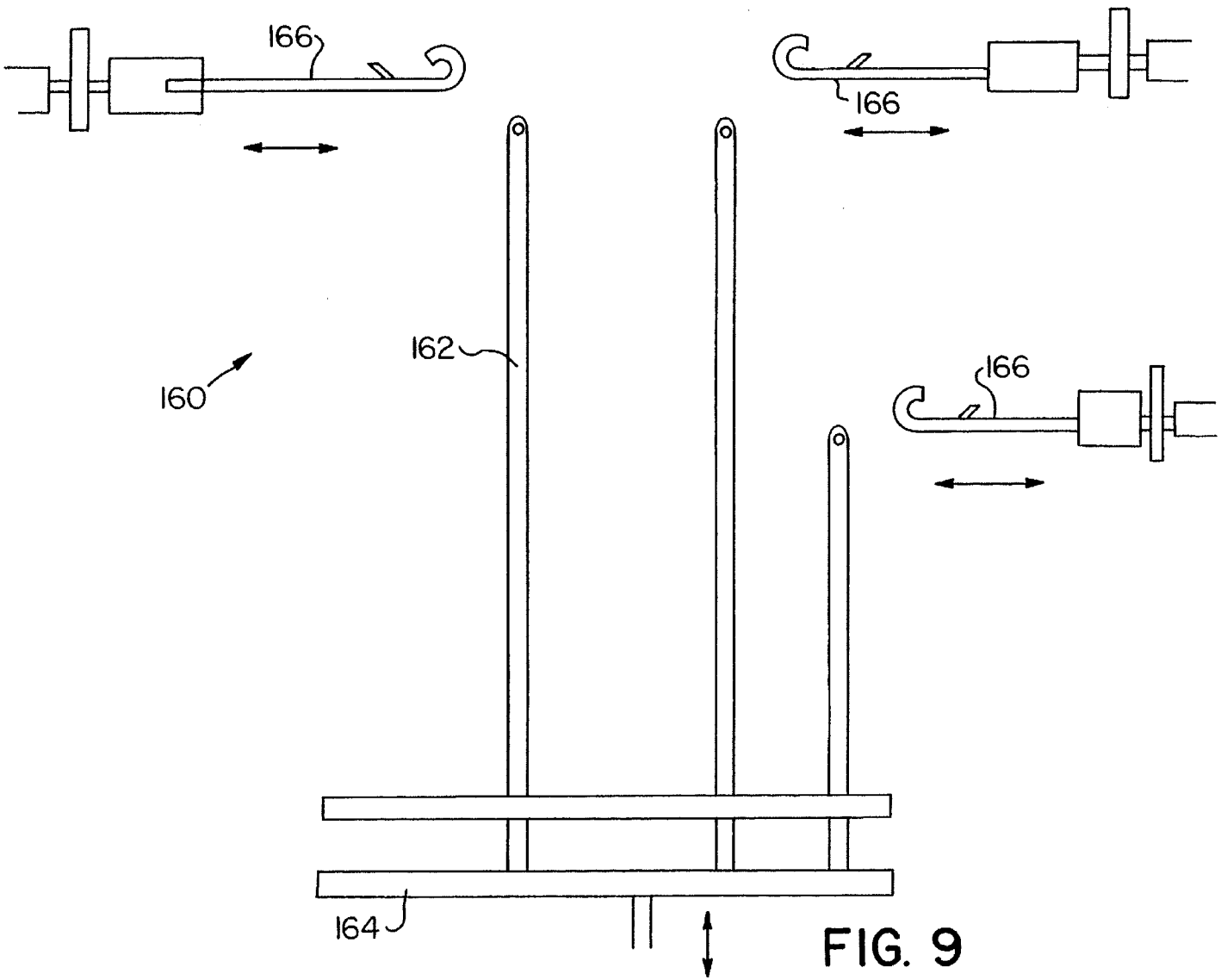
FIG. 9 is a schematic view of the selvage assembly with latch needles of the weaving apparatus.

As seen in FIG. 9, selvage needles 162 are connected to a plate 164 and carry selvage yarn. The latch needles 166 act to hold the selvage loops to thereby secure filling yarns 14 on each side of the woven structure. The number of selvage needles 162 and latch needles 166 also depends upon the number of insertion units 160 (which can vary from the three shown in FIG. 2).

Figure 10:
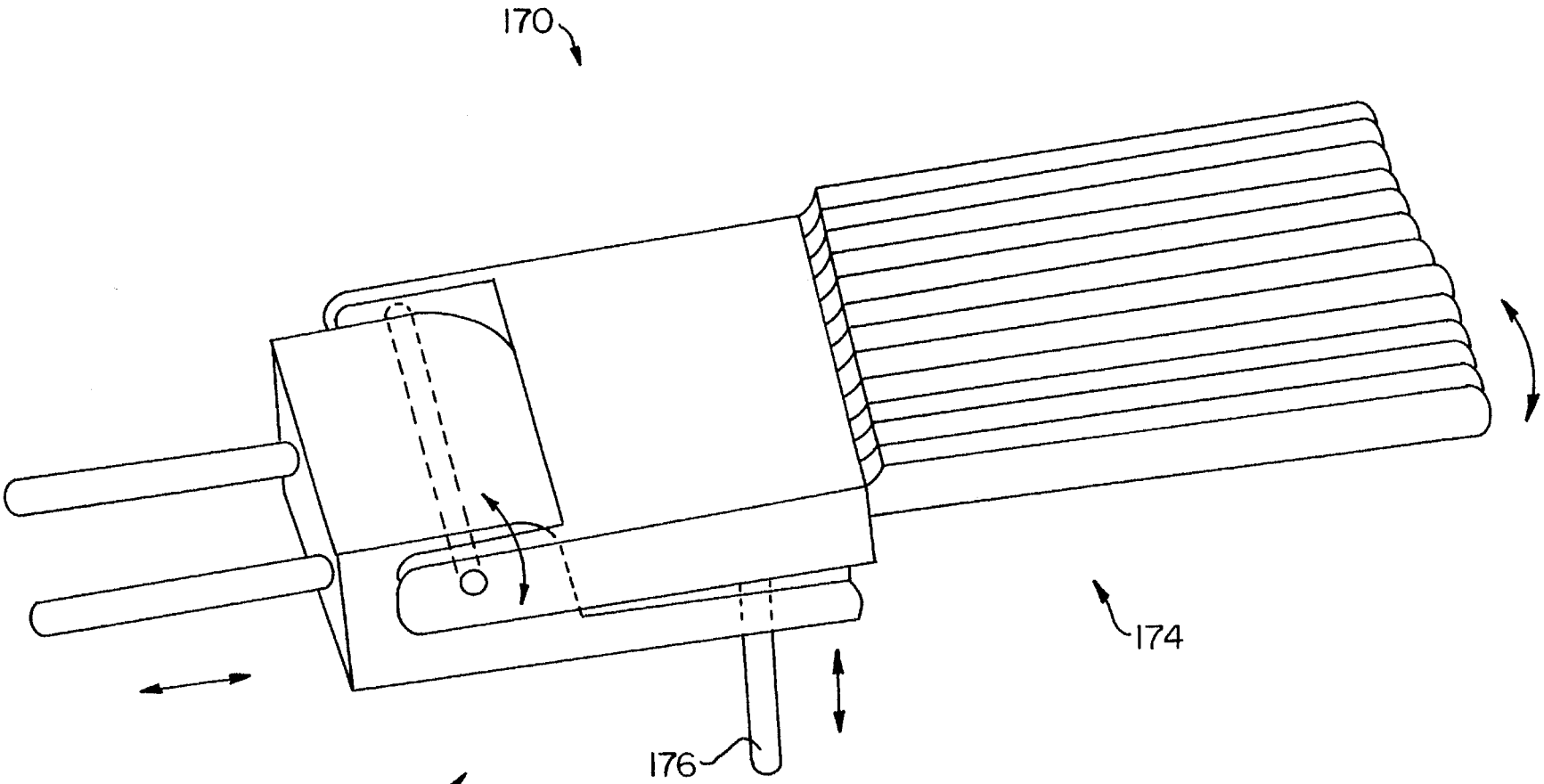
FIG. 10 is a schematic perspective view of the beat-up assembly of the weaving apparatus.
Figure 11:
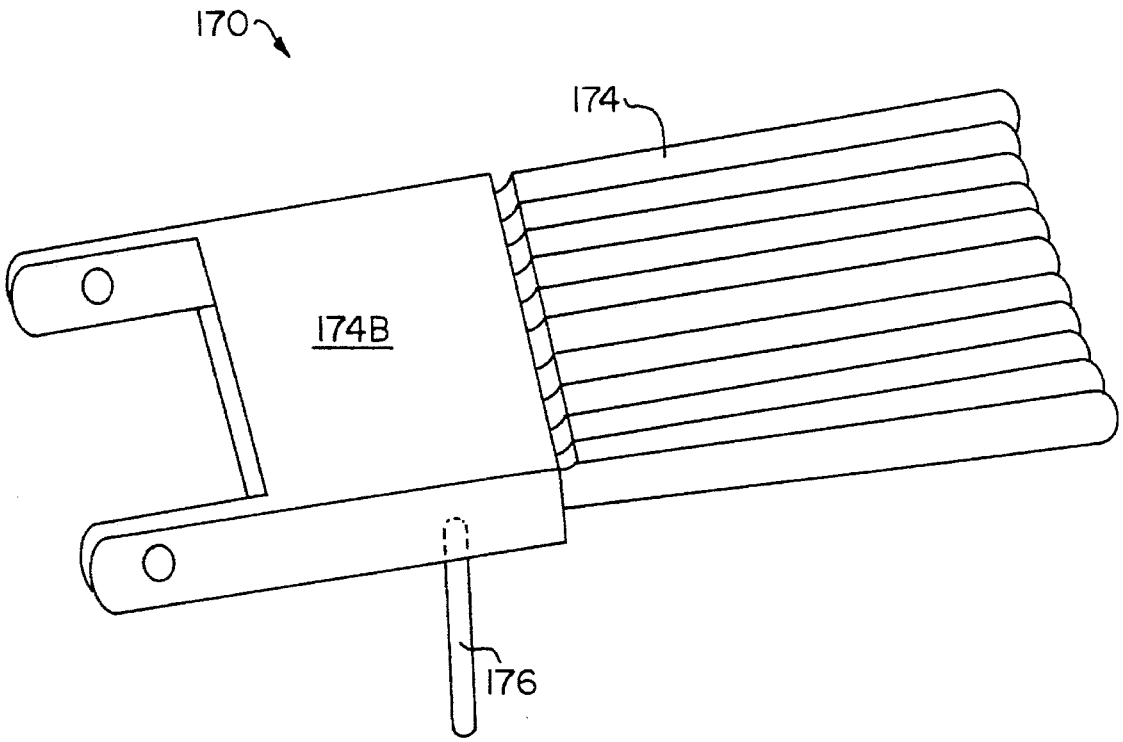
FIG. 11 is a schematic perspective view of a beat-up bar of the weaving apparatus.

Fabric beat-up 170 has a carrier unit 172 and bar unit 174 as shown in FIGS. 10 and 11. The individual bars 174A are connected together in slotted part 174B. Slotted part 174B is pivotably mounted in carrier unit and connected to it by rod 176 so that the bar unit can be moved upwardly as shown in FIG. 10. The number of bars varies with the number of warp yarns. Finally, a take-up unit 180 is shown in FIG. 2 whereby the woven structure is removed from the weaving zone by a stepping motor-driven screw rod.

Figure 13:
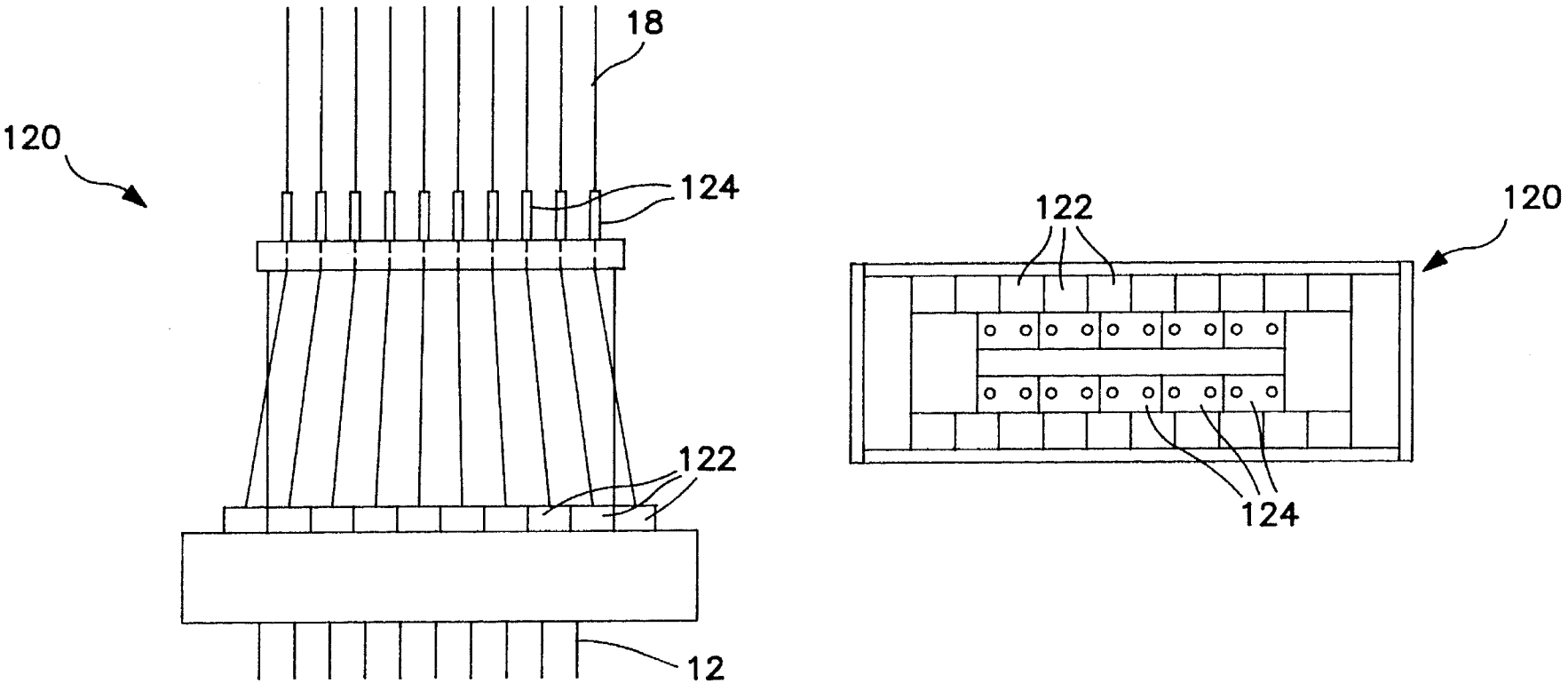
FIG. 13 is a schematic view of the starting position of the weaving cycle utilizing the weaving apparatus shown in FIG. 2.

Most suitably, each element on multi-axial weaving machine 100 is actuated by pneumatic cylinders (not shown). The timing sequence of each motion is controlled by programmable personal computers (not shown). The sequence of the timing motion is as follows:

1. The ± bias yarn spools and tube carriers are moved horizontally forward (see FIG. 13A wherein FIG. 13 illustrates the starting position of the weaving machine 100).

2. The ± bias yarn spools and tube carriers are moved vertically downward (see FIG. 13B).

3. The ± bias yarn spools and tube carriers are moved horizontally backward (see FIG. 13C).

4. The ± bias yarn spools and tube carriers are moved vertically upward and return to their initial positions (see FIGS. 13D1 and 13D2).

5. The filling needles are moved forward and a tension unit feeds the filling yarns (see FIGS. 13E1 and 13E2) .

6. The selvage needle is moved forward and a tension unit feeds the selvage yarns (see FIG. 13F).

7. The latch needle is moved forward and catches the selvage yarns (see FIG. 13F).

8. The selvage needle is moved back and a tension unit pulls the yarn back (see FIG. 13F).

9. The filling needles are moved back and a tension unit pulls the yarn back (see FIG. 13G).

10. The Z-yarn needles-1 and 2 are moved forward toward each other and a tension unit feeds the yarns (see FIG. 13H).

11. Steps 5–9 are repeated (see FIG. 13I).

12. The Z-yarn needles-1 and 2 are moved backward away from each other and a tension unit pulls the yarn back (see FIG. 13J).

13. The beat-up unit is moved upward and then forward (see FIGS. 13K1 and 13K2).

14. The beat-up unit is moved backwardly and downward (see FIG. 13L).

15. Take-up unit removes the woven structure from the weaving zone (see FIG. 13L).

These steps are for one cycle of the multi-axial weaving operation in accordance with the invention.

Figure 13A:
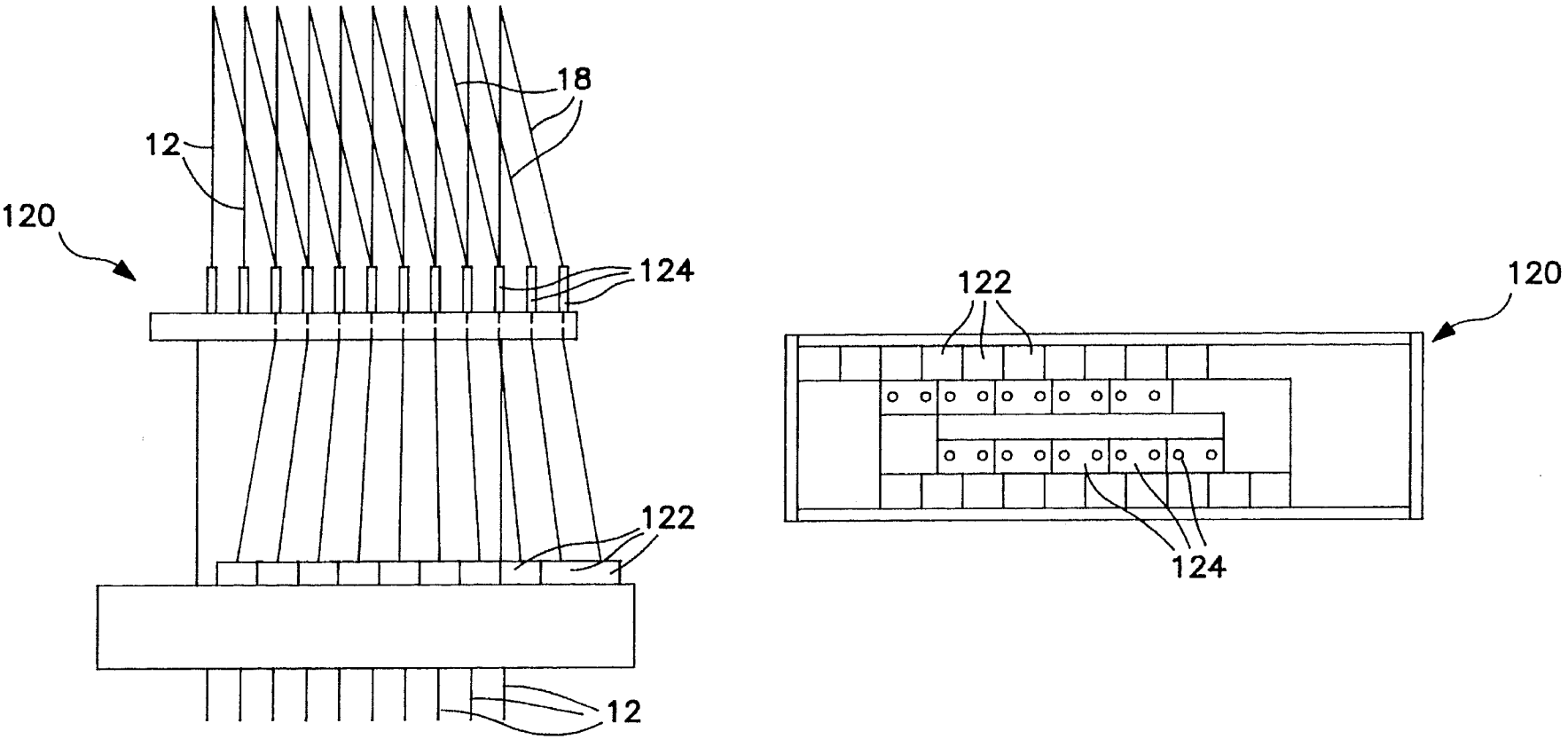
FIG. 13A is a schematic view of step 1 of the weaving cycle.
Figure 13B:
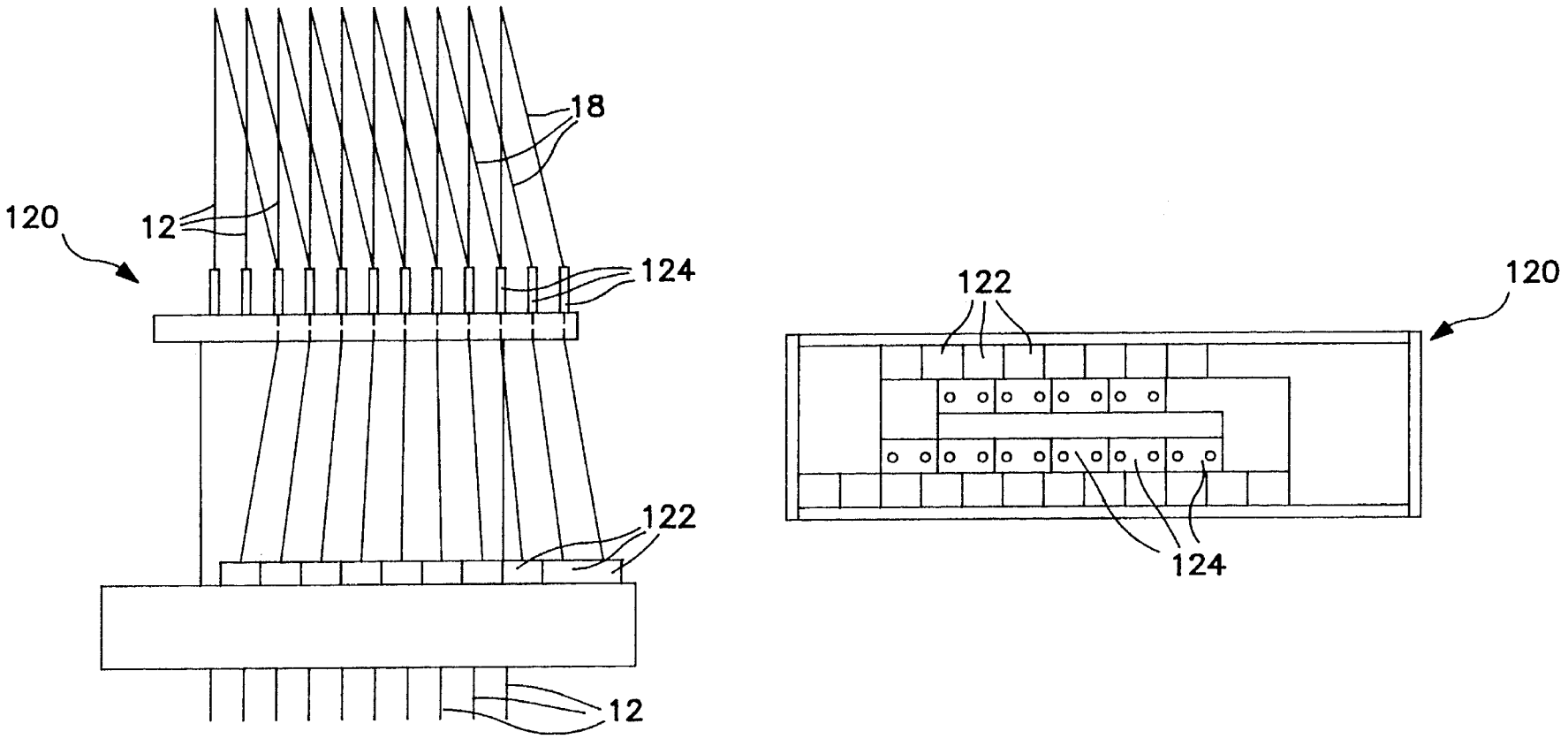
FIG. 13B is a schematic view of step 2 of the weaving cycle.
Figure 13C:
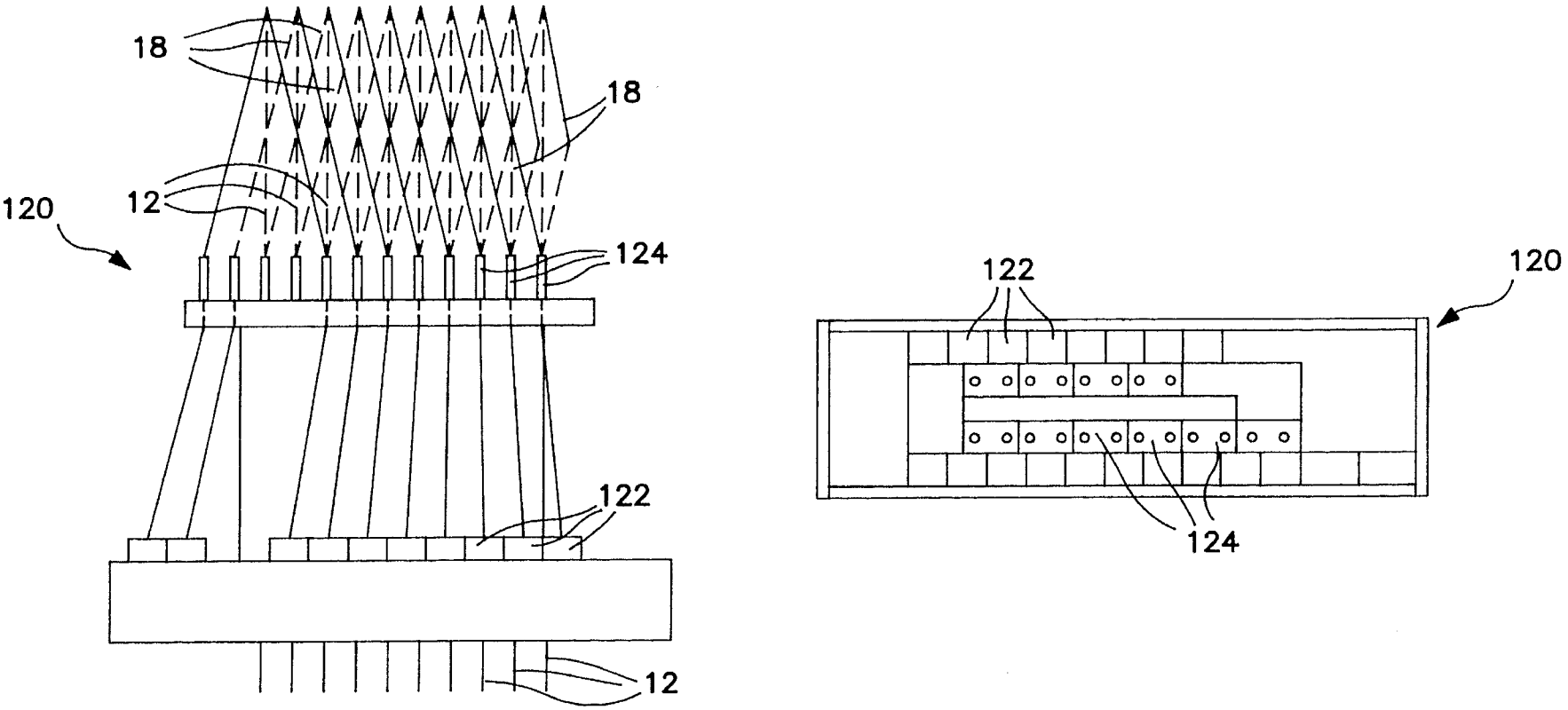
FIG. 13C is a schematic view of step 3 of the weaving cycle.
Figure 13D:
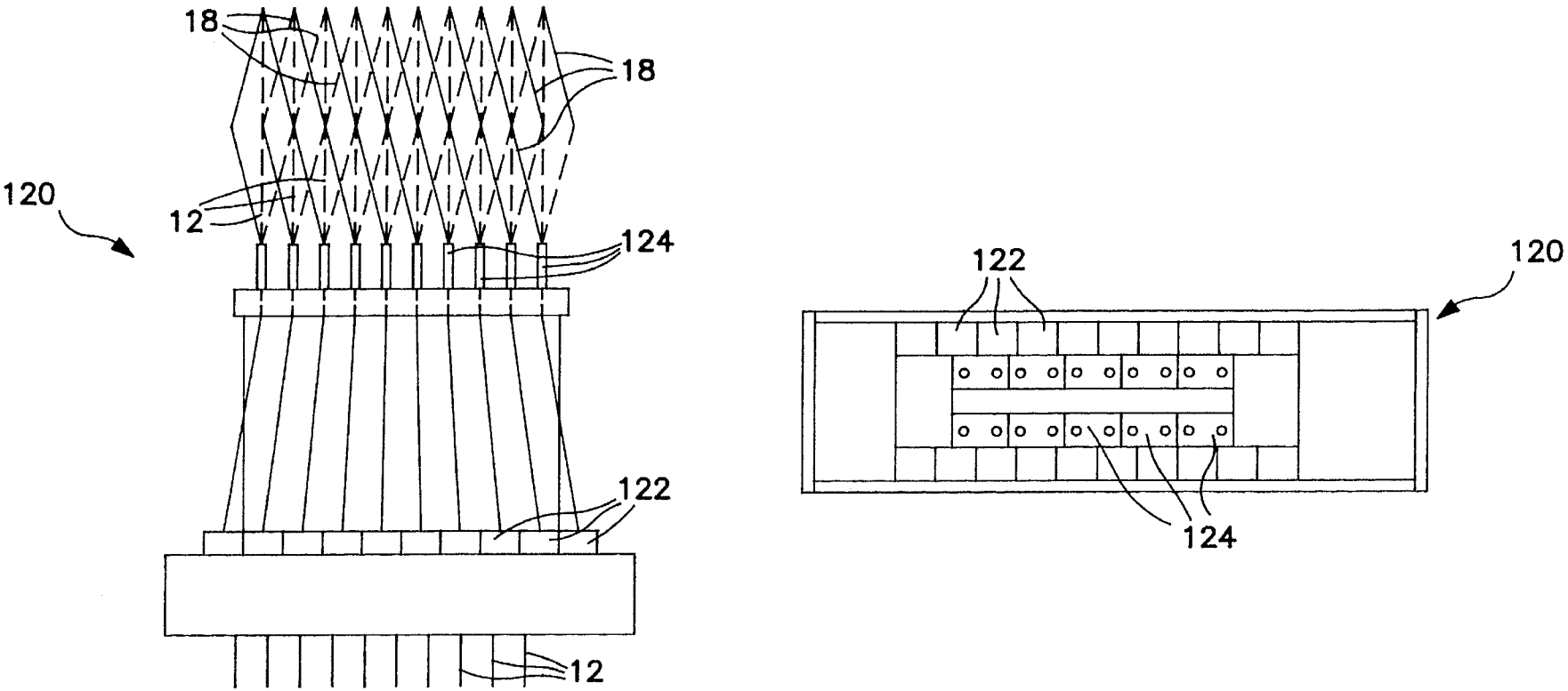
Figure 13F:
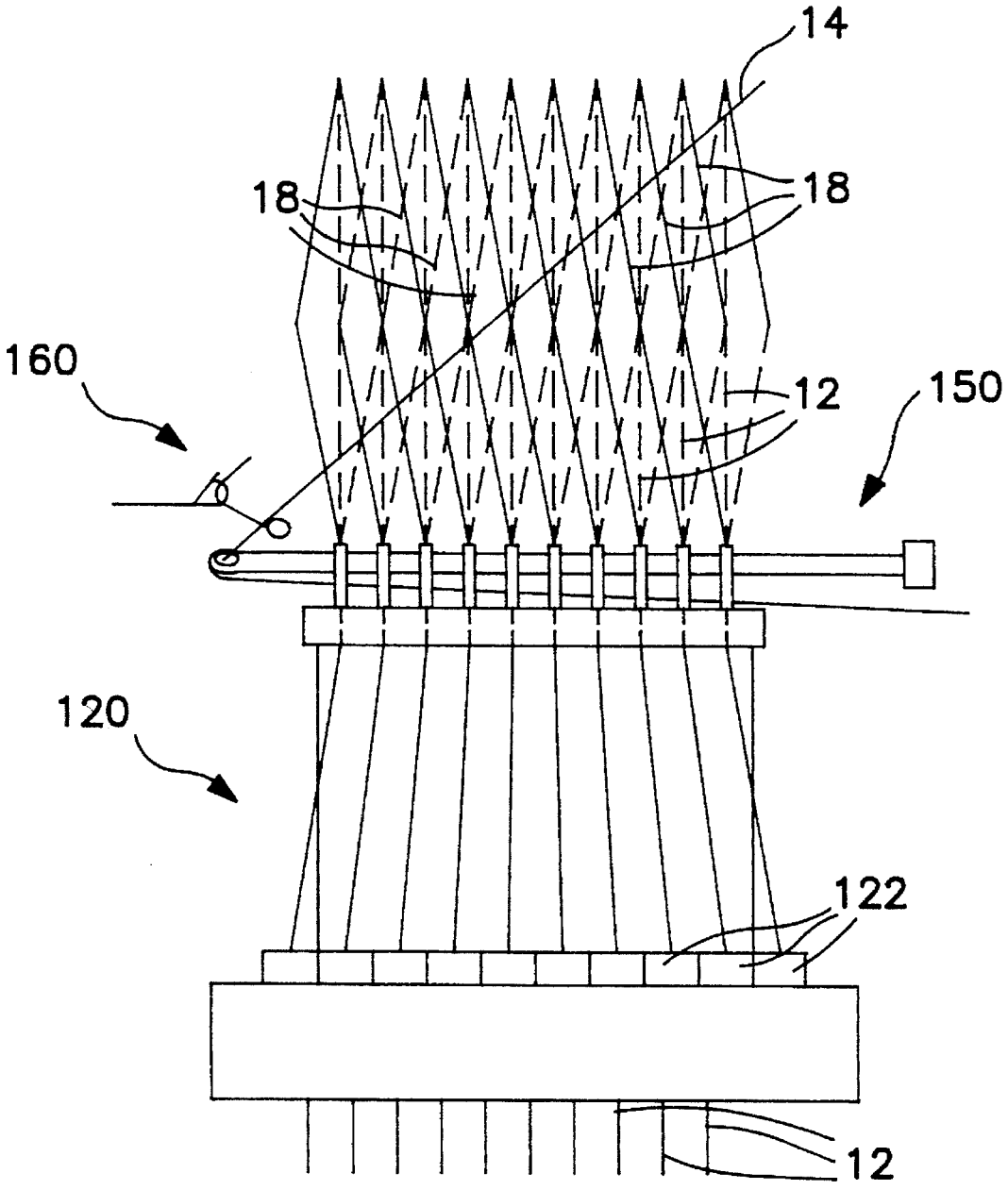
FIG. 13F is a schematic view of steps 6, 7 and 8 of the weaving cycle.
Figure 13G:
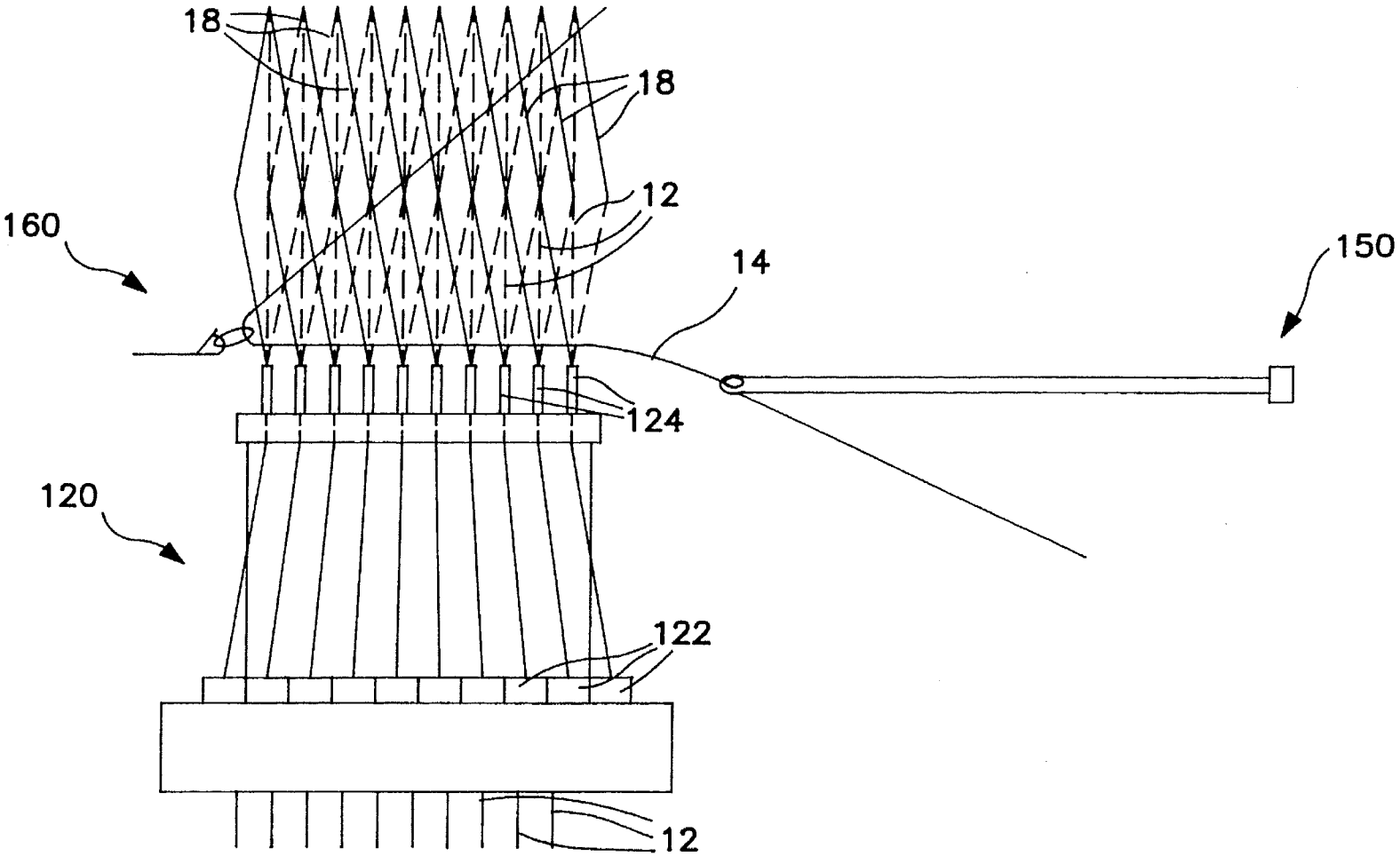
FIG. 13G is a schematic view of step 9 of the weaving cycle.
Figure 13H:
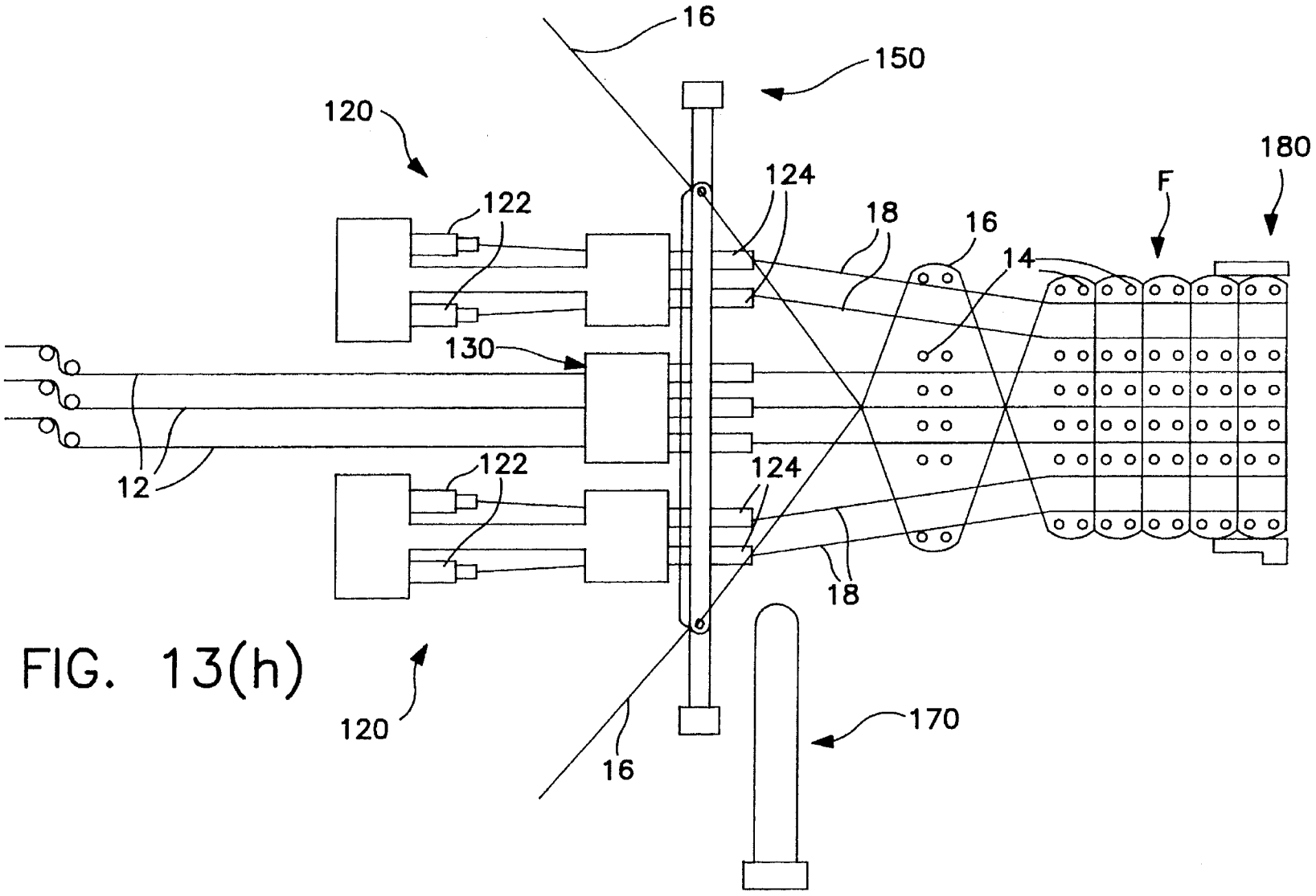
FIG. 13H is a schematic view of step 10 of the weaving cycle.
Figure 13I:
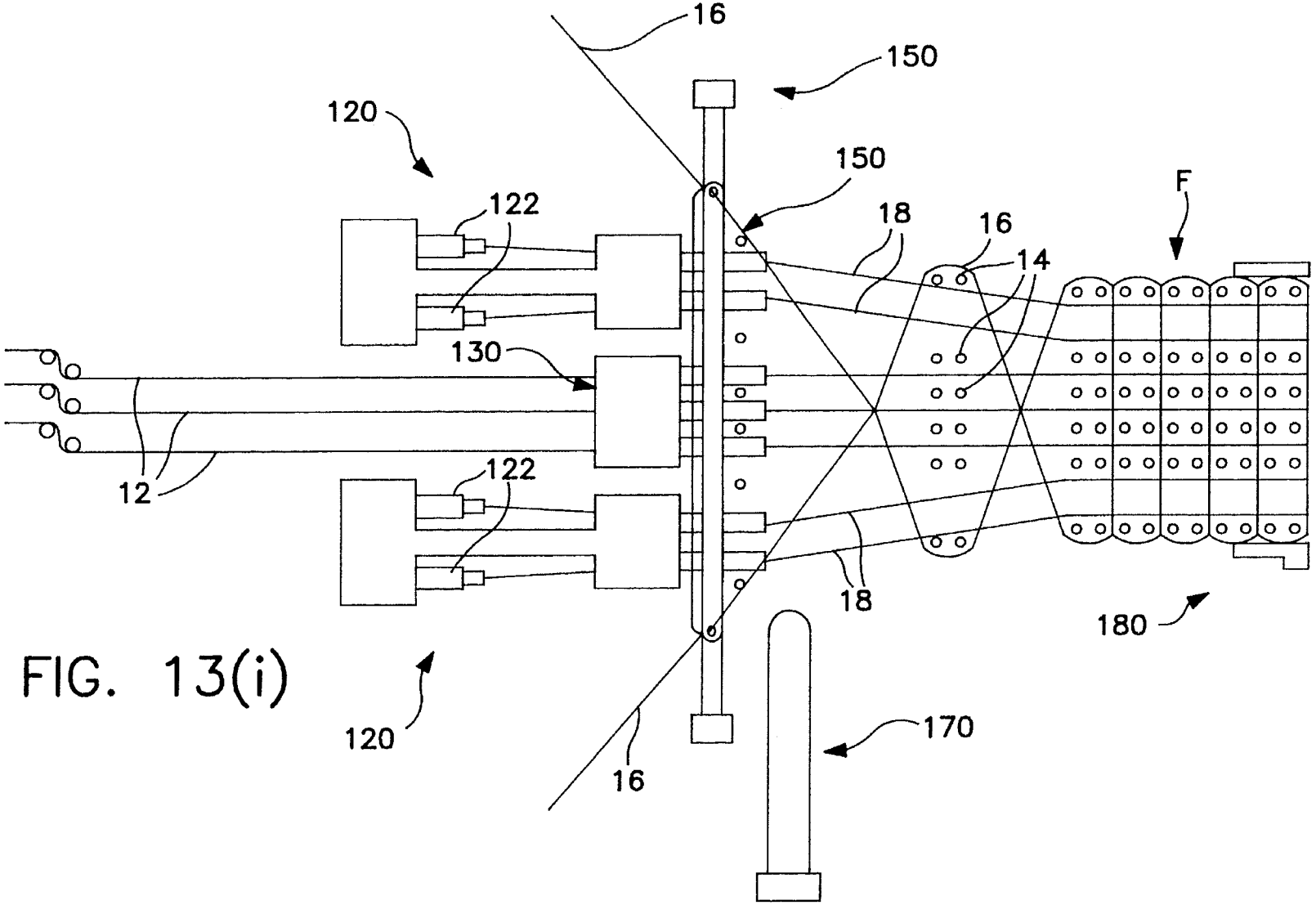
FIG. 13I is a schematic view of step 11 of the weaving cycle.
Figure 13J:
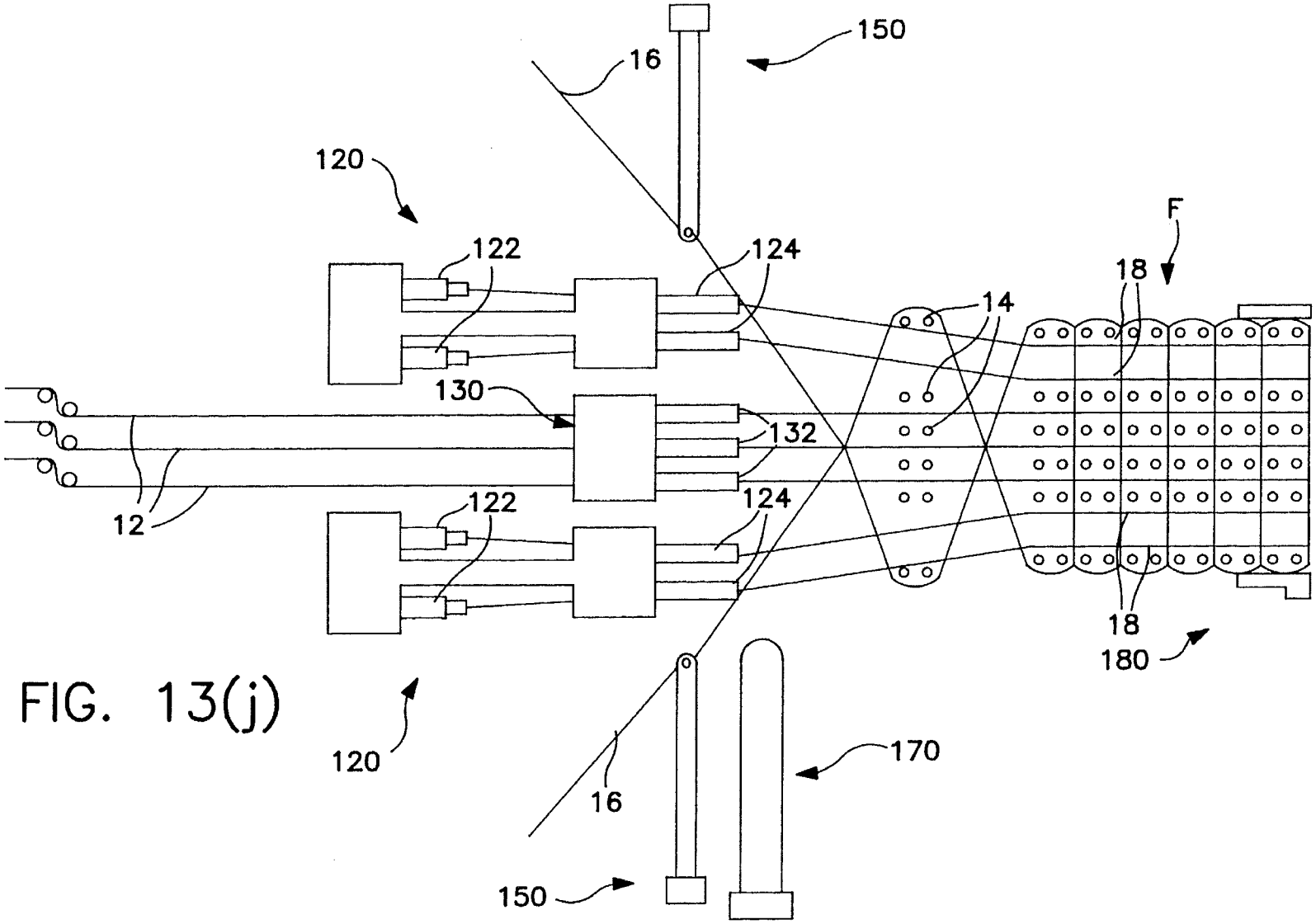
FIG. 13J is a schematic view of step 12 of the weaving cycle.
Figure 13L:
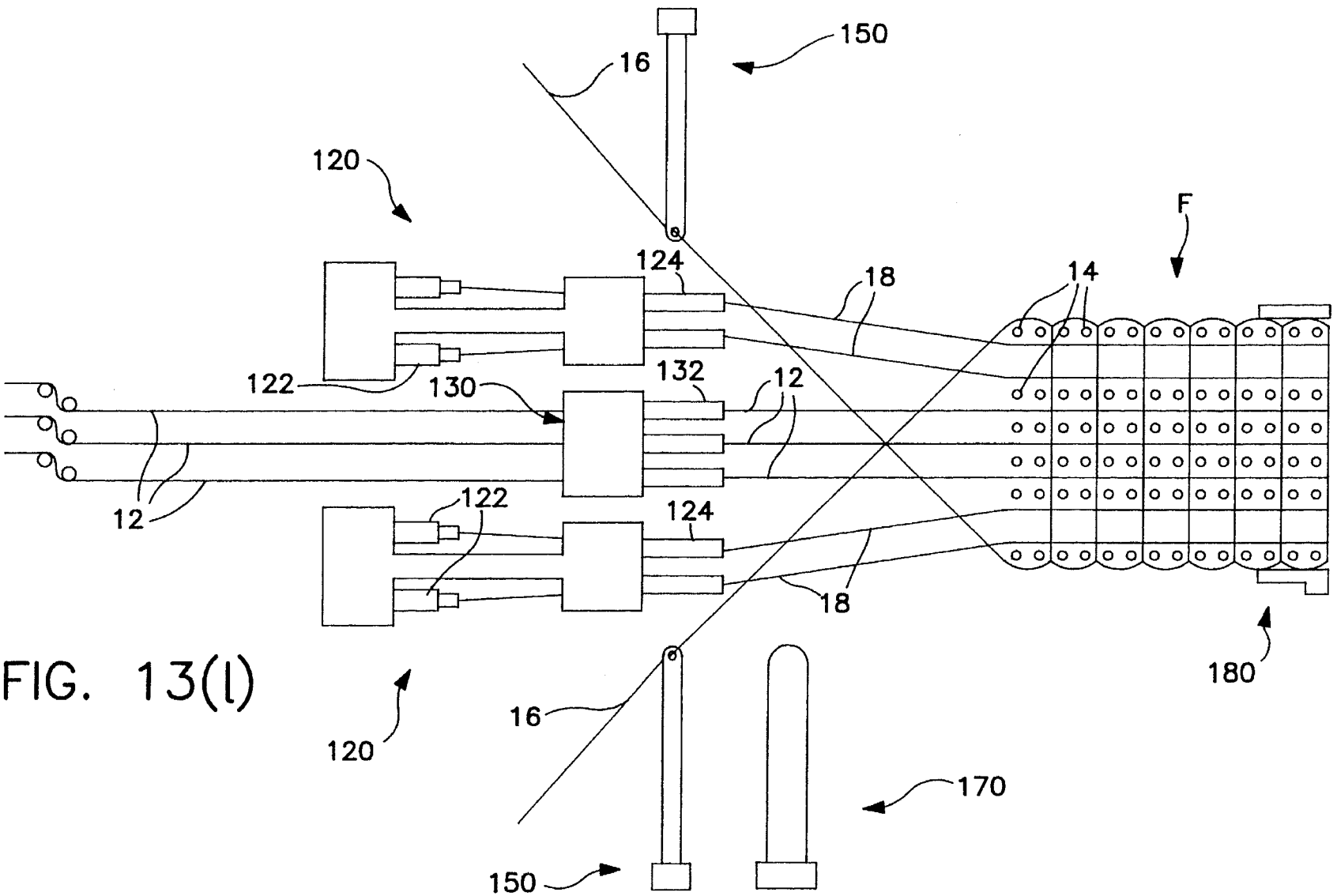
FIG. 13L is a schematic view of steps 14 and 15 of the weaving cycle.
Figure 14:
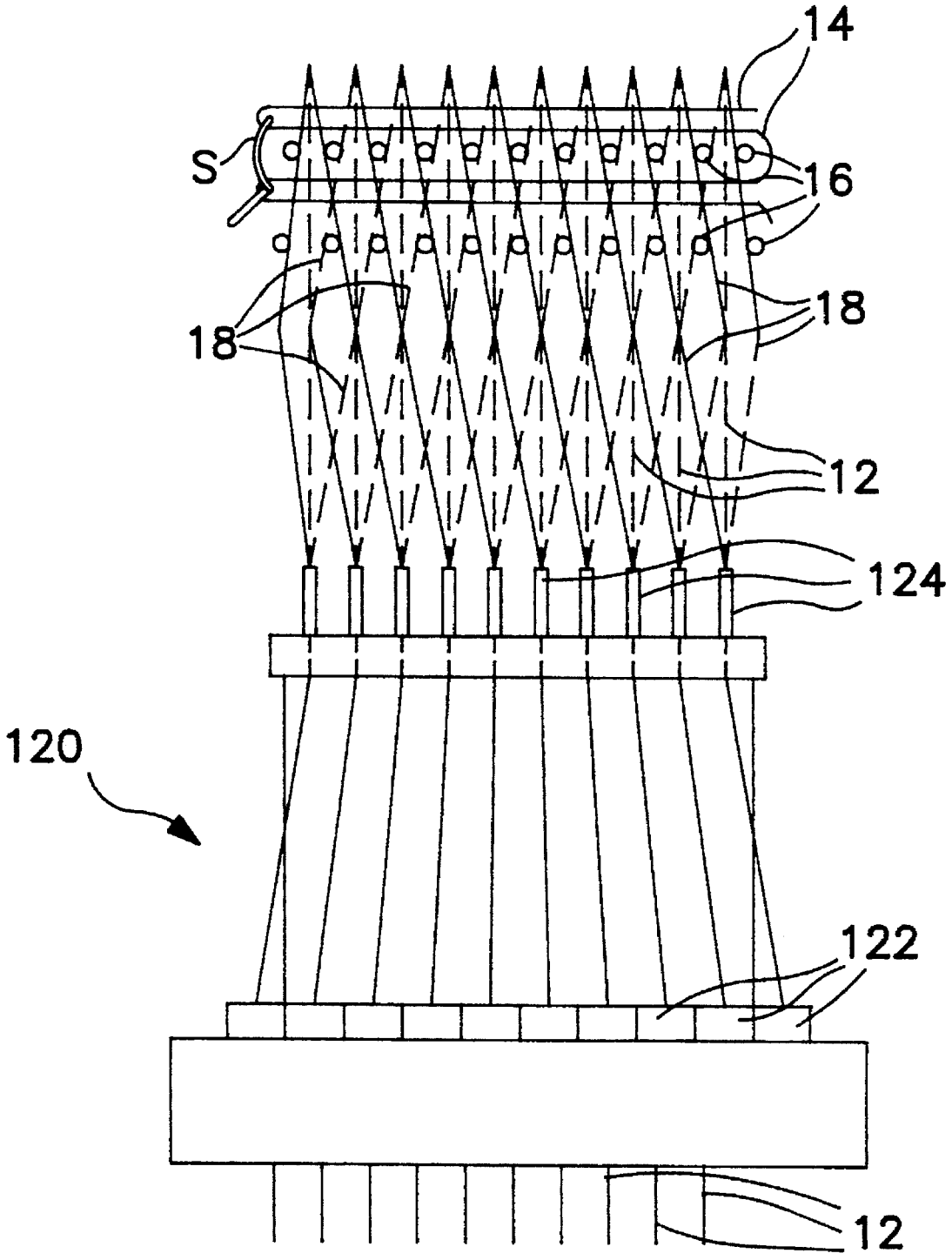
FIG. 14 is a schematic view of the completed fabric formation weaving cycle after one completed cycle of the weaving apparatus shown in FIG. 2.

Referring to the 15 steps to complete one cycle of the multi-axial weaving operation on weaving machine 100, applicant would now like to refer to FIGS. 13–17 to provide a more complete understanding of the weaving steps. Specifically, FIG. 13 provides a schematic view of the starting position of the weaving cycle utilizing weaving apparatus 100. FIGS. 13A–13C are schematic views of steps 1–3, respectively, of the weaving cycle and FIGS. 13D-1 and 13D-2 are schematic views of step 4 of the weaving cycle. FIGS. 13E-1 and 13E-2 show a schematic view of step 5 of the weaving cycle, and FIG. 13F is a schematic view of steps 6, 7, and 8 of the weaving cycle. FIG. 13G–13J shows schematic views of steps 9–12, respectively, of the weaving cycle and FIGS. 13K-1 and 13K-2 show schematic views of step 13. FIG. 13L shows a schematic view of step 14 and step 15 of the weaving cycle, and FIG. 14 shows a schematic view of the completed fabric formation weaving cycle after one completed cycle of weaving apparatus 100 shown in FIG. 2.

Figure 16:
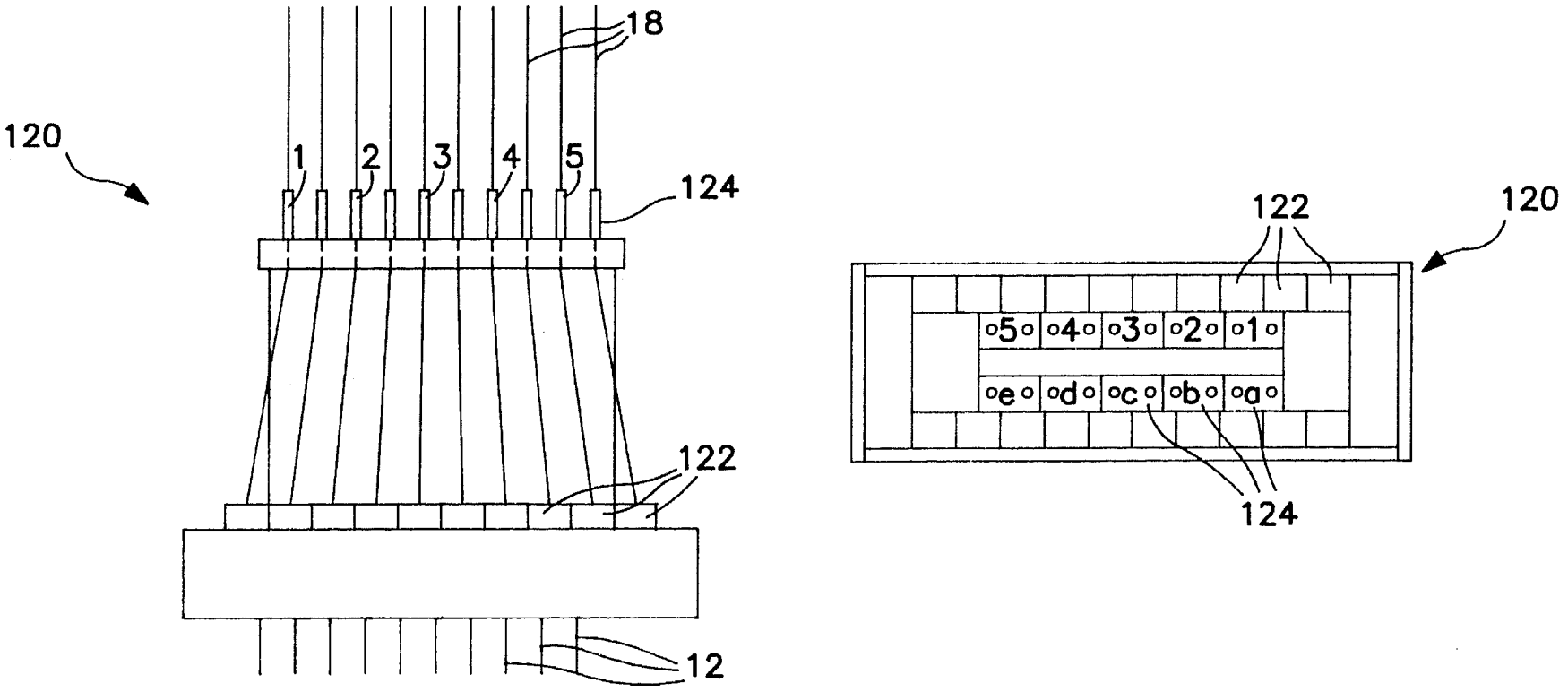
FIG. 16 is a schematic view similar to FIG. 13 showing the beginning point of the bias yarn orientation on the weaving apparatus shown in FIG. 2.
Figure 16A:
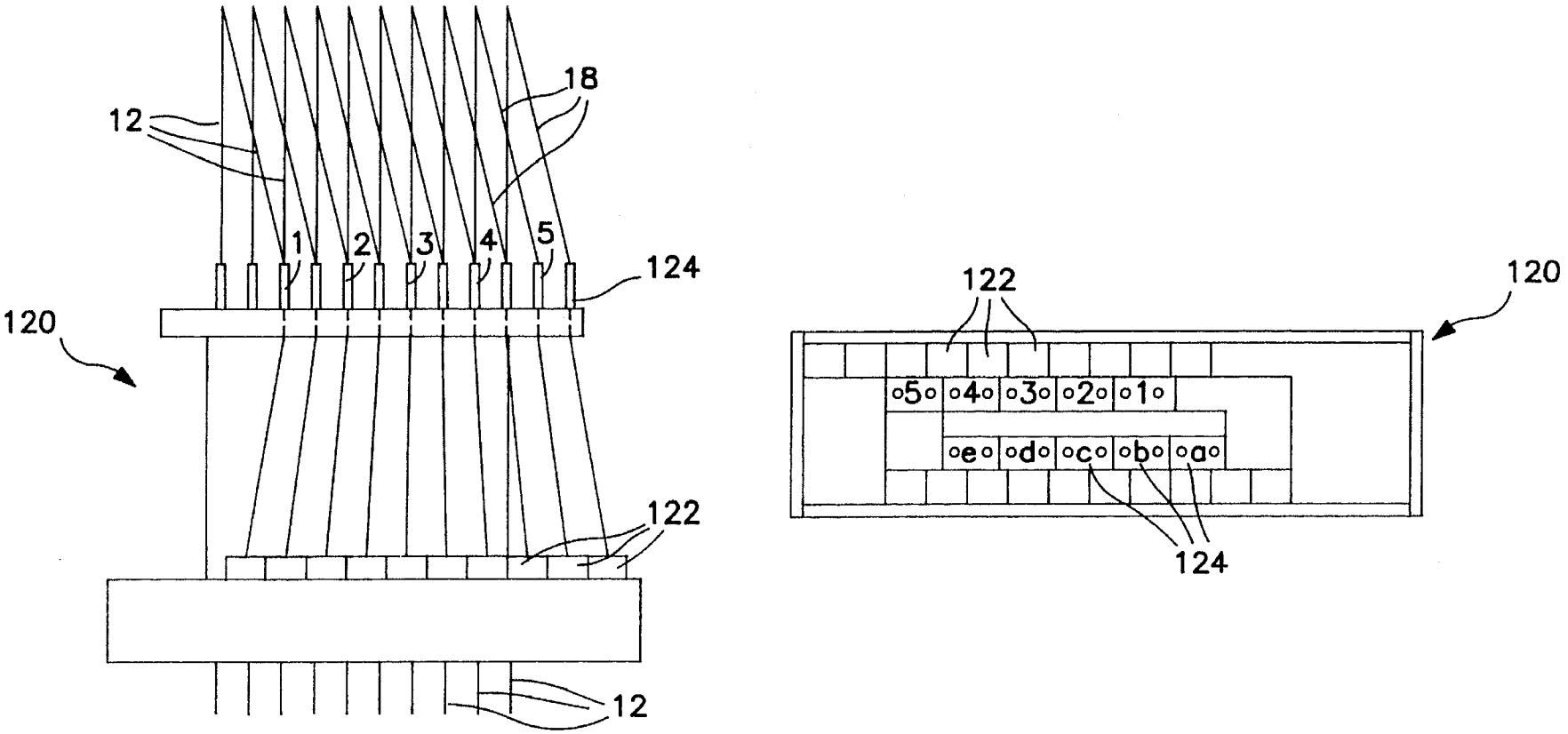
FIG. 16A is a schematic view showing orientation of the bias yarn at a 15° angle with respect to the warp yarn.
Figure 16B:
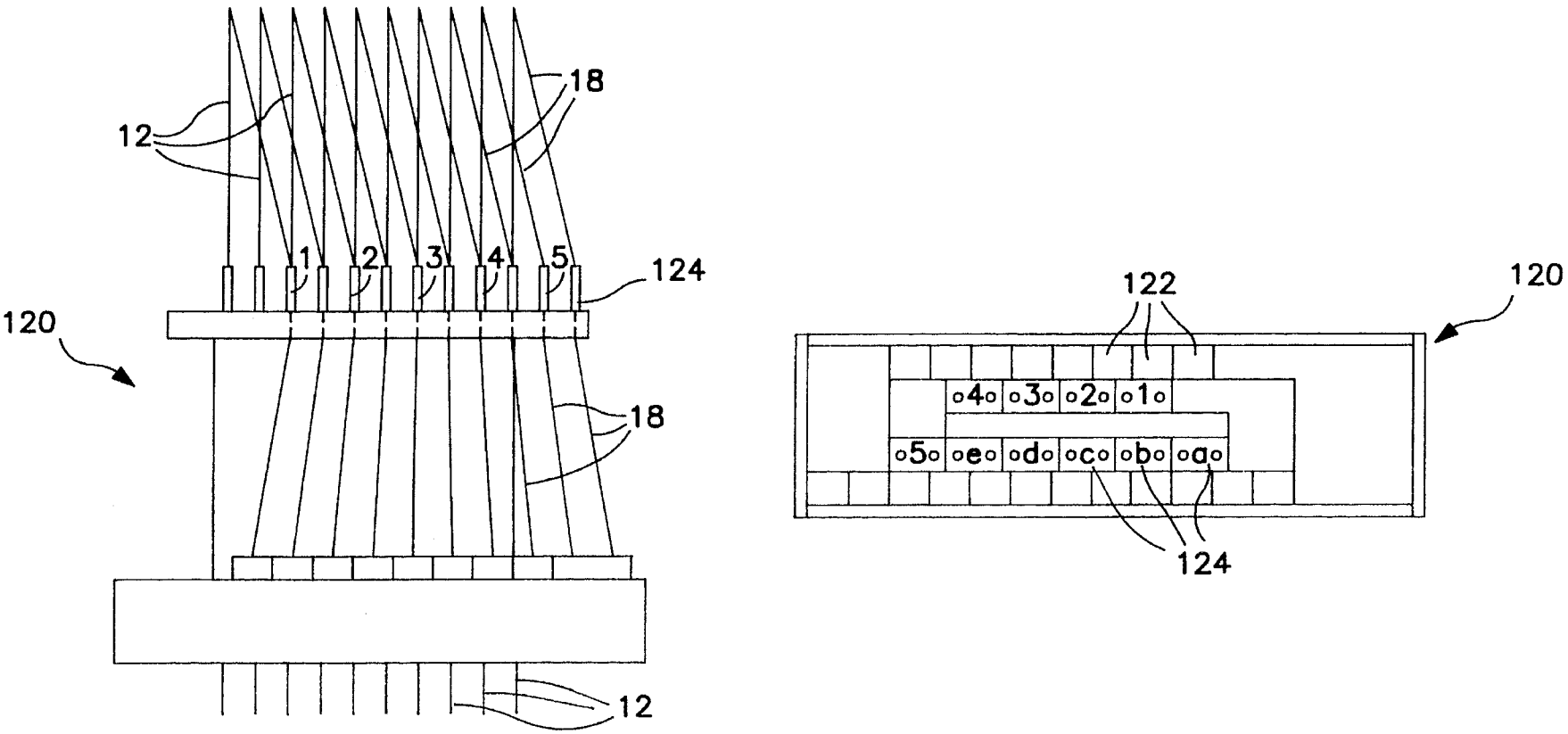
FIG. 16B is a schematic view showing the bias yarn carrier moving downwardly.
Figure 16C:
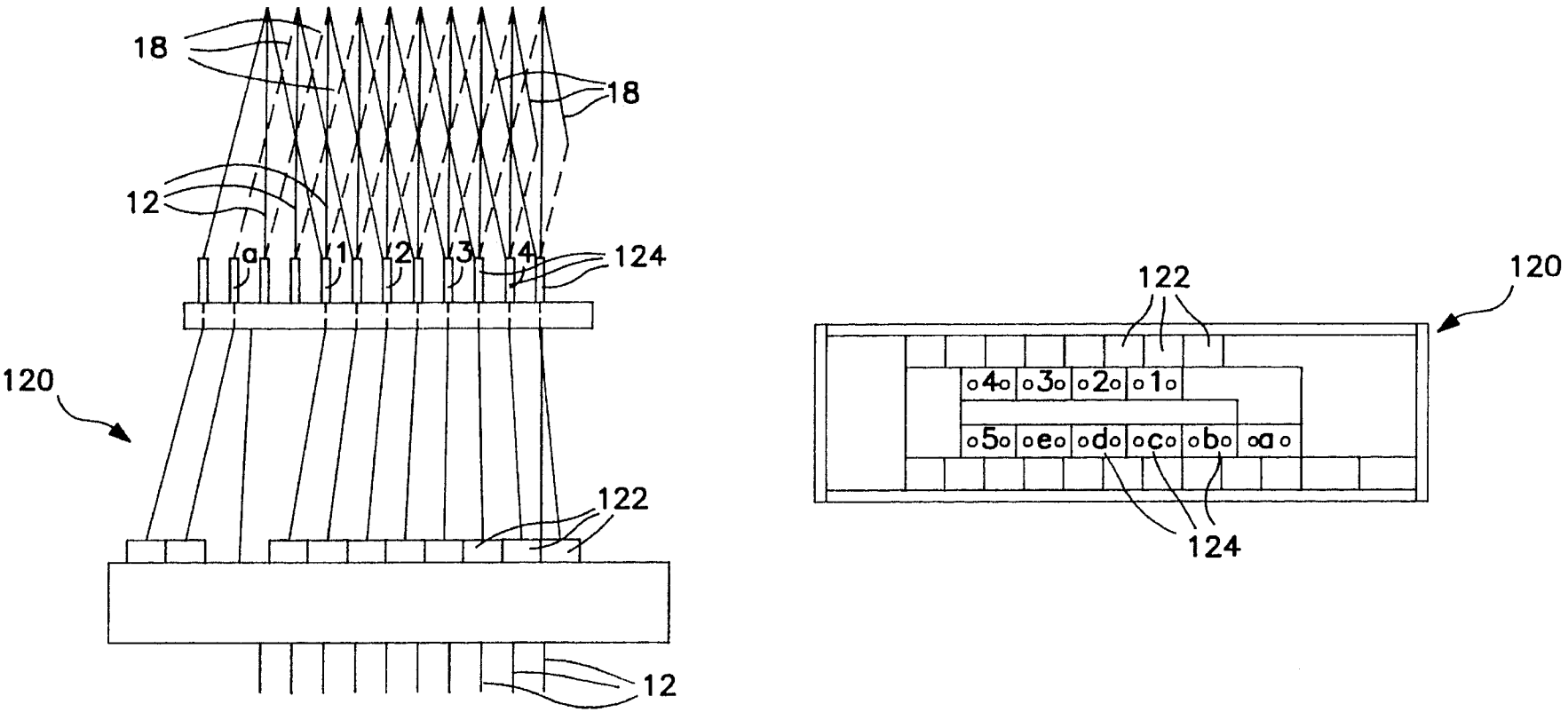
FIG. 16C is a schematic view wherein the positive bias yarn orientation has occurred.
Figure 16D:
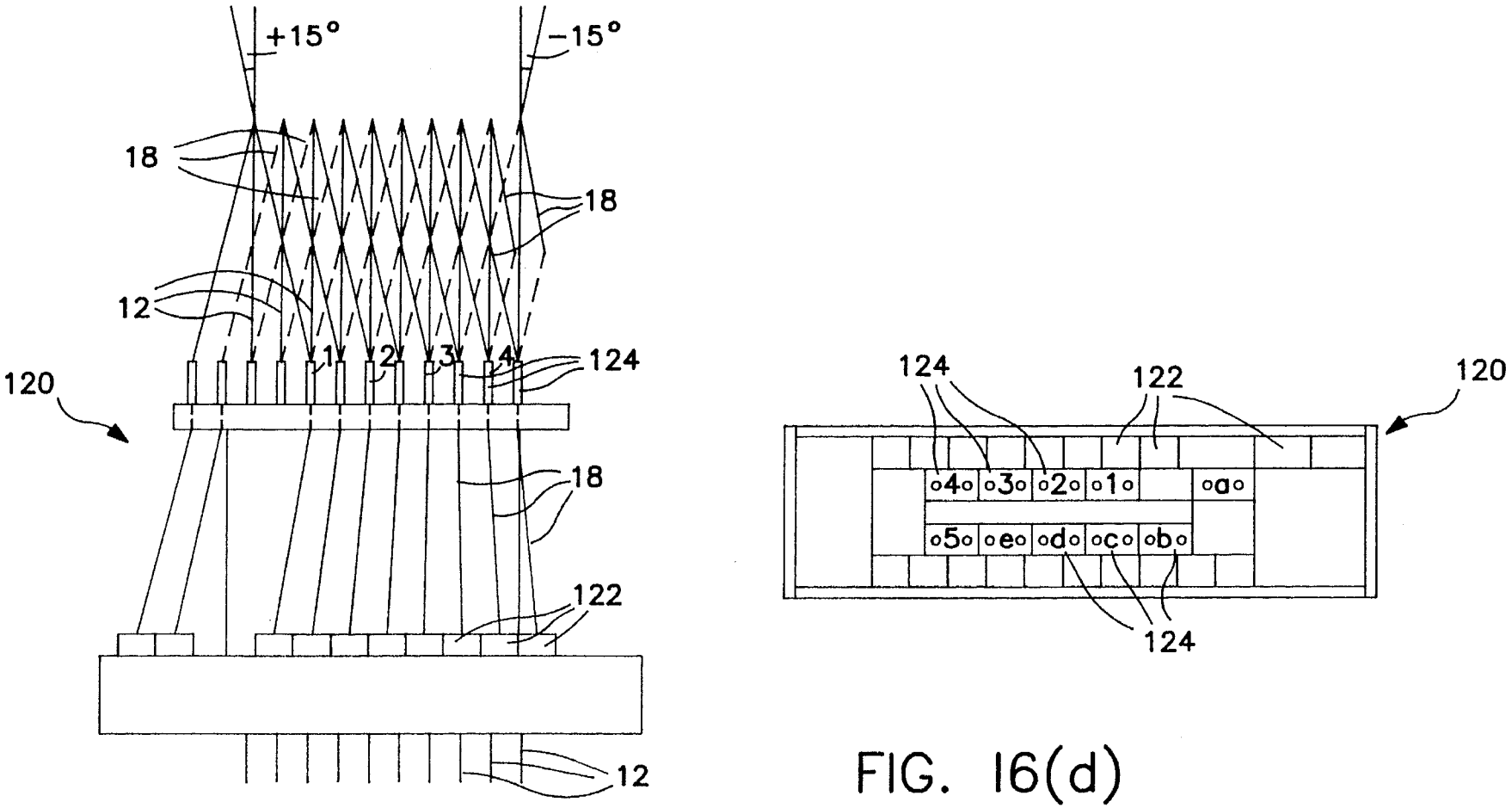
FIG. 16D is a schematic view showing the yarn carrier moving upwardly so that the negative bias yarns will be oriented at a 15° angle with respect to the warp yarns.
Figure 16E:
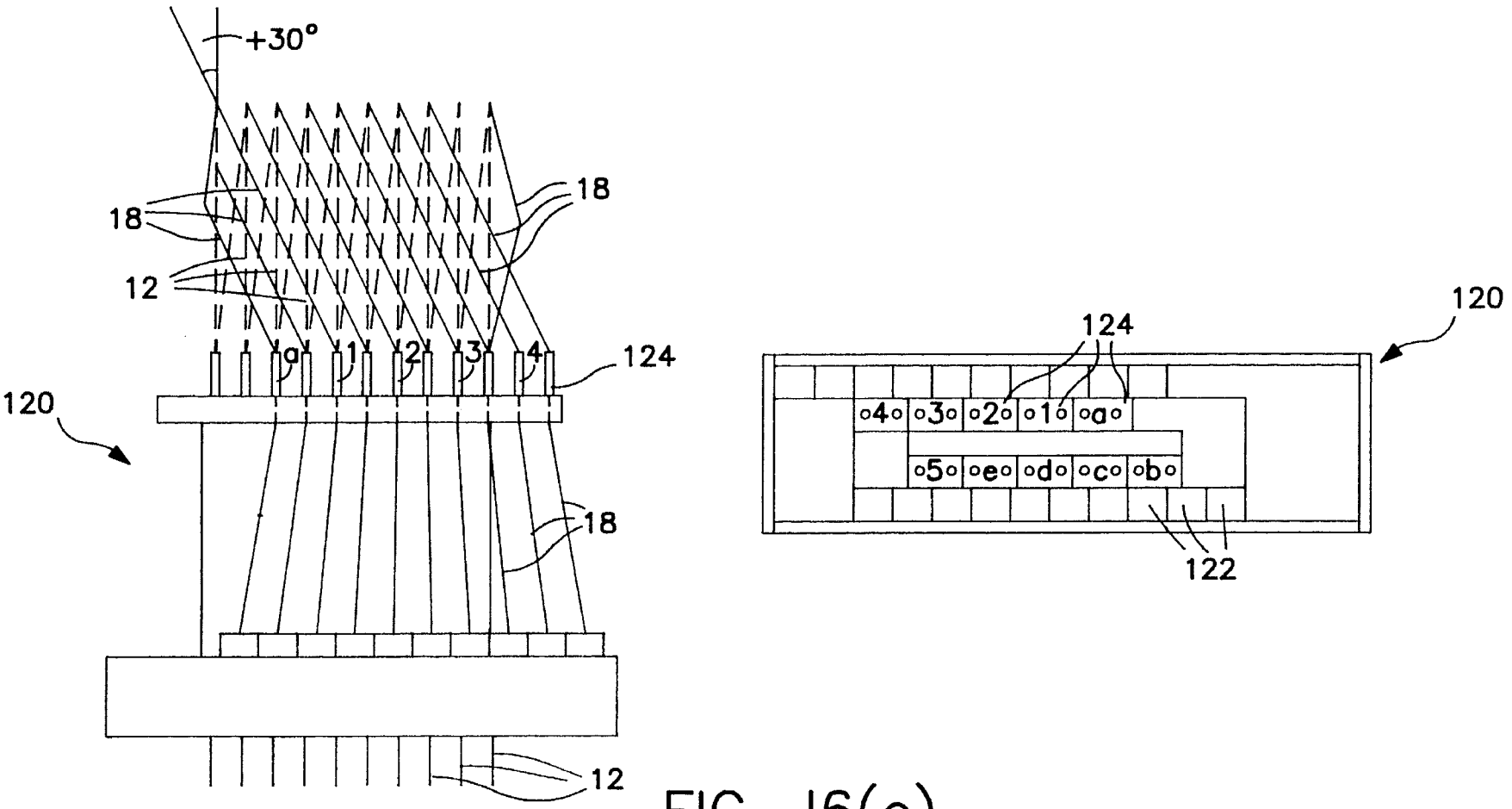
FIG. 16E is a schematic view showing bias yarn orientation occurring again so as to render the positive bias yarn at a 30° angle with respect to warp yarns.
Figure 16F:
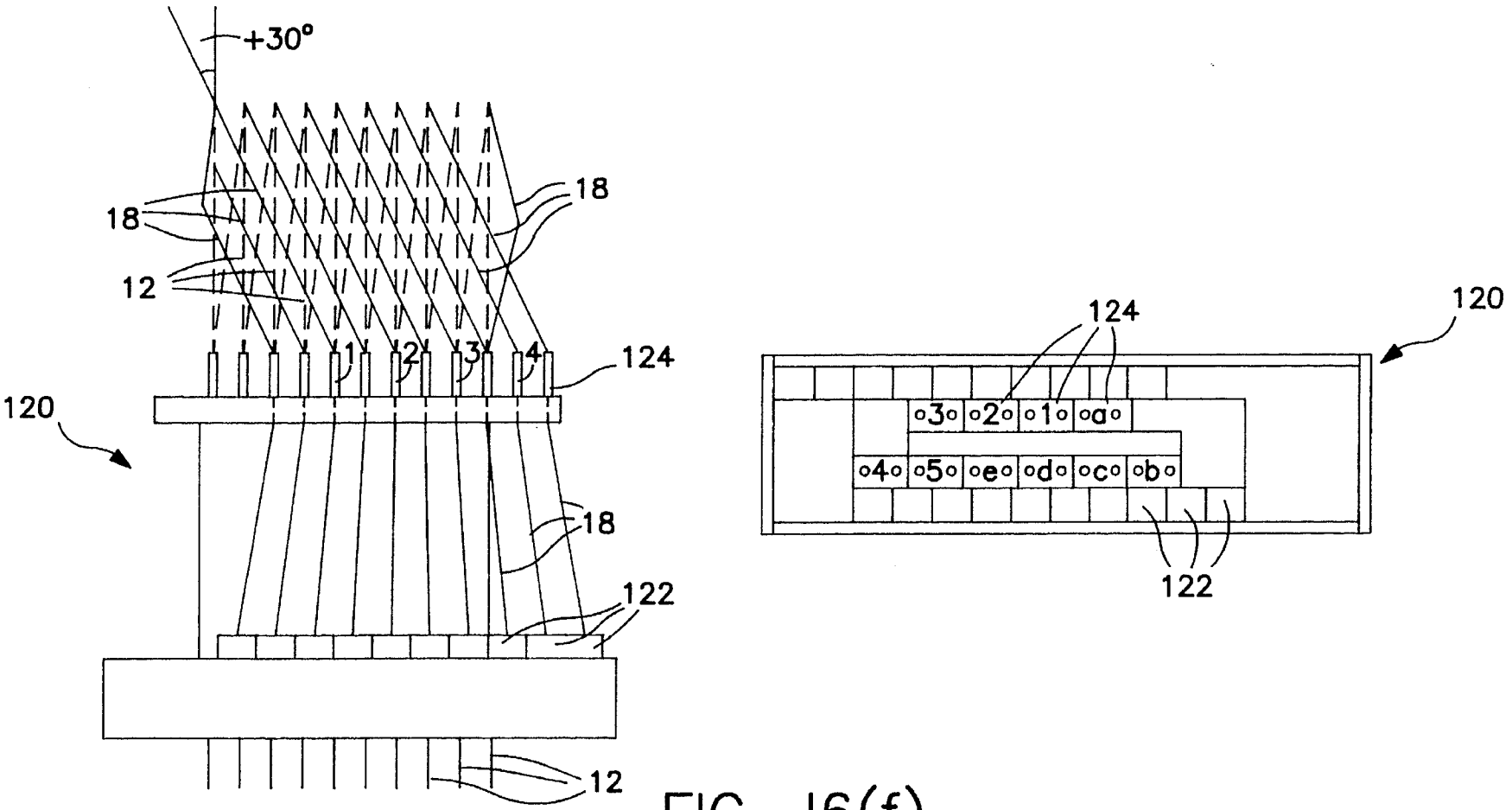
FIG. 16F is a schematic view showing the yarn carrier moving downwardly.
Figure 16G:
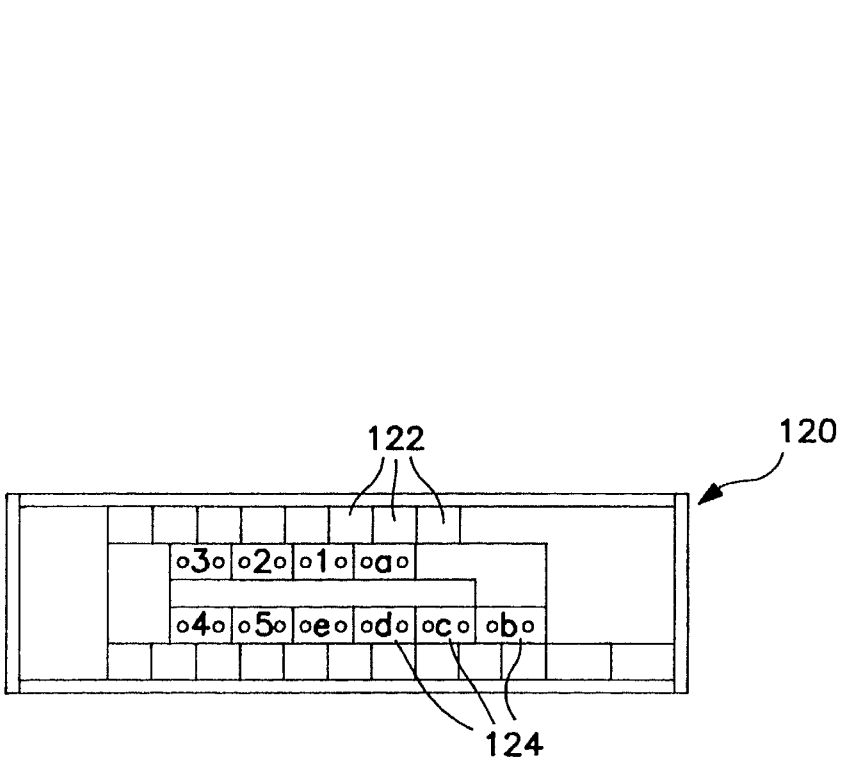
FIG. 16G is a schematic view showing the bias yarn orientation having occurred.
Figure 16G:
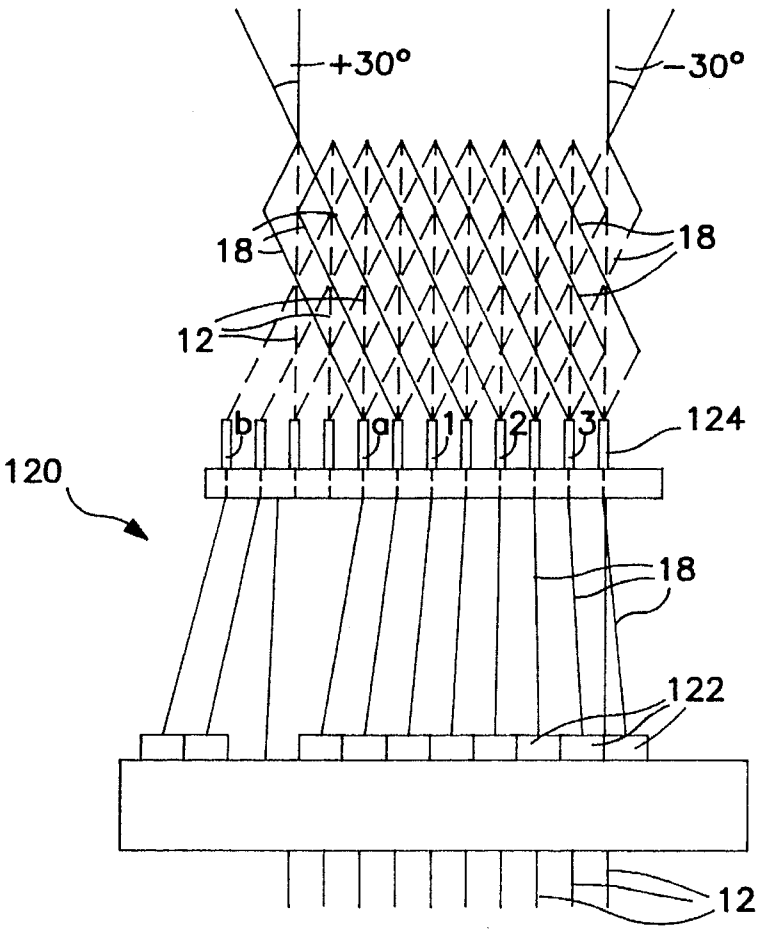
Figure 16H:
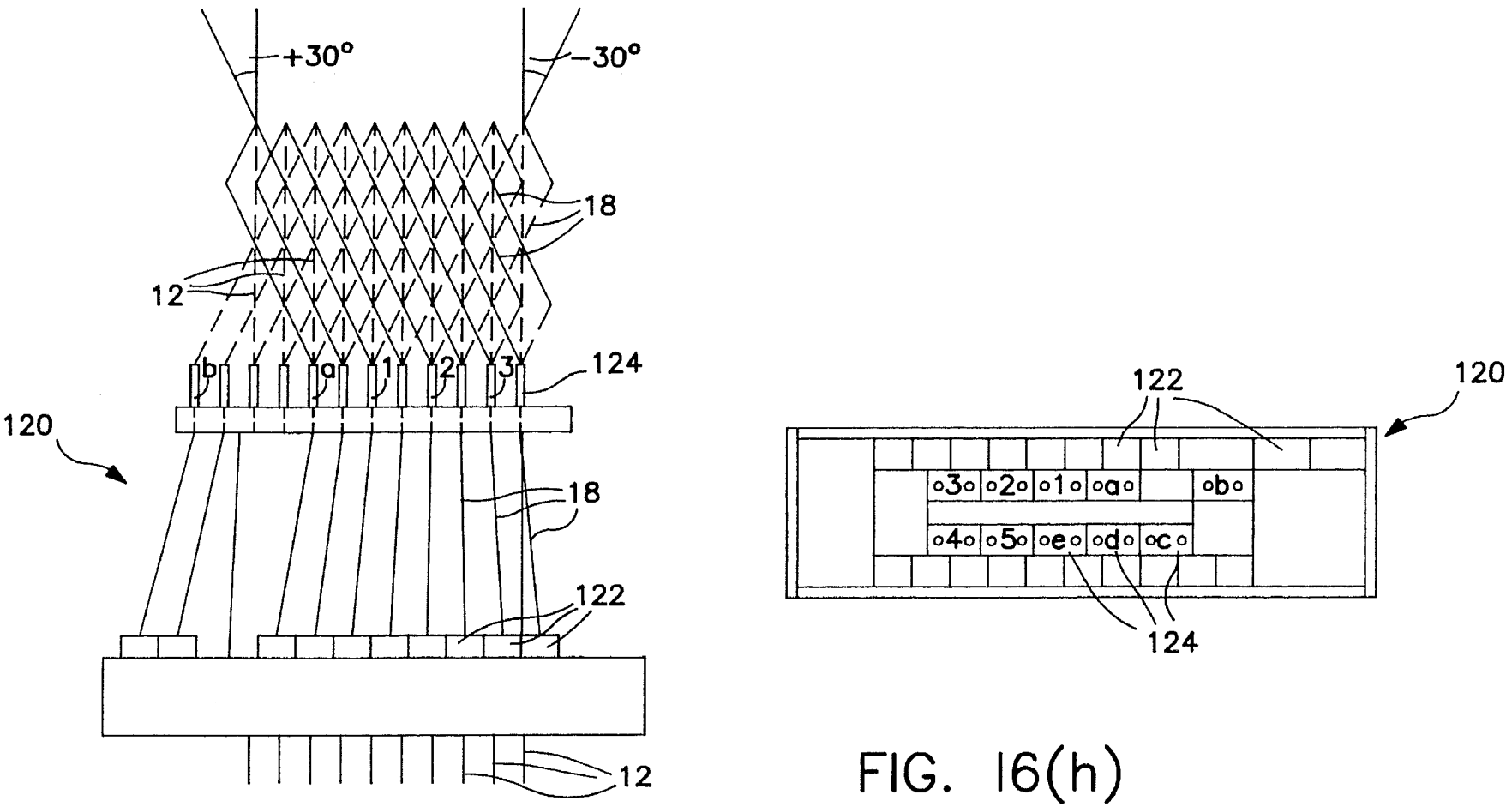
FIG. 16H is a schematic view showing the yarn carrier moving upwardly.
Figure 16J:
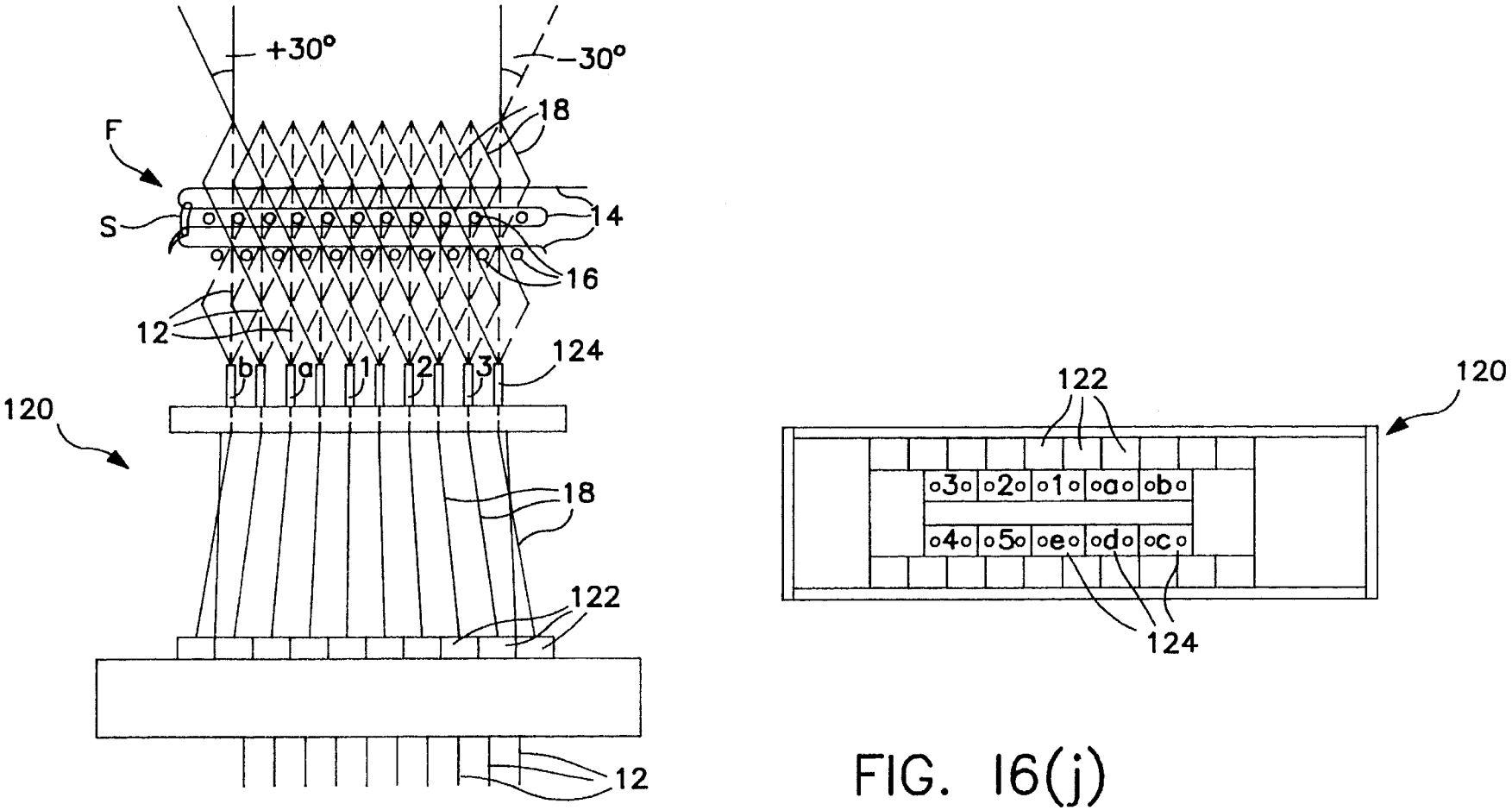
FIG. 16J is a schematic view of the weaving apparatus shown in FIG. 2 after the weft and Z-yarn insertions (and wherein it can be seen that 45° and 60° angles for the bias yarn with regard to the warp yarn are easily achievable by repeating the yarn carrier movement for a third and fourth time, respectively)

Also, referring now to FIG. 16 for a still more detailed explanation of the bias yarn orientation, applicant notes that FIG. 16 is a schematic view very similar to FIG. 13 described hereinabove showing the beginning point of the bias yarn orientation on weaving apparatus 100 as best seen in FIG. 2. FIG. 16A is a schematic view showing orientation of the bias yarn at a 15° angle with respect to the warp yarn, and FIG. 16B is a schematic view showing the bias yarn carrier moving downwardly. FIG. 16C shows a schematic view wherein the positive bias yarn orientation has occurred, and 16D shows the yarn carrier moving upwardly so that the negative bias yarns will be oriented at a 15° angle with respect to the warp yarns. FIG. 16E shows a bias yarn orientation occurring so as to render the positive bias yarn at a 30° angle with respect to warp yarns, and FIG. 16F shows the yarn carrier moving downwardly. FIG. 16G shows the bias yarn orientation having occurred, and FIG. 16H shows the yarn carrier now moving upwardly. FIG. 16I shows a schematic view of the yarn carrier moving forward and the bias yarns achieving a 30° angle with regard to the warp yarns for both surfaces of fabric F so that weaving apparatus 100 is ready for the weft yarn insertion step. FIG. 16J shows weaving apparatus 100 after the weft and z-yarn insertions and wherein it can be seen that the 45° and 60° angles for the bias yarn with regard to the warp yarn are easily achievable by repeating the yarn carrier movement for a third and fourth time, respectively.

EMBODIMENT 2

Figure 12:
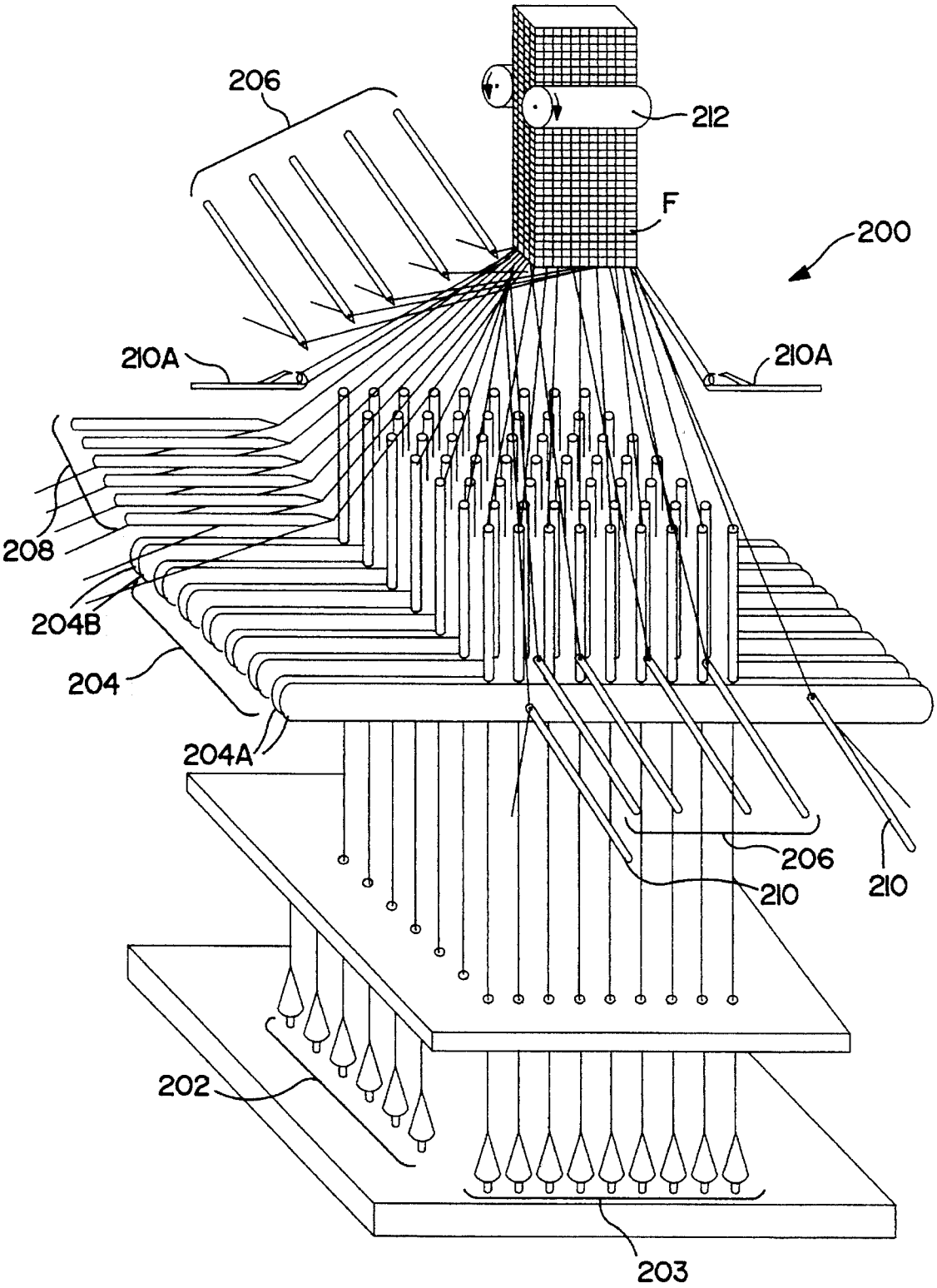
FIG. 12 is a schematic perspective view of a manually operated apparatus for forming the three-dimensional fabric according to the present invention.

A manual apparatus for forming the novel three-dimensional fabric according to the invention is shown in FIG. 12. Apparatus 200 produces a multi-axial three-dimensional fabric F as described hereinabove and was also developed by the College of Textiles at North Carolina State University in Raleigh, N.C. Apparatus 200 is very similar to the automated apparatus 100 conceived by the inventors to fabricate the novel multi-axial three-dimensional fabric of the invention as shown in FIG. 2. Apparatus 200 comprises bobbins 202 for axial yarn and bobbins 203 for bias yarns to be inserted into the three-dimensional woven fabric. The warp yarns extend from bobbins 202 up through yarn guiding tube bars 204 and into multi-axial three-dimensional woven fabric F. Needles 206 are provided on opposing sides of apparatus 200 for inserting Z-yarns in the thicknesswise direction of fabric F between adjacent columns of warp yarn. Needles 208 are provided at one side of apparatus 200 for inserting weft yarns between adjacent rows of the warp yarns and selvage needles 210 will serve to secure the loops of weft yarns at both sides of the fabric structure being formed.

Figure 15:
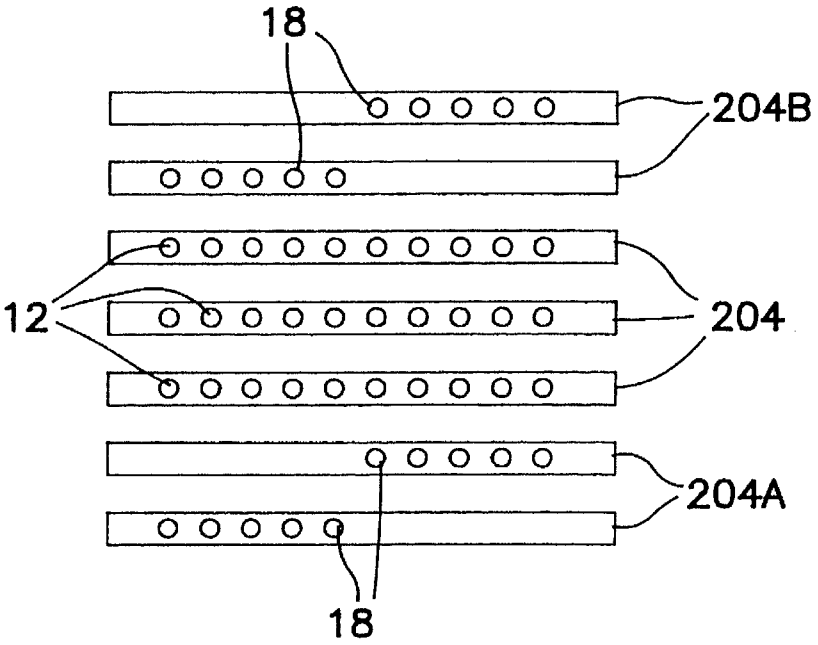
FIG. 15 is a schematic view of the starting position of the weaving cycle for the manually operated weaving apparatus shown in FIG. 12 wherein the left side illustrates the front view of the weaving apparatus and the right side illustrates a cross-sectional view of the weaving zone.
Figure 15:
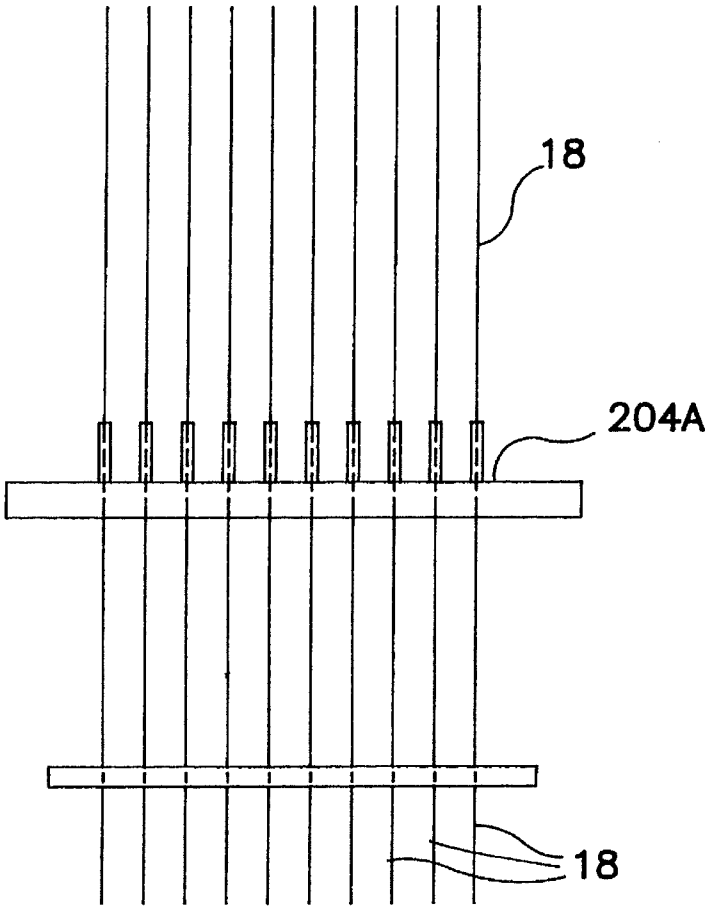

Thus, apparatus 200 provides for the warp yarns being arranged in a matrix of rows and columns within the desired cross-sectional shape and FIG. 15 illustrates the starting position of apparatus 200 and FIG. 15A–15J represent the steps of the weaving operation as described hereinbelow. After the front and back pair of bias thread layers are oriented in a relatively symmetrically inclined relationship by the pair of tube bars 204A and 204B positioned at the front and back surfaces of the fabric preform being constructed, weft yarns are inserted by needles 208 between the rows of warp yarns and the loops of the filling yarns are secured by selvage yarn at both sides of the structure by selvage needles 210 and cooperating latch needles 210A and then are returned to their initial position.

Next, the Z-yarns are inserted from both the front surface and back surface of the three-dimensional fabric F being formed by needles 206 which pass across each other between the columns of the warp yarns to lay the Z-yarns in place across the previously inserted filling yarn. The filling yarn is again inserted by filling insertion needles 208 as described hereinbefore and the yarns returned to their starting position. Thereafter, the Z-yarns are returned to their starting position by Z-yarn insertion needles 206 by passing between the columns of warp yarns once again and locking the bias yarn and filling yarns into place in the fabric structure. The inserted filling, bias and Z-yarns are beaten into place against the woven line by a bar-like element (not shown) and a take-up system 212 removes woven structure F from the weaving zone. Although applicant has hereinabove described one cycle of operation of apparatus 200 to fabricate three-dimensional multi-axial woven fabric according to the invention, the cycle would be continuously repeated depending upon the length of fabric required.

Figure 15A:
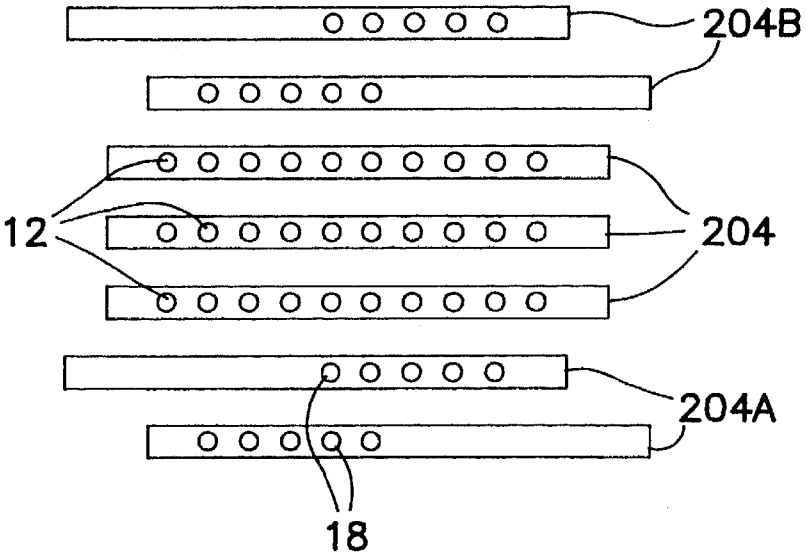
FIG. 15A is a schematic view of a one-step movement of a pair of bias yarn carrier tube bars on both sides of the three-dimensional fabric being constructed (wherein one step is the center-to-center distance between two adjacent carrier tubes)
Figure 15A:
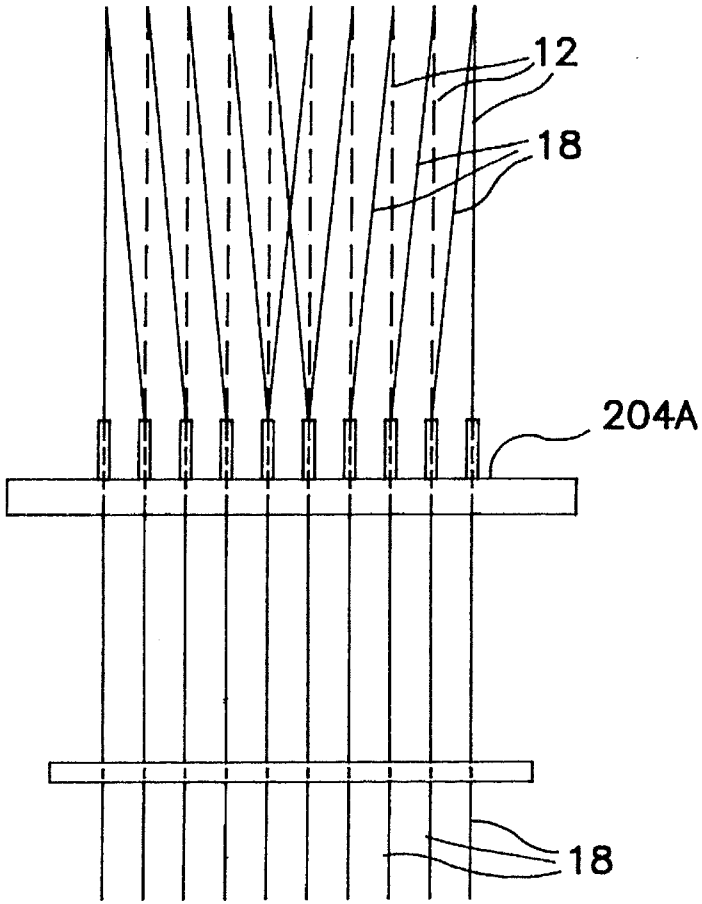
Figure 15B:
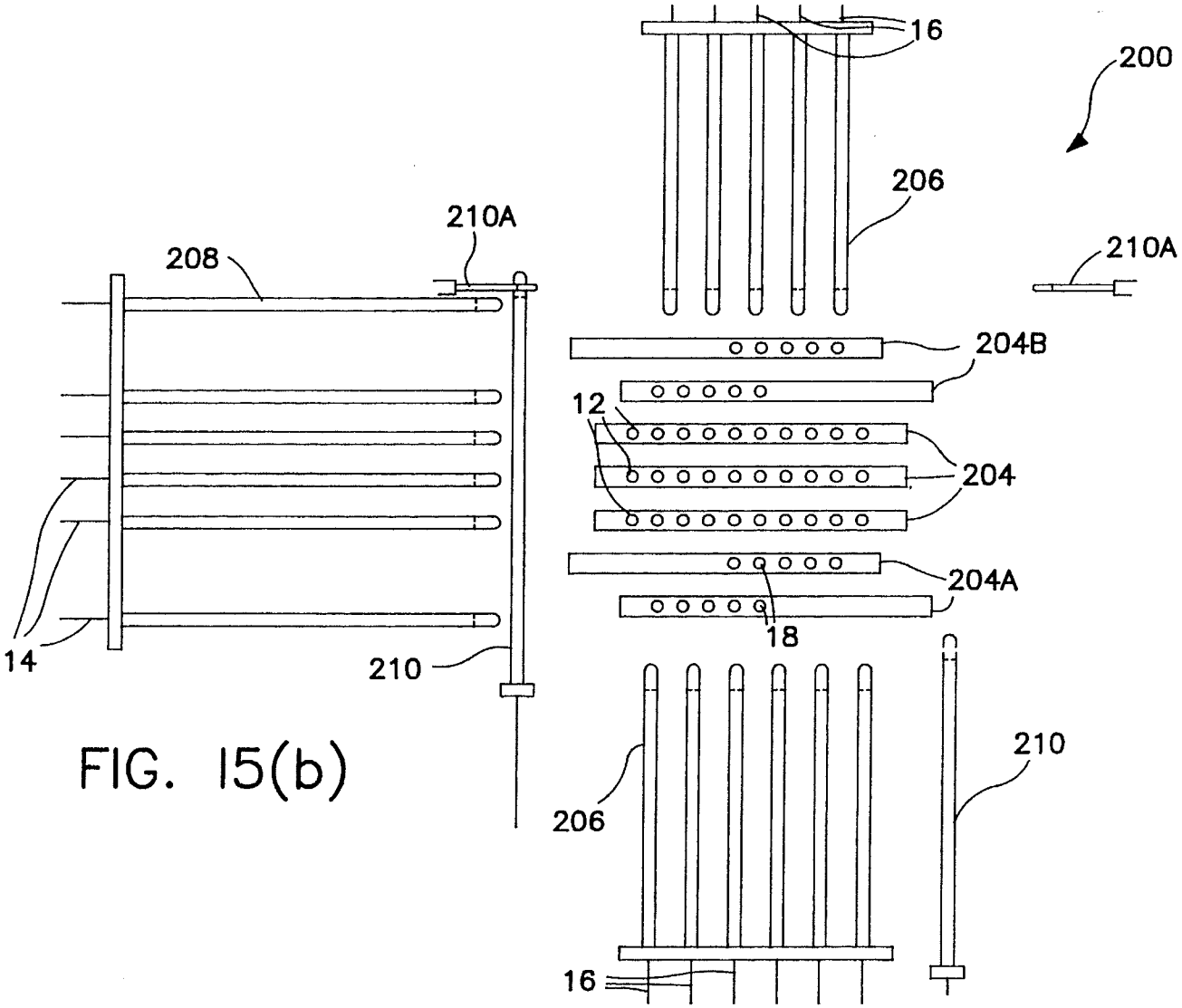
FIG. 15B is a schematic view wherein the first selvage needle moves forward and the first latch needle holds the selvage loop.
Figure 15C:
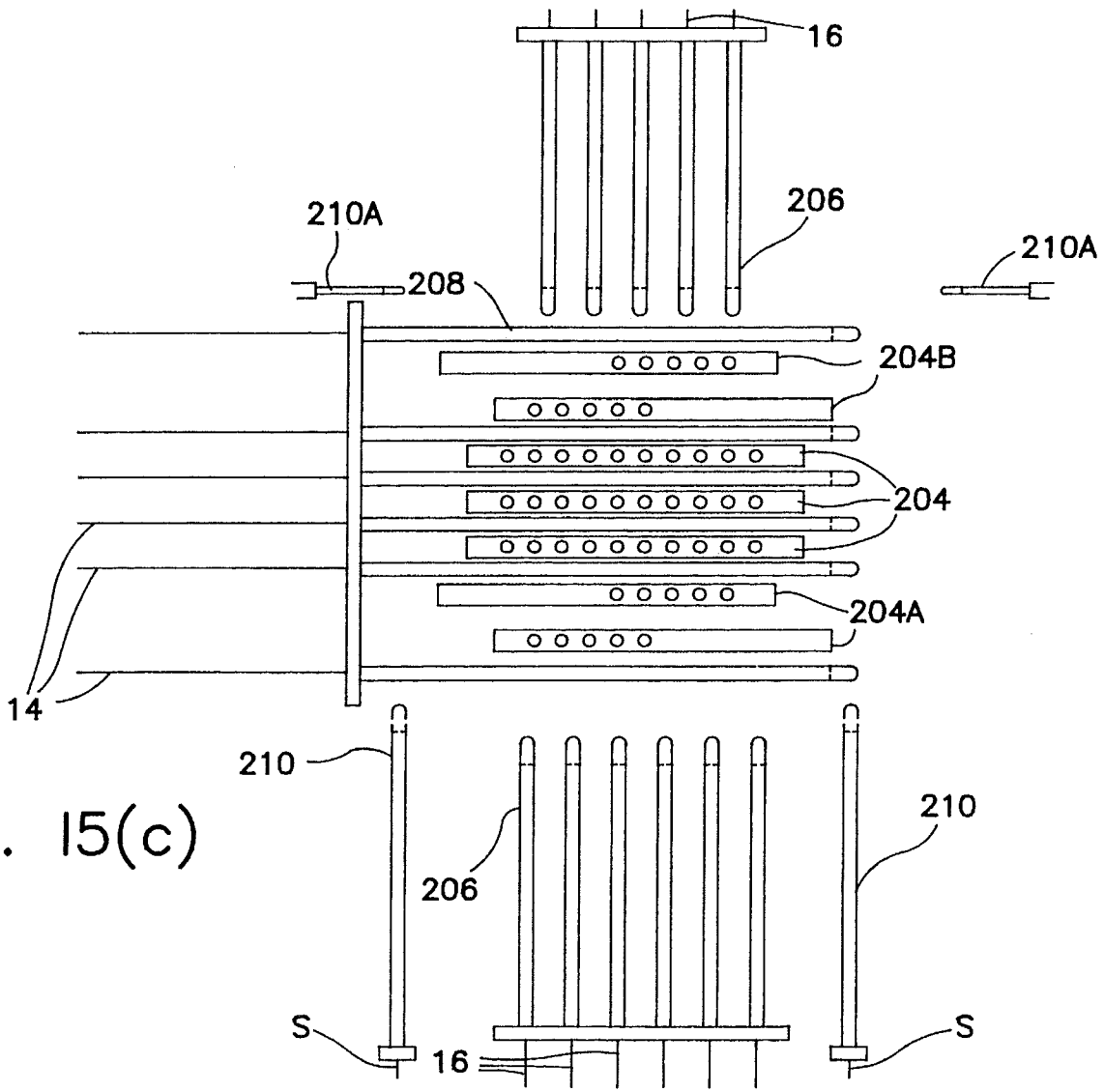
FIG. 15C is a schematic view wherein the first selvage needle and latch needle return to their initial position and weft yarn is inserted into the three-dimensional fabric.
Figure 15D:
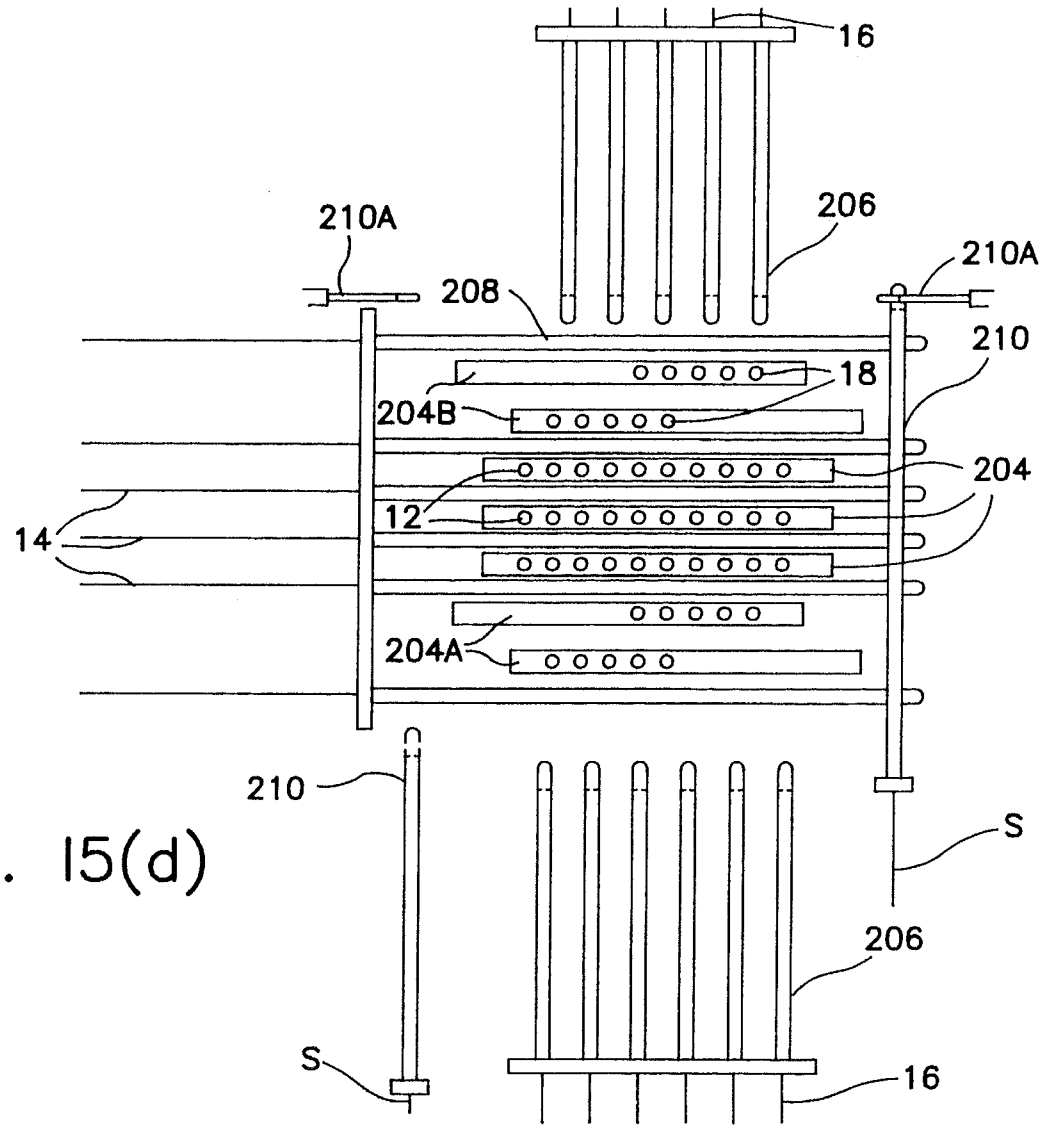
FIG. 15D is a schematic view wherein the second selvage needle moves forward through the weft loops and the second latch needle holds the selvage loop and secures the weft loops.
Figure 15E:
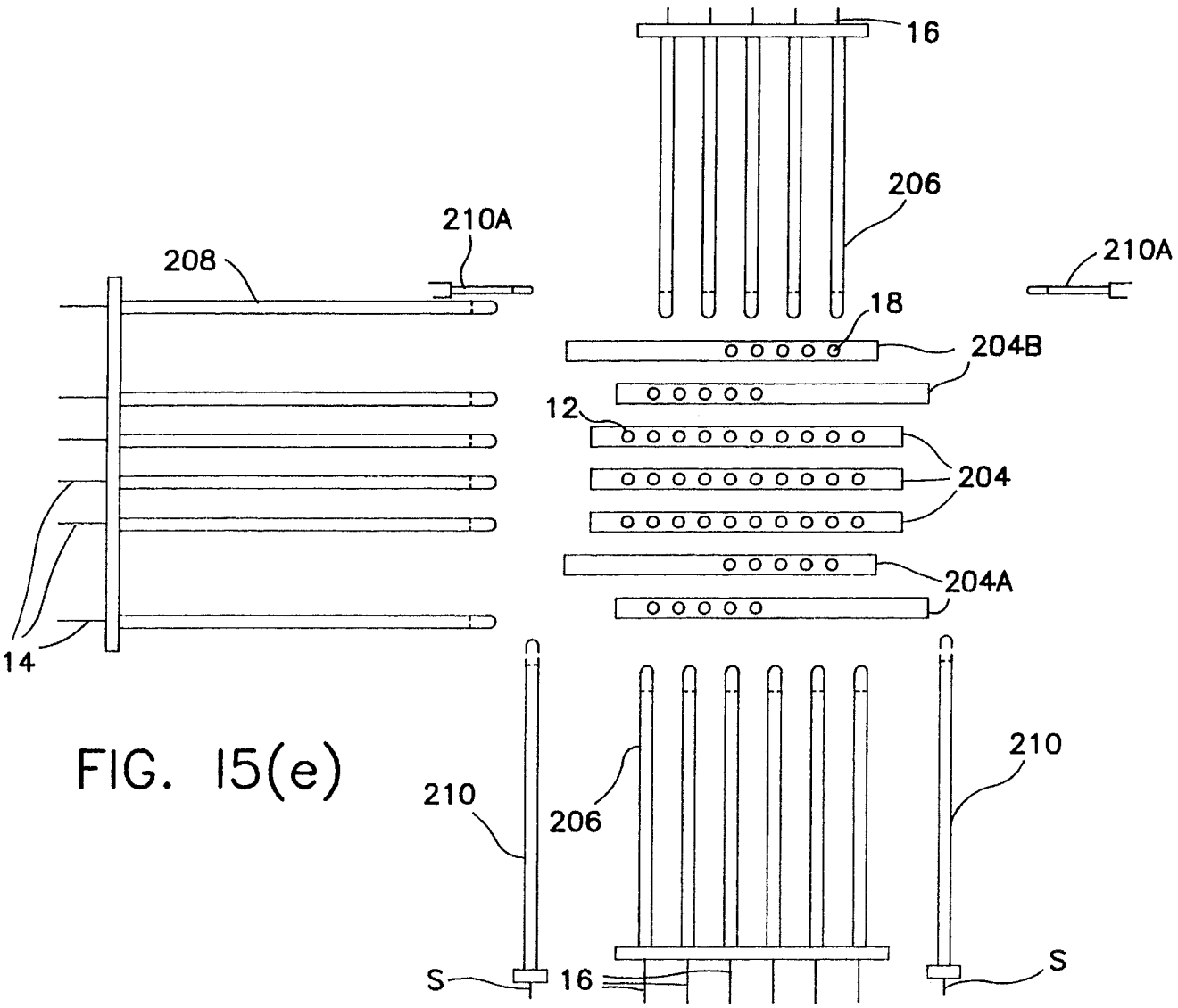
FIG. 15E is a schematic view wherein the second selvage needle and latch needle are returned to their initial positions.
Figure 15F:
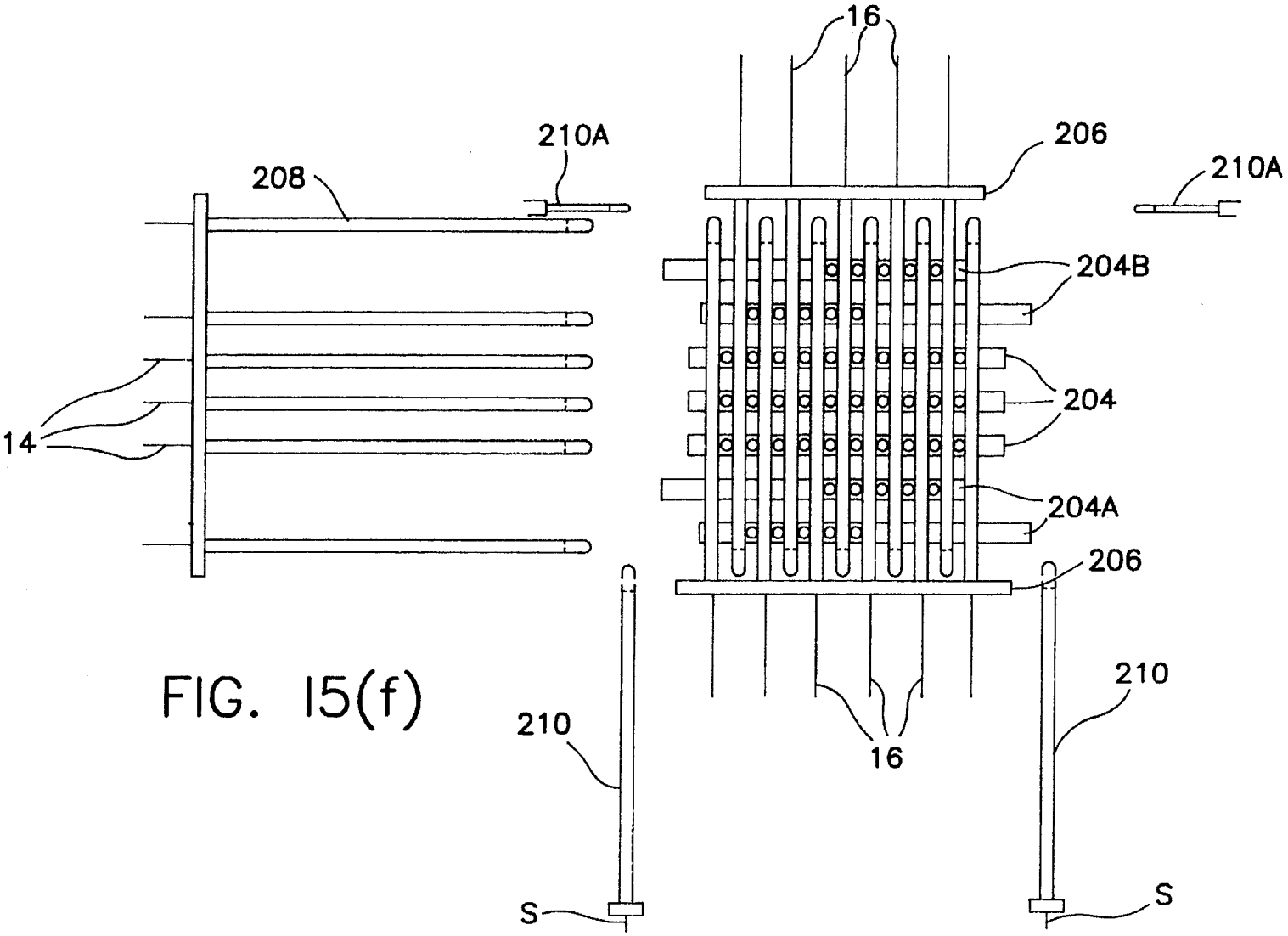
FIG. 15F is a schematic view wherein the Z-yarn needles are inserted from both sides of the weaving zone and passed through the yarn carrier tube and yarn-guiding tube corridors (and wherein the weaving steps described in FIGS. 15B–15E are repeated so that weft yarns are inserted again while the Z-yarn needles are in the weaving zone)
Figure 15G:
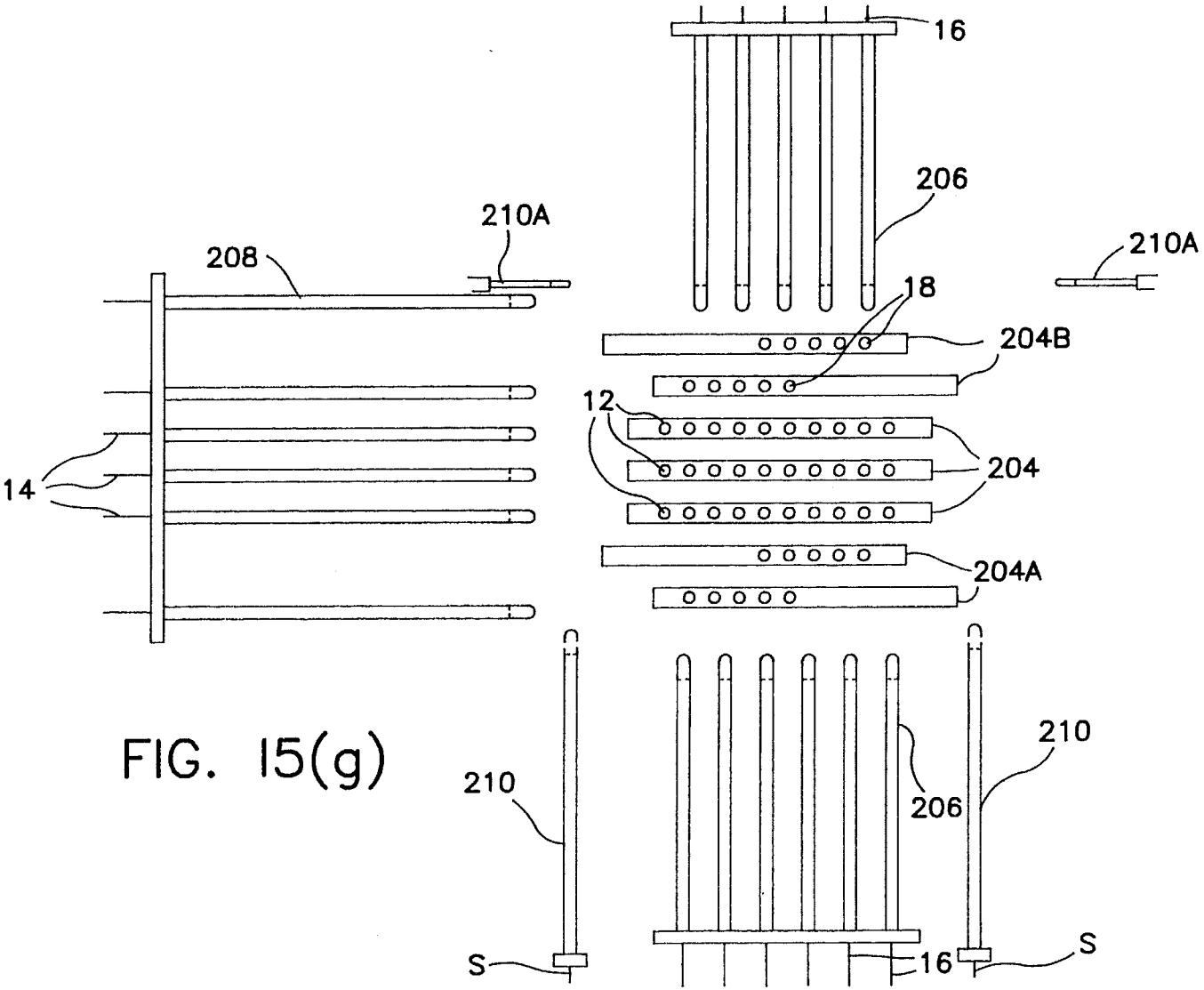
FIG. 15G is a schematic view of Z-yarn insertion needles returning to their starting positions and locking the bias yarns, weft yarns and warp yarns together.
Figure 15H:
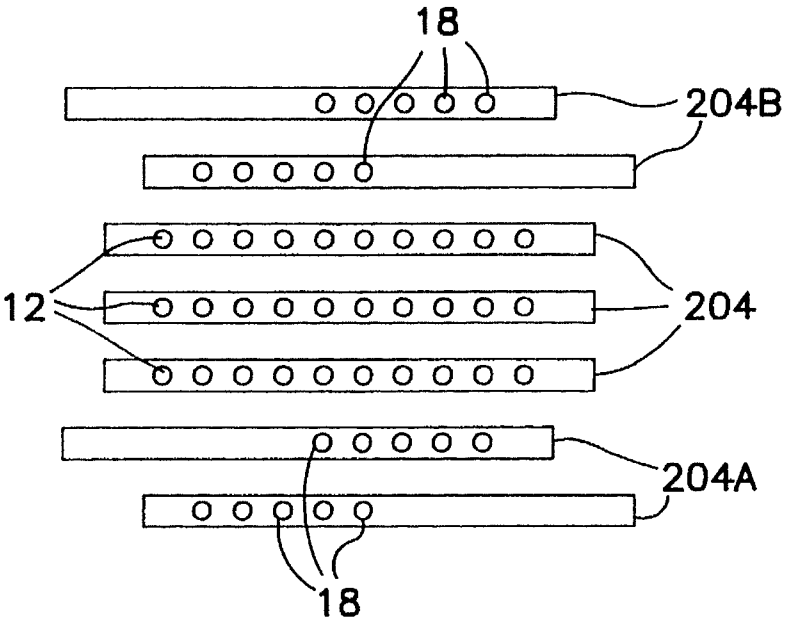
FIG. 15H is a schematic view of the three-dimensional fabric formation after one cycle is completed of the weaving operation on the manually operated apparatus shown in FIG. 12.
Figure 15H:
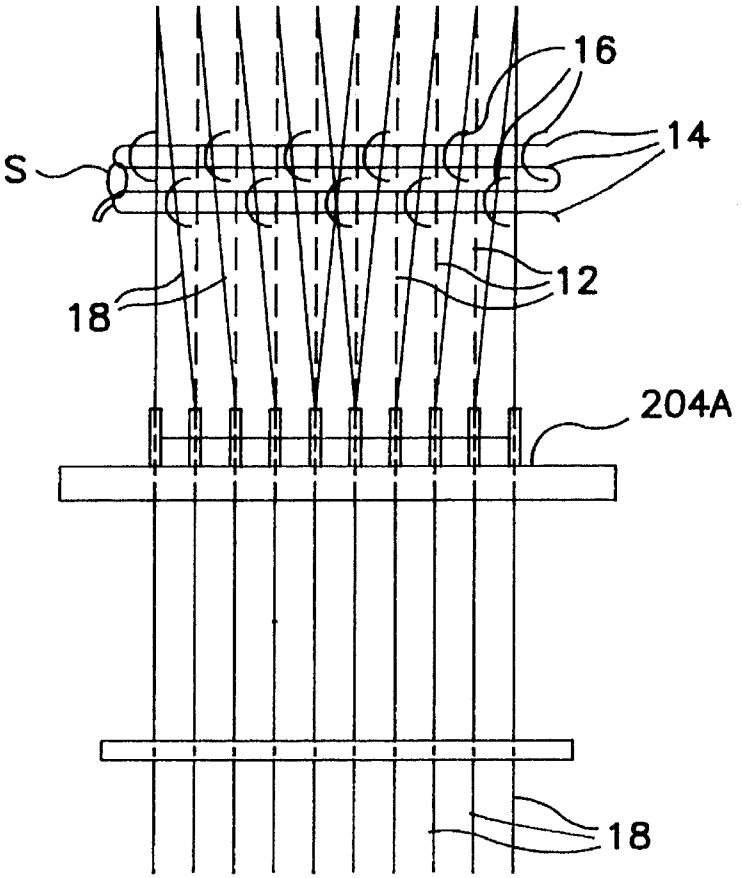
Figure 15I:
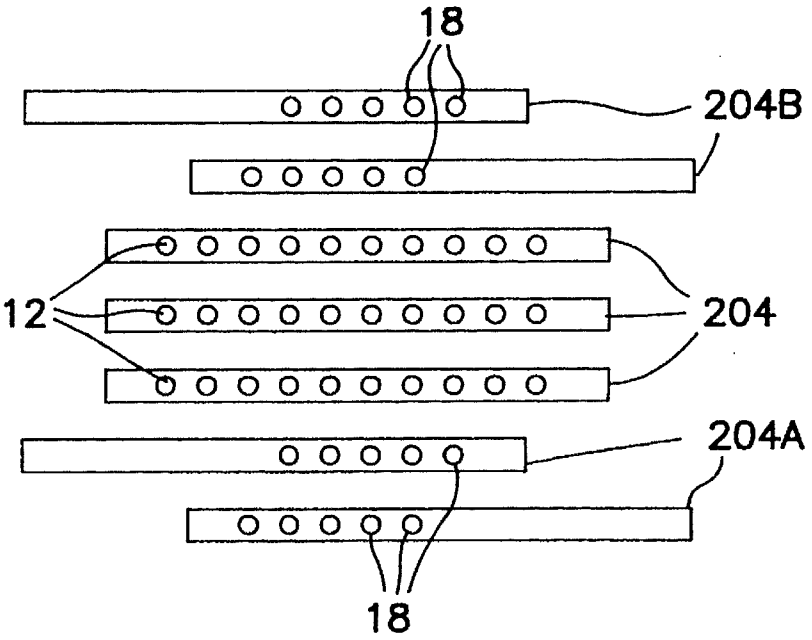
FIG. 15I is a schematic view similar to 15H after a second cycle of the weaving operation has been completed.
Figure 15I:
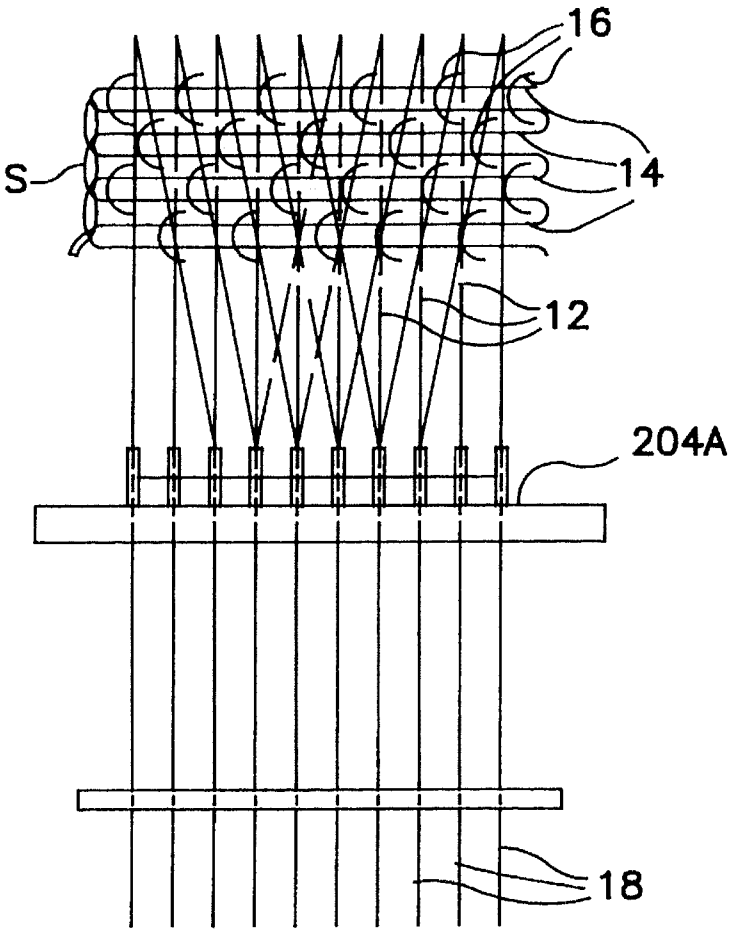
Figure 15J:
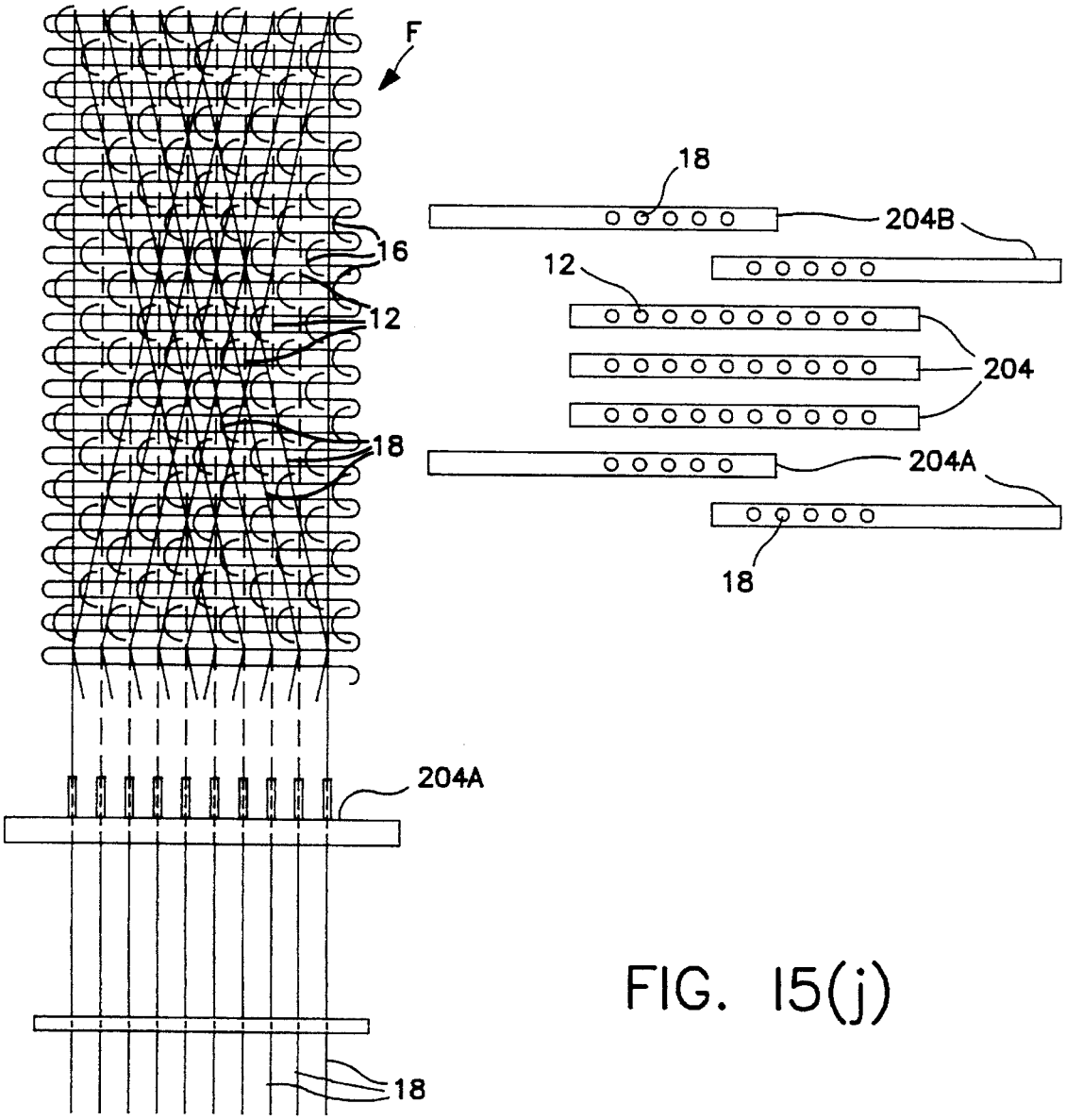
FIG. 15J is a schematic view similar to FIG. 15H after a fifth cycle of the weaving operation has been completed (and wherein at this point of the weaving operation a pair of bias yarn carrier tubes for both the front and back surface of the three-dimensional fabric will begin to move in reverse direction)

Referring now to FIGS. 15 and 16 for further detailed description of the weaving process on apparatus 200, applicant notes that FIG. 15 is a schematic view of the starting position of the weaving cycle for manually operated weaving apparatus 200 shown in FIG. 12 in which the left side of the figure illustrates the front view of weaving apparatus 200 and the right side illustrates a cross-sectional view of the weaving zone. FIG. 15A shows a 1-step movement of a pair of bias yarn carrier tube bars on both sides of three dimensional fabric F being constructed (wherein one step is the center-to-center distance between two adjacent carrier tubes). FIG. 15B shows the first selvage needle moving forward and the first latch needle holding the selvage loop, and FIG. 15C shows the first selvage needle and latch needle returning to their initial position and weft yarn inserted into fabric F. FIG. 15D shows the second selvage needle moving forward through the weft loops and the second latch needle holding the selvage loop and securing the weft loops, and FIG. 15E shows the second selvage needle and latch needle returned to their initial positions. FIG. 15F shows the z-yarn needles inserted from both sides of the weaving zone and passed through the yarn carrier tube and yarn guiding tube corridors (and wherein the weaving steps described immediately hereinbefore are repeated so that weft yarns are inserted again while the z-yarn needles are in the weaving zone). FIG. 15G shows z-yarn insertion needles returned to their starting positions so as to lock the bias yarns, weft yarns and warp yarns together, and FIG. 15H shows a schematic view of the three dimensional fabric formation after one cycle of the weaving operation is completed on manually operated apparatus 200. FIG. 15I is a schematic view similar to FIG. 15H after a second cycle of the weaving operation has been completed, and FIG. 15J is a schematic view similar to FIG. 15H after a fifth cycle of the weaving operation has been completed, and at this point of the weaving cycle the bias yarn carrier tubes for both the front and back surface of fabric F will begin to move in reverse direction.

Figure 17:
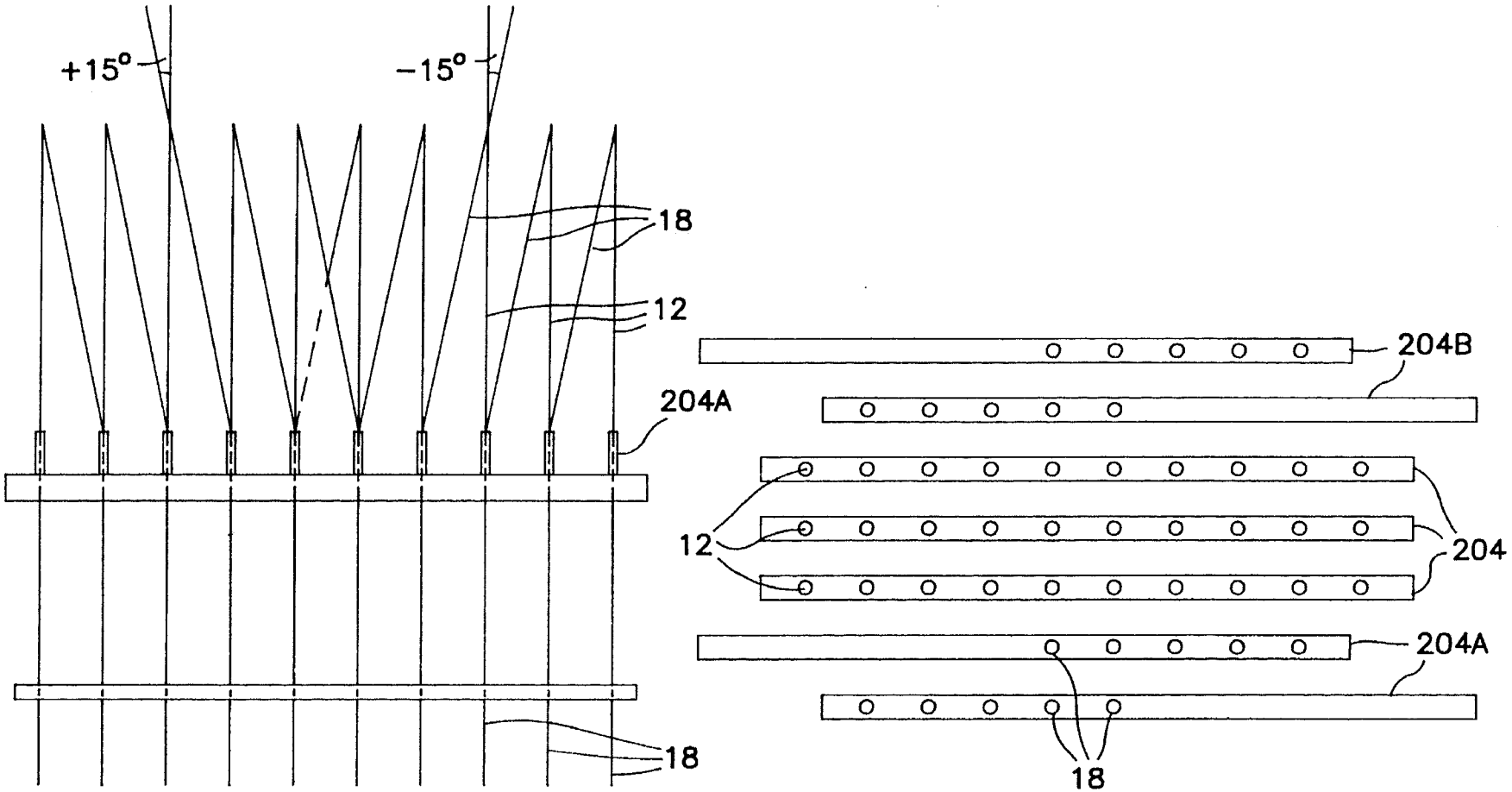
FIG. 17 is a schematic view of a one-step (center-to-center distance between two adjacent carrier tubes) movement of both the positive and negative bias yarn carrier tube bars on both the front and back surface of the three-dimensional fabric on the manually operated apparatus shown in FIG. 12.
Figure 17A:
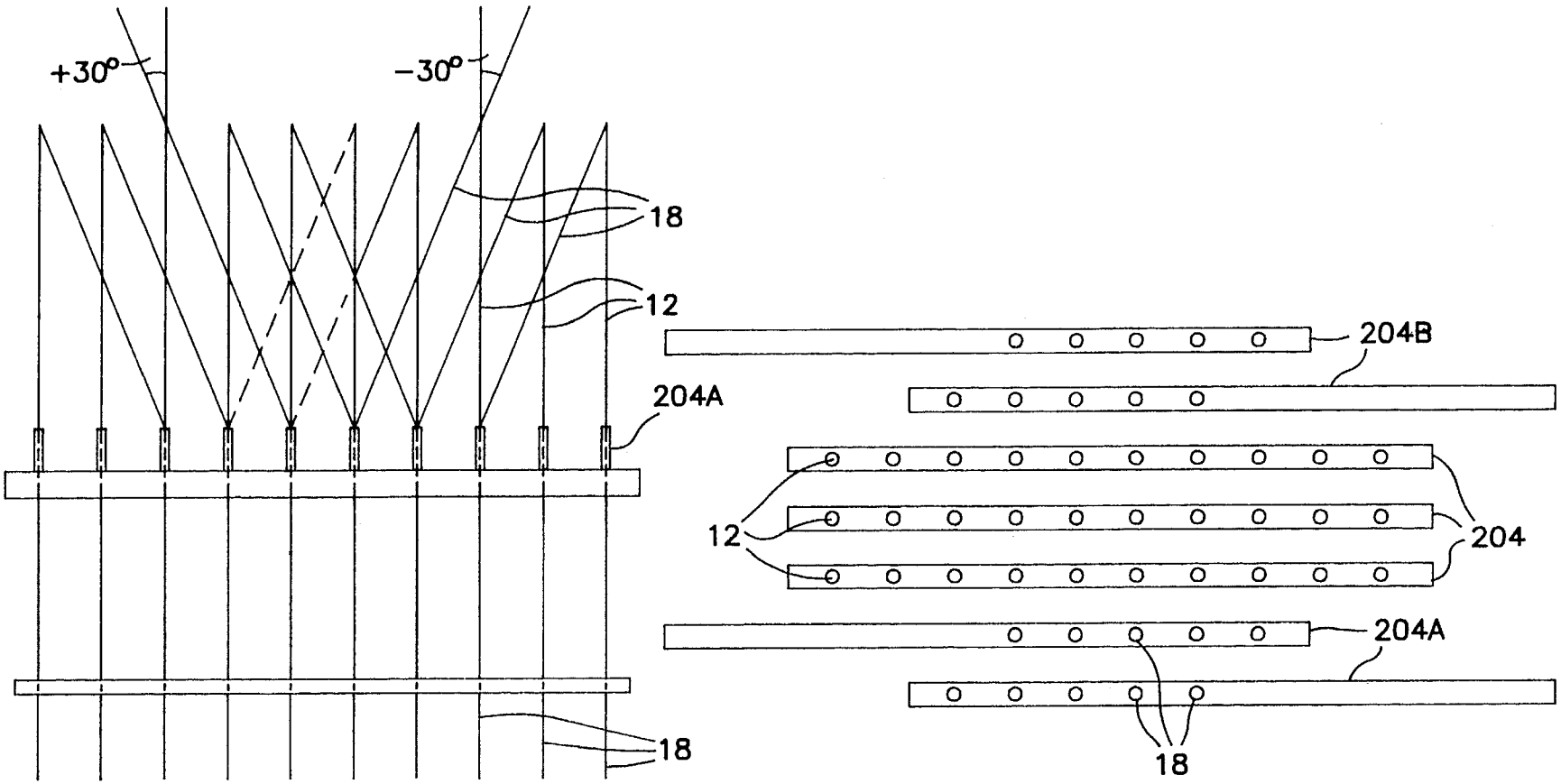
FIG. 17A is a schematic view of a two-step movement of both the positive and negative bias yarn carrier tube bars on both the front and back surface of the three-dimensional fabric wherein both bias yarns are at a 30° orientation with respect to the warp yarns.
Figure 17B:
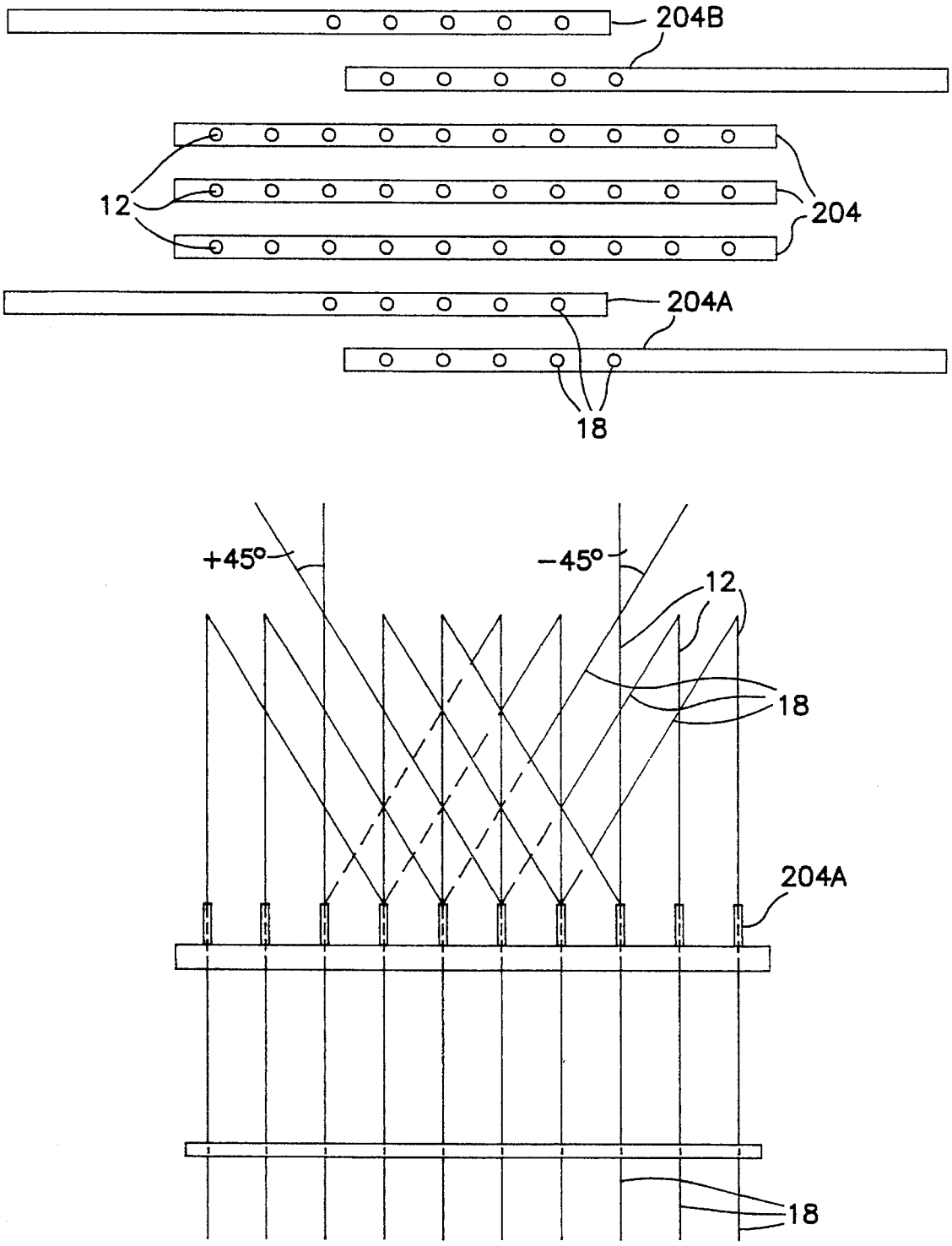
FIG. 17B is a schematic view of a three-step movement of both the positive bias and negative bias yarn carrier tube bars on both the front and rear surface of the three-dimensional fabric wherein both bias yarns make a 45° angle with respect to the warp yarns.
Figure 17C:
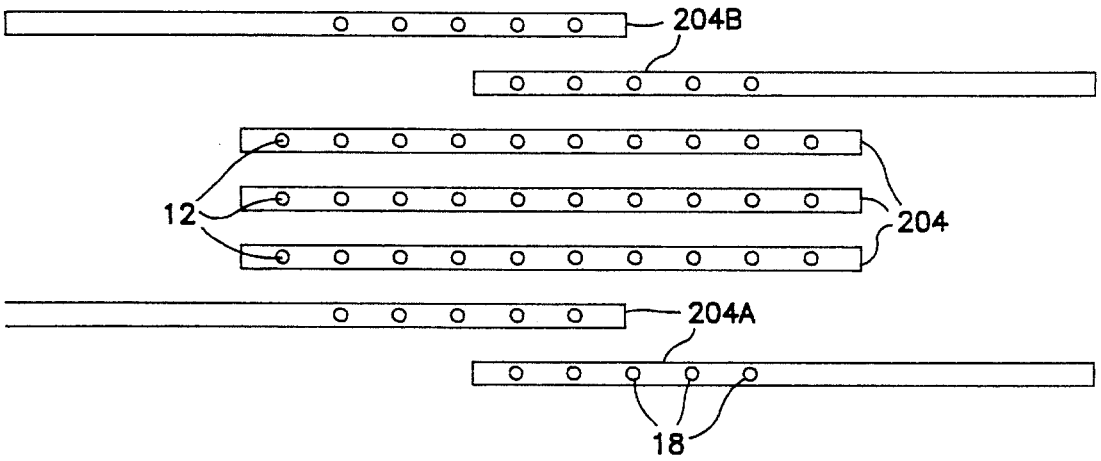
FIG. 17C is a schematic view of a four-step movement of both the positive and negative yarn carrier tube bars on both the front and rear surface of the three-dimensional fabric wherein both bias yarns make a 60° angle with respect to the warp yarns.
Figure 17C:
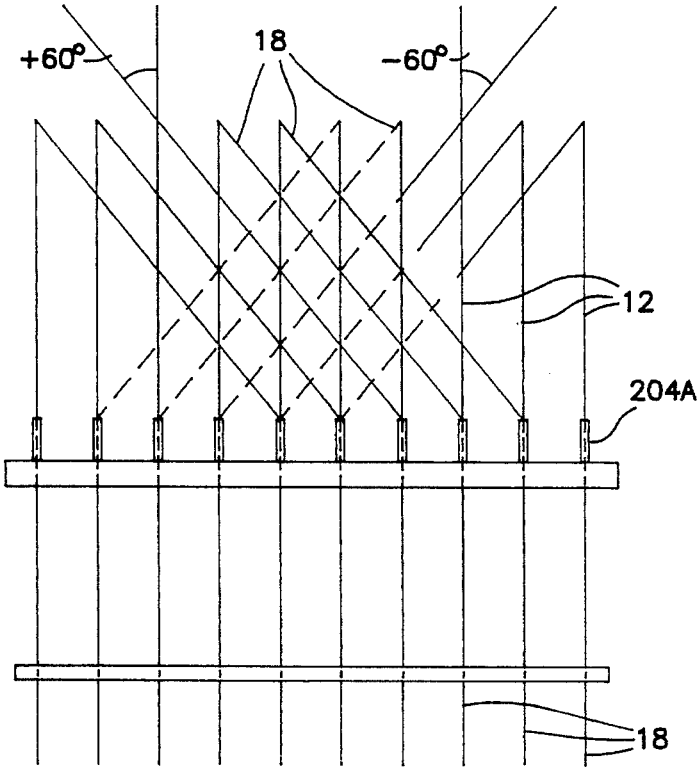

Referring now to FIG. 17, applicant notes that FIG. 17 is a schematic view of a 1-step (center-to-center distance between two adjacent carrier tubes) movement of both the positive and negative bias yarn carrier tube bars on both the front and back surface of fabric F during operation of manually operated apparatus 200. FIG. 17A shows a 2-step movement of both the positive and negative bias yarn carrier tube bars on both the front and back surface of fabric F wherein both bias yarns are at a 30° orientation with respect to the warp yarns. FIG. 17B shows a 3-step movement of both the positive bias and negative bias yarn carrier tube bars on both the front and rear surface of fabric F wherein both bias yarns make a 45° angle with respect to the warp yarns, and FIG. 17C is a schematic view of a 4-step movement of both the positive and negative yarn carrier tube bars on both the front and rear surface of fabric F wherein both bias yarns make a 60° angle with respect to the warp yarns.

The three-dimensional fabric F is used as a preform from which a composite material is formed. Due to the presence of the bias threads on the front and back surfaces of the fabric, the in-plane shear strength and modulus of the resulting woven composite structure is significantly enhanced as will be described in Example 1 hereinbelow.

EXAMPLE 1

A rectangular cross-sectional fabric was formed on apparatus 200 as shown in FIG. 12 and measured 29.67 mm (width)×4.44 mm (thickness). The preform was woven from G 30-500 CELION carbon fibers wherein the warp and bias yarns are 12K tow, and the filling and Z-yarns are 6K and 3K tow, respectively. The preform was impregnated by using 85–15% ratio resin (TACTIX 123) and catalyst (MELAMINE 5260). Thereafter, the preform was placed in a mold and a matrix poured. After the pressure was applied to the mold to cure the preform, the composite was removed from the mold. The specifications of the preform and composite are given in Table 1, below.

TABLE 1

MULTI-AXIAL AND 3-D ORTHOGONAL WOVEN PREFORM AND COMPOSITE SPECIFICATIONS

| | | Multi-axial 3-D Woven | 3-D Orthogonal Woven |
|---|---|---|---|
| Fiber | CELION G 30-500 Carbon fiber | | |
| | Warp yarn | 12 K-HTA-7E with EP-03 Finish | |
| | Weft yarn | 6 K-HTA-7E with EP-03 Finish | |
| | Z-yarn | 3 K-HTA-7E with BP-03 Finish | |
| | +/–Oriented yarn | 12 K-HTA-7E with EP-03 Finish | — |
| Structure | | | |
| | Warp | 3 Layers × 18 Rows | |
| | Weft | 6 Layers (11 double picks/inch) | |
| | Z-yarn | 18 ends (one Z-yarn for every warp row) | |
| | + Oriented yarn | 2 Layers × 9 Rows | — |
| | – Oriented yarn | 2 Layers × 9 Rows | — |
| Cross-section | | Rectangular bar | Rectangular bar |
| Dimensions (mm) | | 29.67 × 4.44 | 28.86 × 3.14 |
| Volume fraction of preform | | 40.46% | — |
| Volume fraction of composite | | 51.795% | 52.003% |
| Density of composite (gr/cm$^3$) | | 1.479 | 1.5024 |
| Composite | | Matrix type Resin (TACTIX 123), 85% Catalyst (MELAMINE 5260), 15% | |
| Impregnation techniques | | Vacuum Impregnation Molding | |
| Applied pressure on the mold | | 900 kgr, 80° C., One Hour | |
| Cure | | 177° C. | |
| Time | | 2 Hours | |

In-plane shear strength and modulus of the multi-axial 3-D woven carbon/epoxy composite were measured using the Iosipescu test method. The results are set forth in Table 2 below. Because of the influence of the bias threads, the in-plane shear strength was increased by about 25% whereas the modulus was increased by about 170%.

TABLE 2

IN-PLANE SHEAR TEST RESULTS

| | Multi-axial 3-D Woven Composite | 3-D Orthogonal Woven Composite |
|---|---|---|
| 1. Test Methods | Iosipescu Shear Test Methods | |
| 2. Direction of Cutting | Warp direction | Warp direction |
| 3. Direction of Loading | Filling | Filling |
| 4. Sample Dimension (depth × width × length, mm) | 4.44 × 19.05 × 76.2 | 3.15 × 19.05 × 76.2 |
| 5. Notch width (mm) | 10.50 | 11.39 |
| 6. In-plane shear strength [MPa] Sample No. | | |
| 1. | 129.25 | 93.27 |
| 2. | 129.70 | 108.91 |
| 3. | 136.26 | 89.58 |
| 4. | 144.13 | 129.77 |
| 5. | 149.32 | 133.09 |
| Average | 137.73 | 110.91 |
| 7. In-plane shear module [GPa] Sample No. | | |
| 1. | 8.07 | 5.09 |
| 2. | 12.54 | 4.75 |
| 3. | 15.63 | 5.67 |
| 4. | 15.61 | 3.87 |
| 5. | 8.66 | 3.22 |

TABLE 2-continued

| IN-PLANE SHEAR TEST RESULTS | | |
|---|---|---|
| | Multi-axial 3-D Woven Composite | 3-D Orthogonal Woven Composite |
| Average | 12.10 | 4.52 |

FIGS. 16 and 16A–16J and FIGS. 17 and FIGS. 17A–17C illustrate step-by-step bias yarn orientation for angles from about ±20° to about ±60° for both apparatus 100 and apparatus 200, respectively, described hereinabove and shown in FIG. 2 and FIG. 12 of the drawings. Specifically, FIGS. 16A–16D illustrate orientation of the bias yarn at 15° in apparatus 100. FIGS. 16E–16I show bias yarn orientation at 30° in apparatus 100 prior to filling yarn insertion. It will be appreciated that 45° and 60° bias yarn orientation are easily achieved by repeating the yarn carrier movement for a third and fourth time, respectively. Also, FIG. 17 shows bias yarn orientation at 15° on apparatus 200. FIGS. 17A, 17B and 17C show orientation of the bias yarn on apparatus 200 at 30°, 45° and 60° angles, respectively.

Finally, applicants wish to note that many different materials may be useful for weaving the multi-axial, three-dimensional fabric according to the present invention. These materials include, but are not limited to, organic fibrous materials such as cotton, linen, wool, nylon, polyester and polypropylene and the like, and other inorganic fibrous materials such as glass fibre, carbon fibre, metallic fiber, asbestos and the like. These representative fibrous materials may be used in either filament or spun form.

It will be understood that various details of the invention may be changed without departing from the scope of the invention. Furthermore, the foregoing description is for the purpose of illustration only, and not for the purpose of limitation—the invention being defined by the claims.

What is claimed is:

1. A three-dimensional fabric formed from five yarn systems comprising:

(a) a plurality of warp thread layers comprising a plurality of warp threads arranged in parallel with a longitudinal direction of said fabric and defining a plurality of rows and columns wherein said rows define a front and a back surface;

(b) at least one first pair of bias thread layers positioned on the front surface of said plurality of warp yarn layers and comprising a plurality of continuous bias threads arranged so that each layer is inclined symmetrically with respect to the other layer and inclined with respect to the warp threads;

(c) at least one second pair of bias thread layers positioned on the back surface of said plurality of warp yarn layers and comprising a plurality of continuous bias threads arranged so that each layer is inclined symmetrically with respect to the other layer and inclined with respect to the warp threads;

(d) a plurality of threads arranged in a thicknesswise direction of said fabric and extending between said first and second pair of bias thread layers and perpendicularly intersecting the warp threads between adjacent columns thereof; and (e) a plurality of weft threads arranged in a widthwise direction of said fabric and perpendicularly intersecting the warp threads between adjacent rows thereof.

2. A three-dimensional fabric according to claim 1 wherein the layers of said first pair of bias thread layers define an angle of between ±20° to ±60° therebetween.

3. A three-dimensional fabric according to claim 1 wherein the layers of said second pair of bias thread layers define an angle of between ±20° to ±60° therebetween.

4. A three-dimensional fabric according to claim 1 wherein said plurality of threads arranged in the thicknesswise direction of said fabric are individually continuous and laid in said fabric so as to interlock the warp threads, bias threads and weft threads.

5. A three-dimensional fabric according to claim 1 wherein said plurality of threads arranged in the thicknesswise direction of said fabric define a plurality of thread layers.

6. A three-dimensional fabric according to claim 1 wherein said plurality of weft threads define a plurality of weft thread layers.

7. A method for producing a three-dimensional fabric formed from five yarn systems comprising the steps of:

(a) providing a plurality of warp thread layers comprising a plurality of warp threads arranged in parallel with a longitudinal direction of said fabric and defining a plurality of rows and columns wherein said rows define a front and a back surface;

(b) providing at least one first pair of bias thread layers positioned on the front surface of said plurality of warp yarn layers and comprising a plurality of continuous bias threads initially arranged so that each layer is substantially parallel with respect to the other layer and with respect to the warp threads;

(c) providing at least one second pair of bias thread layers positioned on the back surface of said plurality of warp yarn layers and comprising a plurality of continuous bias threads initially arranged so that each layer is substantially parallel with respect to the other layer and with respect to the warp threads;

(d) providing a plurality of threads adapted to be arranged in a thicknesswise direction of said fabric and extending between said first and second pair of bias thread layers and perpendicularly intersecting the warp threads between adjacent columns thereof;

(e) providing a plurality of weft threads adapted to be arranged in a widthwise direction of said fabric and perpendicularly intersecting the warp threads between adjacent rows thereof;

(f) manipulating said first and second pairs of bias thread layers so that each layer of each respective pair is inclined symmetrically with respect to the other layer and with respect to the warp threads;

(g) inserting said plurality of weft threads from a starting position so as to perpendicularly intersect the warp threads between adjacent rows thereof and returning said weft threads to their starting position;

(h) inserting said plurality of threads adapted to be arranged in a thicknesswise direction of said fabric from a starting position so as to perpendicularly intersect the warp threads between adjacent columns thereof and to traverse said previously inserted plurality of weft threads, said plurality of threads not being returned to their starting position subsequent to traversing said fabric;

(i) again inserting said plurality of weft threads from a starting position so as to perpendicularly intersect the warp threads between adjacent rows thereof and returning said weft threads to their starting position; and (j) returning said plurality of threads adapted to be arranged in a thicknesswise direction of said fabric to their starting position and again perpendicularly intersecting the warp threads between adjacent columns thereof and traversing said secondly inserted plurality of weft threads so as to lock said first and second bias thread layers and said plurality of weft threads in place.

8. A method for producing a three-dimensional fabric according to claim 7 including manipulating the layers of said first pair of bias thread layers so as to define an angle of between ±20° to ±60° therebetween.

9. A three-dimensional fabric according to claim 7 including manipulating the layers of said second pair of bias thread layers so as to define an angle of between ±20° to ±60° therebetween.

10. A three-dimensional fabric according to claim 7 including the step of securing each insertion of said plurality of weft threads with a selvage yarn on opposing sides of said fabric.

* * * * *